US007382383B2

(12) United States Patent
Shiomi et al.

(10) Patent No.: US 7,382,383 B2
(45) Date of Patent: Jun. 3, 2008

(54) DRIVING DEVICE OF IMAGE DISPLAY DEVICE, PROGRAM AND STORAGE MEDIUM THEREOF, IMAGE DISPLAY DEVICE, AND TELEVISION RECEIVER

(75) Inventors: Makoto Shiomi, Tenri (JP); Tomoo Furukawa, Matsusaka (JP); Koichi Miyachi, Kyoto (JP); Kazunari Tomizawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 740 days.

(21) Appl. No.: 10/815,693

(22) Filed: Apr. 2, 2004

(65) Prior Publication Data

US 2004/0196234 A1 Oct. 7, 2004

(30) Foreign Application Priority Data

Apr. 2, 2003 (JP) ..... 2003-099637
Apr. 2, 2003 (JP) ..... 2003-099645

(51) Int. Cl.
*G09G 5/10* (2006.01)

(52) U.S. Cl. ..... 345/690

(58) Field of Classification Search ..... 345/98, 345/690; 348/671, 673, 678; 353/31; 358/463, 358/520; 425/324
See application file for complete search history.

(56) References Cited

U.S. PATENT DOCUMENTS 6,040,876 A 3/2000 Pettitt et al.
6,052,113 A 4/2000 Foster
6,667,815 B1 * 12/2003 Nagao ..... 358/1.9
2001/0026283 A1 10/2001 Yoshida et al.
2002/0033769 A1 3/2002 Miyata et al.

(Continued)

FOREIGN PATENT DOCUMENTS

EP 1122711 A2 8/2001

(Continued)

OTHER PUBLICATIONS

European Search Report for corresponding Aspplication No. 04252014.8.

(Continued)

*Primary Examiner*—Richard Hjerpe
*Assistant Examiner*—Abbas Abdulselam
(74) *Attorney, Agent, or Firm*—Harness, Dickey & Pierce

(57) ABSTRACT

A noise adding circuit adds noise data to video data, and a circuit rounds a less significant bit, so as to output video data of 6 bits from 8 bit input data for example. The video data of 6 bits is stored in a frame memory until a further next frame, and a previous frame grayscale correction circuit corrects video data of a previous frame as required so that the video data of the previous frame approaches video data of a further previous frame. It then outputs thus corrected video data. Further, a modulation processing section corrects video data of a current frame so as to emphasize grayscale transition from the video data of the previous frame which is outputted by the previous frame grayscale correction circuit. Thus, it is possible to realize a driving device of an image display device, which can improve a response speed of pixels and has a simple arrangement, without apparently deteriorating display quality of an image displayed in the pixels.

119 Claims, 25 Drawing Sheets

U.S. PATENT DOCUMENTS

| | | | |
|---|---|---|---|
| 2002/0044115 | A1 | 4/2002 | Jinda et al. |
| 2003/0058264 | A1 | 3/2003 | Takako et al. |
| 2003/0218591 | A1 | 11/2003 | Shen et al. |

FOREIGN PATENT DOCUMENTS

| | | |
|---|---|---|
| JP | 2650479 | 5/1997 |
| JP | 2001-337667 | 12/2001 |
| JP | 2002-116743 | 4/2002 |

OTHER PUBLICATIONS

Berbecel, Gheorghe, "*Digital Image Display: Algorithms and Implementation*," Mar. 18, 2003, John Wiley & Sons, Chichester, XP002458864.

European Search Report mailed Nov. 30, 2007.

* cited by examiner

| DISPLAYED GRAYSCALE | TRANSMIT-TANCE | GRAYSCALE INCREMENT x | | | | | | |
|---|---|---|---|---|---|---|---|---|
| | | 4 | 8 | 12 | 16 | 24 | 32 | 48 |
| 32 | 1.04% | 1.03% | 4.74% | 11.56% | 21.76% | 53.10% | 100.00% | 244.01% |
| 64 | 4.78% | 0.22% | 1.03% | 2.52% | 4.74% | 11.56% | 21.76% | 53.10% |
| 128 | 21.95% | 0.05% | 0.22% | 0.55% | 1.03% | 2.52% | 4.74% | 11.56% |
| 192 | 53.56% | 0.02% | 0.09% | 0.22% | 0.42% | 1.03% | 1.94% | 4.74% |

| DISPLAYED GRAYSCALE | TRANSMIT-TANCE | GRAYSCALE INCREMENT x | | | | | | |
|---|---|---|---|---|---|---|---|---|
| | | 4 | 8 | 12 | 16 | 24 | 32 | 48 |
| 32 | 1.04% | 0.31% | 0.66% | 1.06% | 1.50% | 2.52% | 3.74% | 6.77% |
| 64 | 4.78% | 0.68% | 1.41% | 2.20% | 3.03% | 4.85% | 6.88% | 11.59% |
| 128 | 21.95% | 1.54% | 3.13% | 4.78% | 6.49% | 10.09% | 13.91% | 22.28% |
| 192 | 53.56% | 2.49% | 5.03% | 7.64% | 10.31% | 15.84% | 21.63% | 33.95% |

FIG. 9

| S \ E | 0 | 32 | 64 | 96 | 128 | 160 | 192 | 224 | 255 |
|---|---|---|---|---|---|---|---|---|---|
| 0 | 0 | 35 | 63 | 93 | 123 | 155 | 176 | 192 | 194 |
| 32 | 26 | 32 | 63 | 94 | 125 | 157 | 189 | 223 | 239 |
| 64 | 42 | 42 | 64 | 95 | 126 | 157 | 188 | 224 | 246 |
| 96 | 56 | 56 | 65 | 96 | 127 | 159 | 190 | 224 | 249 |
| 128 | 64 | 64 | 64 | 96 | 128 | 158 | 190 | 223 | 251 |
| 160 | 76 | 76 | 76 | 97 | 128 | 160 | 191 | 225 | 253 |
| 192 | 90 | 90 | 90 | 99 | 128 | 160 | 192 | 224 | 254 |
| 224 | 112 | 112 | 112 | 112 | 129 | 160 | 191 | 224 | 254 |
| 255 | 134 | 134 | 134 | 134 | 134 | 159 | 192 | 223 | 255 |

α2

α1

FIG. 12

| S \ E | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 176 | 192 | 194 |
| 32 | 26 | 32 | 64 | 96 | 128 | 160 | 192 | 224 | 239 |
| 64 | 42 | 42 | 64 | 96 | 128 | 160 | 192 | 224 | 255 |
| 96 | 56 | 56 | 64 | 96 | 128 | 160 | 192 | 224 | 255 |
| 128 | 64 | 64 | 64 | 96 | 128 | 160 | 192 | 224 | 255 |
| 160 | 76 | 76 | 76 | 96 | 128 | 160 | 192 | 224 | 255 |
| 192 | 90 | 90 | 90 | 96 | 128 | 160 | 192 | 224 | 255 |
| 224 | 112 | 112 | 112 | 112 | 128 | 160 | 192 | 224 | 255 |
| 255 | 134 | 134 | 134 | 134 | 134 | 160 | 192 | 224 | 255 |

α2

α1

α3

FIG. 21

| D | GRAYSCALE VOLTAGE | Db |
|---|---|---|
| 0 | 1.09 | 79 |
| 32 | 1.33 | 202 |
| 64 | 1.55 | 343 |
| 96 | 1.76 | 467 |
| 128 | 2.01 | 589 |
| 160 | 2.31 | 702 |
| 192 | 2.73 | 809 |
| 224 | 3.52 | 915 |
| 255 | 6.5 | 1013 |

DRIVING DEVICE OF IMAGE DISPLAY DEVICE, PROGRAM AND STORAGE MEDIUM THEREOF, IMAGE DISPLAY DEVICE, AND TELEVISION RECEIVER

This Nonprovisional application claims priority under 35 U.S.C. § 119(a) on Patent Application No. 2003/99637 filed in Japan on Apr. 2, 2003 and Patent Application No. 2003/99645 filed in Japan on Apr. 2, 2003, the entire contents of which are hereby incorporated by reference.

FIELD OF THE INVENTION

The present invention generally relates to a driving device of an image display device, a program and/or a storage medium thereof, an image display device, and/or a television receiver.

BACKGROUND OF THE INVENTION

Liquid crystal display devices with low operating power are in widespread use not only in mobile devices but also in stationary type devices. As such a liquid crystal display device, there exists a liquid crystal display device in which: digital signals indicative of grayscales of respective pixels are supplied to a data signal driving circuit, and the data signal driving circuit applies voltages, corresponding to values of the digital signals, to data signal lines, thereby controlling grayscales displayed in the pixels.

In the liquid crystal display device, data for determining a voltage applied to each pixel of the display panel is transferred as a digital signal. Thus, when a bit width of grayscale data indicative of a grayscale is enlarged so as to display a finer grayscale, a circuit size or a computing amount of a circuit for processing the digital signal is increased. On the other hand, when the bit width is narrowed by truncating less significant bits so as to reduce the circuit size or the computing amount, a pseudo outline occurs in an image displayed in a display panel, so that display quality is significantly deteriorated.

Here, in order to realize an image display device which can improve the display quality with a simple circuit while preventing occurrence of the pseudo outline, Japanese Unexamined Patent Publication No. 337667/2001 (Tokukai 2001-337667)(Publication date: Dec. 7, 2001) discloses a technique in which: after adding a noise to the digital signal, the less significant bits are truncated. Specifically, when a digital signal of n bit (n is a natural number) is inputted as a video signal, a first signal processing section 516 shown in FIG. 26 performs γ correction with respect to the digital signal of n bit, so as to convert the digital signal into a digital signal of m bit (m>n: m is a natural number). Further, a second signal processing section 517 adds a noise signal to the digital signal of m bit that has been outputted from the first signal processing section 516, and then truncates a less significant (m−Q) bit (Q≦n: Q is a natural number), and outputs a digital signal of remaining Q bit to a data signal line driving circuit 514 of the display panel. Further, the data signal line driving circuit 514 outputs, via a data signal line, a voltage corresponding to the digital signal of Q bit that has been outputted from the second signal processing section 517, thereby controlling the grayscales displayed in the pixels.

In this arrangement, a bit width (Q bit) of the digital signal outputted from the second signal processing section 517 is set to be shorter than a bit width (m bit) of the digital signal outputted from the first signal processing section 516. As such, its circuit arrangement is simplified as compared with a case where the data signal line driving circuit 514. Thus, it is possible to process the digital signal outputted by the first signal processing section 516.

Further, the second signal processing section 517 adds the noise signal, and then truncates the less significant bits. Thus, unlike the case of merely truncating the less significant bits, pixels adjacent to each other are not greatly different from each other in terms of the displayed grayscale. As a result, it is possible to realize an image display device which can improve the display quality with a simple circuit while preventing occurrence of the pseudo outline.

While, compared with a CRT (Cathode-Ray Tube) and the like, a response speed of the liquid crystal display device is slow. Thus, there is a case where the response is not completed in a rewriting time (16.7 msec), corresponding to an ordinary frame frequency (60 Hz), due to a transition grayscale.

A method has been adopted, in which a driving signal is modulated and driven so as to emphasize grayscale transition from a grayscale indicated by previous grayscale data to a grayscale indicated by current grayscale data (see Japanese Unexamined Patent Publication No. 116743/2002 (Tokukai 2002-116743)(Publication date: Apr. 19, 2002) for example).

For example, in case where grayscale transition from a previous frame FR (k−1) to a current frame FR (k) is "rise", a voltage is applied to the pixel so as to emphasize the grayscale transition from a grayscale indicated by the previous grayscale data to a grayscale indicated by the current grayscale data. More specifically, a voltage whose level is higher than a voltage level indicated by video data D (i, j, k) of the current frame FR (k) is applied to the pixel.

As a result, when the grayscale varies, a luminance level of the pixel sharply increases and approaches a vicinity of a luminance level corresponding to the video data D (i, j, k) of the current frame FR (k) in a short period compared with a case where a voltage whose level is indicated by the video data D (i, j, k) of the current frame FR (k) is applied. Thus, even when the response speed of the liquid crystal is low, it is possible to improve the response speed of the liquid crystal display device.

Further, Japanese Patent Publication No. 2650479 (Date of Patent: Sep. 3, 1997) discloses a display device in which: a transmittance curve is made or predicted in accordance with signal data of at least three sequential fields that are applied to arbitrary pixels, and the signal data of the sequential fields are corrected when the transmittance curve deviates from a desired transmittance curve by a predetermined value or more.

Specifically, as shown in FIG. 27, in the display device 501*a*, a data input device 521 stores video data to the pixels are stored in a field memory 522. Further, a data correction device 523 refers to the field memory 522, and corrects the video data of the field memory 522 when a difference between an ideal transmittance and an actually predicted transmittance is larger than a predetermined threshold value. Further, a data output device 524 sequentially reads out thus corrected video data of the field memory 522, so as to drive pixels (not shown).

SUMMARY OF THE INVENTION

Incidentally, a second signal processing section of the arrangement disclosed by Tokukai 2001-337667 has to detect how many grayscales the display element can display, and has to truncate bits so that the number of bits corresponds to the grayscales. It further has to add a noise corresponding to widths of thus truncated bits.

Thus, it is desirable to dispose the second signal processing section close to the display element of the display panel so that grayscales which can be displayed by the display element of the display panel are specified and the widths of the truncated bits are specified. In Tokukai 2002-116743, a processing section for emphasizing the grayscale transition has to emphasize the grayscale transition so that grayscale displayed by a pixel of the display panel reaches desired grayscale. Thus, it is desirable to dispose the processing section close to the display panel so that how much the grayscale transition should be emphasized so as to reach the desired grayscale is specified and appropriate emphasis of the grayscale transition is determined.

Further, according to the foregoing conventional arrangements, when target grayscale is a minimum grayscale or a maximum grayscale, the grayscale transition cannot be sufficiently emphasized.

For example, in case where the grayscale transition from the previous frame to the current frame is grayscale transition from a maximum grayscale to a minimum grayscale, even when the processing section for emphasizing the grayscale transition is to emphasize the grayscale transition, the grayscale transition cannot be emphasized any more since the grayscale transition is the grayscale transition from the maximum grayscale to the minimum grayscale. Thus, it is impossible to sufficiently emphasize the response speed of the pixels.

The inventors earnestly studied in order to realize a driving device of an image display device which can suppress apparent deterioration of display quality and can drive a display element at a high speed with a smaller circuit size and a smaller computing amount. They found that it is more preferable to perform a process for adding a noise before performing a process for emphasizing the grayscale transition. As a result, various embodiments of the present invention were devised.

An object of an embodiment of the present invention includes realizing a driving device of an image display device, which can improve the response speed of the pixels and which has a simple arrangement, without apparently deteriorating the display quality of an image displayed in the pixels.

Further, another object of an embodiment of the present invention is to realize a driving device of an image display device which can improve the response speed of the pixels even when grayscale transition to the minimum grayscale is required.

In order to achieve an object, a driving device of an image display device according to an embodiment of the present invention includes: an input terminal for receiving first tone data indicative of a current tone of each of pixels; noise adding means for adding noise data to the first tone data inputted to the input terminal, and rounding a less significant bit whose bit width is predetermined, so as to generate second tone data; noise generating means for generating the noise data so that the noise data added to the first tone data supplied to the pixels of the same color which are adjacent to each other have random volumes; storage means for storing current second tone data of the pixel until next second tone data is inputted; and first correction means for correcting the current second tone data, in accordance with previous second tone data read out from the storage means, so as to facilitate tone transition from the previous second tone data to the current second tone data.

In the foregoing arrangement, when the first tone data indicative of the current tone of each pixel is inputted, the noise adding means adds the noise data to the first tone data inputted to the input terminal, and rounds the less significant bit, so as to generate the second tone data. The current second tone data of each pixel that has been generated by the noise adding means is stored in the storage means until the next time, and the first correction means corrects the current second tone data, in accordance with the previous second tone data read out from the storage means and the current second tone data inputted from the noise adding means, so as to emphasize the tone transition from the previous time to the current time.

In the arrangement, a bit width of the second tone data stored in the storage means is set to be shorter than that of the first tone data by rounding the less significant bit. Thus, it is possible to reduce the storage capacity required in the storage means. Further, a bit width of the tone data processed by circuits (the storage means, the first correction means, and the like) positioned after the noise adding means is reduced, so that it is possible to reduce a circuit size of these circuits and to reduce the computing amount thereof. In addition, it is possible to reduce the number of wirings for connecting these circuits and to reduce an area occupied by the wirings.

Further, the noise generating means generates the noise data so that the noise data added to the first tone data to the pixels of the same color which are adjacent to each other have random volumes. Thus, unlike an arrangement in which a pseudo outline occurs in an image displayed in the pixels when the less significant bit of the first tone data is truncated so as to generate the second tone data, the foregoing arrangement brings about no pseudo outline.

As a result, although the bit width of the second tone data is shorter than that of the first tone data, it is possible to keep the display quality of an image displayed in the pixels under such condition that the display quality does not apparently different from that in the case of displaying an image based on the first tone data.

Further, the first correction means emphasizes the tone transition from the previous time to the current time, so that it is possible to improve the response speed of the pixels. Here, in case where the first correction means is provided at the following stage of the noise adding means, a noise is added to the data after emphasizing the tone transition. Thus, the tone transition may be excessively emphasized, so that the luminance of the pixels is undesirably increased. As a result, there is a possibility that this excessive emphasis of the tone transition may be recognized by the user of the image display device as excess brightness.

Alternatively, the tone transition may be insufficiently emphasized, so that the luminance of the pixel is undesirably reduced. As a result, there is a possibility that the insufficient emphasis may be recognized as poor brightness. However, according to the foregoing arrangement, the first correction means is provided at the following stage of the noise adding means, so that it is possible to improve the response speed of the pixels without bringing about excess or poor brightness that are caused by the addition of the noise, unlike the case where the first correction means is provided at the previous stage of the noise adding means.

As a result, it is possible to realize the driving device of the image display device which can improve the response speed of the pixels and can reduce the circuit size and the computing amount without apparently deteriorating the display quality of an image displayed in the pixels.

While, in order to achieve an object, a driving device of an image display device according to an embodiment of the present invention includes: tone conversion means for converting first tone data indicative of a current tone of each of pixels into second tone data having a γ property larger than a γ property of the first tone data; storage means for storing current second tone data until next time; and correction means for correcting the current second tone data, in accordance with previous second tone data read out from the storage means, so as to facilitate tone transition from the previous second tone data to the current tone data, wherein a lowest possible limit of the second tone data which varies according to conversion of the first tone data is set to be higher than a lower limit of a representable value range of the second tone data.

In the foregoing arrangement, the correction means corrects the current second tone data so as to emphasize the tone transition from the previous time to the current time, so that it is possible to improve the response speed of the pixels. Besides, in the foregoing arrangement, the tone conversion means converts the first tone data into the second tone data having a larger γ property. Further, a lowest possible limit of the second tone data which varies according to conversion of the first tone data is set to be higher than a lower limit of a representable value range of the second tone data.

Thus, in case where the pixel for displaying an image based on the second tone data displays a tone indicated by the second tone data, there are a larger number of dark tones than the case where the γ conversion is not performed. Further, a value of second tone data which corresponds to a lower limit (black level) of the first tone data is not the lower limit of the second tone data. Thus, the correction means can use second tone data indicative of a tone lower than a tone of the foregoing second tone data in emphasizing the tone transition, so that it is possible to improve the response speed of the pixels.

For a fuller understanding of the nature and advantages of the invention, reference should be made to the ensuing detailed description of exemplary embodiments taken in conjunction with the accompanying drawings.

BRIEF DESCRIPTION OF THE DRAWINGS

FIG. 9 shows content of a Look Up Table provided to the modulated-drive processing section.

FIG. 12 shows another embodiment of the present invention, and shows content of a Look Up Table provided to the modulated-drive processing section.

FIG. 21 shows operations of the grayscale conversion circuit and the data signal line driving circuit that are provided in the modulated-drive processing section, and shows a relationship among (i) a value range before performing the grayscale conversion, (ii) a value range after performing the grayscale conversion, and (iii) a voltage applied to the pixel.

DESCRIPTION OF THE EMBODIMENTS

Embodiment 1

The following description will explain one embodiment of the present invention with reference to FIG. 1 to FIG. 9. That is, an image display device 1 according to the present embodiment can improve a response speed of pixels so that display quality of an image displayed in the pixels does not apparently deteriorate, and can reduce a circuit size and a computing amount. The image display device 1 of the present embodiment can be preferably used as an image display device of a television receiver for example. Note that, examples of television broadcast received by the television receiver include (i) ground wave television broadcast, (ii) satellite broadcast such as BS (Broadcasting Satellite) digital broadcast and CS (Communication Satellite) digital broadcast, and (iii) cable television broadcast.

Figure 2:
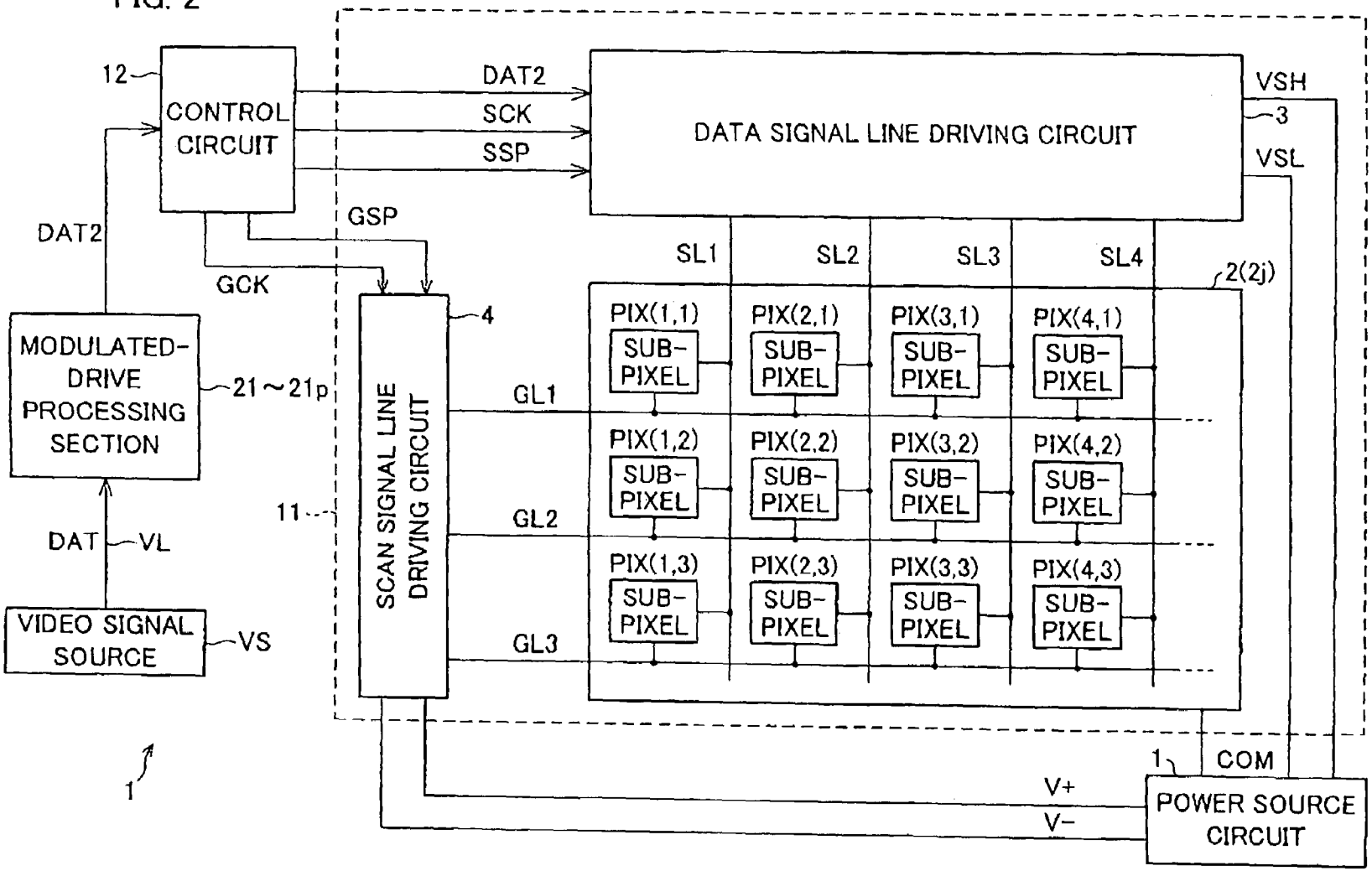
FIG. 2 is a block diagram showing an important portion of the image display device.

In a panel 11 of the image display device 1, for example, sub-pixels which can display colors of R, G, B constitute a single pixel, and a luminance of the sub-pixels is controlled, so that the panel 11 can display colors. For example, as shown in FIG. 2, the panel 11 includes: a pixel array 2 having sub-pixels SPIX (1,1) to SPIX (n, m) disposed in a matrix manner; a data signal line driving circuit 3 for driving data signal lines SL1 to SLn of the pixel array 2; and a scanning signal line driving circuit 4 for driving scanning signal lines GL1 to GLm of the pixel array 2.

Further, the image display device 1 includes: a control circuit 12 for supplying control signals to both the driving circuits 3 and 4; and a modulated-drive processing section (driving device) 21 for modulating a video signal, supplied to the control circuit 12, in accordance with an inputted video signal, so as to emphasize the grayscale transition. Note that, these circuits are operated by power supplied from a power source circuit 13. Further, in the present embodiment, three sub-pixels SPIX adjacent to each other in a direction along the scanning signal lines GL1 to GLm constitute a single pixel PIX. Further, the sub-pixels SPIX (1, 1) . . . according to the present embodiment correspond to pixels recited in claims.

Here, a schematic arrangement and operations of the entire image display device 1 will be explained before detailing an arrangement of the modulated-drive processing section 21. Further, for convenience in description, numbers or alphabets each of which indicates a position are added only in a case where it is necessary to specify the position like an i-th data signal line SLi, and signs each of which indicates the position are omitted in case where it is not necessary to specify the position or in case where members are generically referred to.

The pixel array 2 includes: a plurality of (in this case, n) data signal lines SL1 to SLn; and a plurality of (in this case, m) scanning signal lines GL1 to GLm which respectively cross the data signal lines SL1 to SLn. When an arbitrary integer among 1 to n and an arbitrary integer among 1 to m are j, the sub-pixel SPIX (i, j) is provided with each combination of the data signal line SLi and the scanning signal line GLj.

In the case of the present embodiment, each sub-pixel SPIX (i, j) is disposed on a portion surrounded by two data signal lines SL(i−1) and SLi adjacent to each other and two scanning signal lines GL(j−1) and GLj adjacent to each other.

Figures 3, 4, 5:
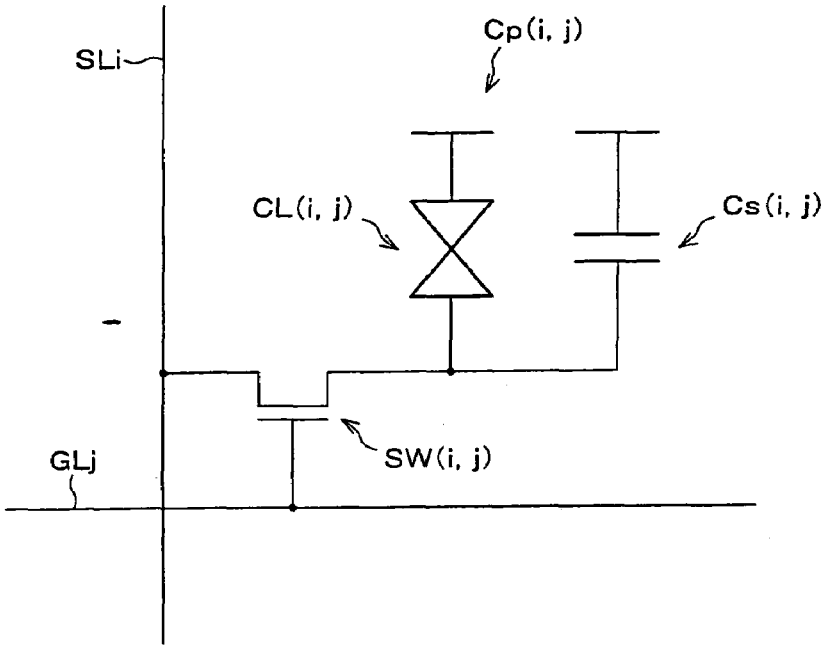
FIG. 3 is a circuit diagram showing an example of an arrangement of a pixel provided in the image display device.
FIG. 4 shows how a transmittance of the pixel increases with respect to a peripheral luminance in terms of percent when a grayscale displayed in the pixel is increased by x grayscale.
FIG. 5 shows how a transmittance of the pixel increases with respect to an original luminance in terms of percent when a grayscale displayed in the pixel is increased by x grayscale.

As an example, a case where the image display device 1 is a liquid crystal display device is described as follows. For example, the sub-pixel SPIX (i, j) includes: a field-effect transistor SW (i, j), whose gate is connected to the scanning signal line GLj and drain is connected to the data signal line SLi, as a switching element; and a pixel capacitor Cp (i, j) whose one electrode is connected to a source of the field-effect transistor SW (i, j) as shown in FIG. 3. Further, the other electrode of the pixel capacitor Cp (i, j) is connected to a common electrode line which is shared by all the sub-pixels SPIX . . . The pixel capacitor Cp (i, j) is constituted of a liquid crystal capacitor CL (i, j) and an auxiliary capacitor Cs (i, j) which is added as required.

In the sub-pixel SPIX (i, j), when the scanning signal line GLj is selected, the field-effect transistor SW (i, j) conducts, so that a voltage applied to the data signal line SLi is applied to the pixel capacitor Cp (i, j). While the field-effect transistor SW (i, j) turns OFF after the selection period of the scanning signal line GLj, the pixel capacitor Cp (i, j) continues to retain a voltage obtained in turning OFF. Here, a transmittance or a reflectance of liquid crystal varies depending on a voltage applied to the liquid crystal capacitor CL (i, j). Thus, when the scanning signal line GLj is selected and a voltage corresponding to video data D (i, j, k) sent to the sub-pixel SPIX (i, j) is applied to the data signal line SLi, it is possible to vary a display condition of the sub-pixel SPIX (i, j) so as to correspond to the video data D (i, j, k).

The liquid crystal display device according to the present embodiment uses, as a liquid crystal cell, a vertical-alignment mode liquid crystal cell in which: its liquid crystal molecules are aligned substantially in a vertical direction with respect to a substrate in receiving no voltage, and its molecules slant from a condition, under which they are aligned in a vertical direction, in accordance with a voltage applied to the liquid crystal capacitor CL (i, j) of the sub-pixel SPIX (i, j). The liquid crystal cell is used in a normally black mode (in which a black state is displayed in receiving no voltage).

In the foregoing arrangement, a scanning signal line driving circuit 4 shown in FIG. 2 outputs a signal indicative of whether it is a selection period or not, i.e., a voltage signal and the like, to each of the scanning signal lines GL1 to GLm. Further, the scanning signal line driving circuit 4 changes the scanning signal line GLj for outputting a signal indicative of the selection period, for example, in accordance with a timing signal, such as a clock signal GCK and a start pulse signal GSP, supplied from the control circuit 12. Thus, the respective scanning signal lines GL1 to GLm are sequentially selected at predetermined timings.

Further, a data signal line driving circuit 3 extracts video data . . . , inputted to the sub-pixels SPIX . . . in a time-divisional manner, as video signals, by sampling the video data D . . . or in a similar manner at predetermined timings. Further, the data signal line driving circuit 3 outputs output signals, corresponding to the respective video data, to the sub-pixels SPIX (1, j) to SPIX (n, j) that correspond to the scanning signal lines GLj being selected by the scanning signal line driving circuit 4, via the respective data signal lines SL1 to SLn.

Note that, the data signal line driving circuit 3 determines a timing of the sampling and an output timing of an output signal in accordance with a timing signal, such as a clock signal SCK and a start pulse signal SSP, that is inputted from the control circuit 12.

While the corresponding scanning signal lines GLj are being selected, the sub-pixels SPIX (1, j) to SPIX (n, j) adjust their luminance or transmittance in emitting light in accordance with output signals supplied to the corresponding data signal lines SL1 to SLn, thereby determining brightness thereof.

Here, the scanning signal line driving circuit 4 selects the scanning signal lines GL1 to GLm sequentially. Thus, it is possible to set the sub-pixels SPIX (1, l) to SPIX (n, m) constituting all the pixels of the pixel array 2 to have brightness (grayscale) indicated by the respective video data, thereby updating an image displayed in the pixel array 2.

Note that, the video data D may be a grayscale level itself or may be a parameter for computing a grayscale level as long as it is possible to specify a grayscale level of the sub-pixel SPIX. However, as an example, the following description will explain the case where the video data D is the grayscale level itself of the sub-pixel SPIX.

Further, in the image display device 1, a video signal DAT supplied from a video signal source VS to the modulated-drive processing section 21 may be transferred as a frame unit (entire image unit), or it may be so arranged that: one frame thereof is divided into a plurality of fields, and the video signal DAT is transferred field by field. However, as an example, the following description will explain the case where the video signal DAT is transferred field by field.

That is, in the present embodiment, the video signal DAT supplied from the video signal source VS to the modulated-drive processing section 21 is transferred in such a manner that: one frame is divided into a plurality of fields (for example, two fields), and the video signal DAT is transferred field by field.

In more detail, in transferring the video signal DAT to the modulated-drive processing section 21 of the image display device 1 via a video signal line VL, the video signal source VS transfers all the video data for a certain field. It then transfers video data for the next field, thereby transferring the video data for the respective fields by time division.

Further, the field is constituted of a plurality of horizontal lines. In the video signal line VL, for example, all the video data for a certain horizontal line is transferred at a certain field. Then, video data for the next horizontal line is transferred, thereby transferring the video data for each horizontal line by time division.

Note that, in the present embodiment, one frame is constituted of two fields. In each even-numbered field, video data of even-numbered horizontal lines out of the horizontal lines constituting one frame is transferred. Further, in each odd-numbered field, video data of odd-numbered horizontal lines is transferred. Moreover, the video signal source VS drives the video signal line VL by time division also in transferring video data of one horizontal line, so that the respective video data is sequentially transferred in a predetermined order.

Meanwhile, in the modulated-drive processing section 21, a receiving circuit (not shown) samples the video data transferred through the video signal line VL, and obtains video data D (i, j, k) supplied to the respective sub-pixels SPIX (i, j). Note that, in case where the video data D (i, j, k) supplied to the respective sub-pixels SPIX (i, j) through the video signal line VL is transferred, the receiving circuit performs the sampling at a predetermined timing, thereby obtaining the video data D (i, j, k) itself.

Meanwhile, in case where the video data supplied to the respective pixels is transferred through the video signal line VL, the receiving circuit performs the sampling at a predetermined timing, thereby obtaining the video data for the respective pixels. Then, the receiving circuit decomposes colors indicated by the video data into color components of the respective sub-pixels of the pixel, thereby obtaining the video data D (i, j, k) supplied to the respective sub-pixels SPIX (i, j).

In the image display device 1 according to the present embodiment, a single pixel is constituted of three sub-pixels SPIX respectively corresponding to R, G, and B. Also the modulated-drive processing section 21 shown in FIG. 2 includes not only a circuit for R, that is, a circuit for processing the video data D supplied to the sub-pixel SPIX corresponding to R, but also circuits for G and B. However, the respective circuits are arranged in the same manner except for the inputted video data D (i, j, k), so that the following description will explain merely the circuit for R with reference to FIG. 1.

That is, the modulated-drive processing section 21 according to the present embodiment includes, as circuits for R: a frame memory 31 which stores the video data supplied to the sub-pixel SPIX for R so that the video data of one frame is stored until the next frame; a memory control circuit 32 which writes the video data of a current frame FR(k) on the frame memory 31, and reads out the video data D0 (i, j, k) of a previous frame FR (k−1) from the frame memory 31, so as to output the video data D0 (i, j, k) as previous frame video signal DAT0; a modulation processing section (first correction means) 33 which corrects the video data of the current frame FR (k) so that grayscale transition from the current frame to the previous frame is emphasized, and outputs thus corrected video data D2 (i, j, k) as a corrected video signal DAT2.

Note that, in the present embodiment, for the convenience in description, the video data outputted from the frame memory 31 is described as follows: the video data of the previous frame FR (k−1) is referred to as D0 (i, j, k), and the video data of a further previous frame FR (k−2) (this video data will be described later) is referred to as D00 (i, j, k−2). Further, based on both the video data D00 (i, j, k−2) and D0 (i, j, k−1), video data generated by a previous frame grayscale correction circuit 37 described later is referred to as D0*a* (i, j, k−1). Note that, in the present embodiment, each of the sub-pixels SPIX (1, j), (4, j) . . . displays R, so that the video data D (1, j, k), D (4, j, k) . . . are inputted to an input terminal T1.

Further, the modulated-drive processing section 21 according to the present embodiment includes a BDE (Bit-Depth Extension) circuit and the BDE circuit has: a noise adding circuit 34 which adds a noise generated by a noise generating circuit (a non-limiting example of support for noise generating means) 35 to the video data D (i, j, k) inputted to the input terminal T1, and outputs the resultant data; and a truncation circuit 36 which truncates less significant bits of the video data outputted by the noise adding circuit 34 so as to reduce a bit width of the video data. The video data D1 (i, j, k) outputted by the truncation circuit 36 is inputted to the modulation processing section 33 and the memory control circuit 32 as the video data of the current frame FR (k). Note that, the noise generating circuit 35 and the truncation circuit 36 correspond to a non-limiting example of support for noise adding means.

The noise generating circuit 35 outputs such a random noise that a pseudo outline does not occur in an image displayed in the pixel array 2, and an average value of thus outputted noise is 0. Further, when a maximum value of the noise data is too large, there is a possibility that a noise pattern may be recognized by a user of the image display device 1, so that the maximum value of the noise is so set that the noise pattern is not recognized.

In the present embodiment, the video data D (i, j, k), supplied to each of the sub-pixels SPIX (i, j), which is inputted to the input terminal T1 is represented by 8 bits, and an amount of the noise data is set to be within ±5 bits. Further, the truncation circuit 36 truncates less significant 2 bits from 8-bit video data outputted by the noise generating circuit 35, and outputs the data as 6-bit video data D1 (i, j, k). Accordingly, the frame memory 31's storage area for storing the respective video data D1 (i, j, k) of the current frame FR (k) is reduced so that each video data D1 (i, j, k) corresponds to 6 bits.

Thus, it is possible to reduce the number of bits of the video data processed by circuits positioned after the truncation circuit 36, without bringing about a noise pattern and a pseudo outline in an image displayed in the pixel array 2. This is further done while preventing the image from apparently differing from an image based on the video data D which has not been subjected to the truncation.

Here, the added noise is recognized by the user of the image display device 1 in terms of (i) how largely an observed grayscale is different from a grayscale of peripheral pixels (regulation) and (ii) how largely the luminance of the observed grayscale is different from target luminance (error). Generally, it is known that: in a field of visualization based on 100 ppi like the image display device 1, an allowable limit of the error is approximately 5% with respect to white luminance, and an allowable limit of the regulation is approximately 5% with respect to a displayed grayscale. Here, FIG. 4 shows how the transmittance of the pixel increases with respect to the peripheral luminance (transmittance before increasing the grayscale) in terms of percent when the grayscale displayed in the pixel is increased by x grayscale.

Further, FIG. 5 shows how the transmittance of the pixel increases with respect to an original transmittance (transmittance before increasing the grayscale) in terms of percent when the grayscale displayed in the pixel is increased by x grayscale. This shows such result that: in case of a noise of 8 to 12 grayscales, almost all the grayscales do not exceed the allowable limit, so that it is possible to prevent the user from recognizing apparent deterioration of the display quality. Note that, each of the foregoing figures shows a value in case where a video signal of $\gamma=2.2$ as a general video signal DAT.

Thus, in case where it is assumed that the user views an image at such a distance that a single pixel cannot be recognized, in 2 to 3 pixels (6 to 9 sub-pixels), the regulation and the error are set not to exceed 5%. Here, when the noise data is indicated by substantially normal distribution, the grayscale is as follows: 8 to 12 [grayscales]$\times 6^{(1/2)}$ to $9^{(1/2)}$ =20 to 36 [grayscales]. Thus, even when fixed noises are added in a time-series manner so as to have a bit width such as approximately 5 bits, that is, the bit width less than that of the video data D by 3 bits, there is no possibility that the noise pattern is recognized by the user of the image display device.

Note that, even when the pixel size is larger, it is general that a distance at which an image is viewed by the user does not accordingly increase. Thus, as the pixel size becomes larger, the allowable level of the noise data becomes smaller. Therefore, in a value range of 1 to 32 grayscales (within 5 bits), a value range preferably used in many image display devices 1 as a maximum value of an absolute value of the noise data is 12 to 20 grayscales, and it is more preferable to set the value range to 15 grayscales (4 bits).

As the noise generating circuit 35, it is possible to use various kinds of computing circuits such as a computing circuit including a linear feedback shift register (M series and Gold series), but the noise generating circuit 35 according to the present embodiment includes: a memory 51 for storing noise data of predetermined blocks such as 16×16 or 32×32; an address counter 52 for sequentially reading out the noise data from the memory 51; and a control circuit 53 for generating a reset signal for resetting the address counter 52.

The control circuit 53 resets the address counter 52 so that the noise data having the same value are added to the video data D (i, j, *) supplied to the same sub-pixel SPIX (i, j) throughout all the frames. For example, in the present embodiment, the control circuit 53 resets the address counter 52 in synchronism with at least one of a horizontal synchronization signal and a vertical synchronization signal that are transferred, in combination with the video data, from the video signal source VS shown in FIG. 2. As a result, the noise adding circuit 34 can add the noise data having the same value to the video data D (i, j, *) supplied to the same sub-pixel SPIX (i, j) throughout all the frames.

Thus, in case where the image display device 1 displays a still image in the pixel array 2, the corrected video data D2 (i, j, *) supplied to the sub-pixels SPIX (i, j) does not vary. As such, it is possible to display a stable still image free from flicker and noise that are caused by the variation of the corrected video data D2 (i, j, *). Here, * indicates an arbitrary value.

Note that, random noise data is stored in the memory 51. Thus, in each frame, the random noise data is added to the video data supplied to the sub-pixel SPIX positioned in the same block. As a result, a pseudo outline does not occur in an image displayed in the pixel array 2.

Further, in the present embodiment, the frame memory 31 stores the video data of the previous frame until the next frame, and the control circuit 32 reads out the video data D00 (i,j,k−2) of the further previous frame FR (k−2), and outputs the data as the further previous video signal DAT00.

Further, the modulated-drive processing section 21 according to the present embodiment includes a previous frame grayscale correction circuit (second correction means) 37. As to each sub pixel SPIX (i, j), the previous frame grayscale correction circuit 37 predicts a grayscale reached in the transition from the video data D00 (i, j, k−2) to the video data D0 (i, j, k−1), and corrects the video data D0 (i, j, k−1) of the previous frame FR (k−1) into the predicted value D0*a* (i, j, k−1) so as to output the predicted value D0*a* (i, j, k−1). The modulated-drive processing section 33 corrects the video data D1 (i, j, k) of the current frame FR (k), in accordance with the corrected previous frame video signal DAT0*a* and the current frame video signal DAT, so as to emphasize the sub-pixel SPIX (i, j)'s grayscale transition from the previous frame to the current frame.

According to the foregoing arrangement, the modulation processing section 33 corrects the video data D1 (i, j, k) of the current frame FR (k) so as to emphasize the grayscale transition from the previous frame FR (k−1) to the current frame FR (k). As such, it is possible to improve a response speed of the sub-pixel SPIX. As a result, even in case of using a sub-pixel SPIX whose response speed is originally low, it is possible to display an image at a sufficiently high response speed.

Further, at a previous stage of the frame memory 31, the BDE circuit including the noise adding circuit 34 and the truncation circuit 36 is provided. As such, it is possible to reduce an amount of the video data D (i, j, k) stored in the frame memory 31 without apparently deteriorating the display quality of an image displayed in the pixel array 2.

In the present embodiment, although a bit width of the video data D (i, j, k) inputted to the input terminal T1 is 8 bits, the bit width of the video data D1 (i, j, k) stored in the frame memory 31 is reduced to 6 bits. Thus, it is possible to reduce the memory capacity required in the frame memory 31.

Further, in circuits positioned after the truncation circuit 36, that is, in the memory control circuit 32, the previous frame grayscale correction circuit 37, the modulation processing section 33, the control circuit 12 shown in FIG. 2, and the data signal line driving circuit 3, the bit width of the video data is reduced from 8 bits to 6 bits. As such, it is possible to reduce (i) the number of connection wirings and (ii) an area occupied by the connection wirings by ¾. As a result, it is possible to reduce a computing amount of these circuits.

Note that, it is necessary to transfer the video data at comparatively high speed. Thus, in order to transfer the video data by using a circuit whose response speed is comparatively low, it is necessary to provide a plurality of circuits in parallel and to operate the circuits alternately. As a result, when the number of bits of the video data increases, an area occupied by the circuits increases. However, according to the foregoing arrangement, the bit width is reduced by ¾, so that it is possible to prevent the area occupied by the circuits from increasing even when the circuits operating in parallel to each other are provided.

Further, according to the foregoing arrangement, the BDE circuit including the noise adding circuit 34 and the truncation circuit 36 is provided at the previous stage of the frame memory 31 and the modulation processing section 33. Thus, unlike the case where the BDE circuit is provided at the following stage of the modulation processing section 33, the foregoing arrangement does not bring about the following disadvantage: after the modulation processing section 33 emphasizes the grayscale transition as much as possible while suppressing the occurrence of the excessive brightness, the BDE circuit adds the noise, so that the excessive brightness is recognized by the user. As a result, according to the foregoing arrangement, although the addition of noise and emphasis of the grayscale transition are performed together, it is possible to prevent the occurrence of the excessive brightness.

Incidentally, when the response speed of the sub-pixel SPIX (i, j) is extremely low, this raises the following problem. Although the grayscale transition from the further previous frame to the previous frame is emphasized in the previous frame FR (k−1), the sub-pixel SPIX (i, j) sometimes fails to reach a grayscale indicated by the video data D1 (i, j, k−1) of the previous frame FR (k−1). In this case, when the grayscale transition is emphasized in the current frame FR (k) on the assumption that the grayscale transition from the further previous frame to the previous frame has been sufficiently performed, there is a possibility that the grayscale transition may be so inappropriately emphasized that the excessive or poor brightness may occur.

Figure 6:
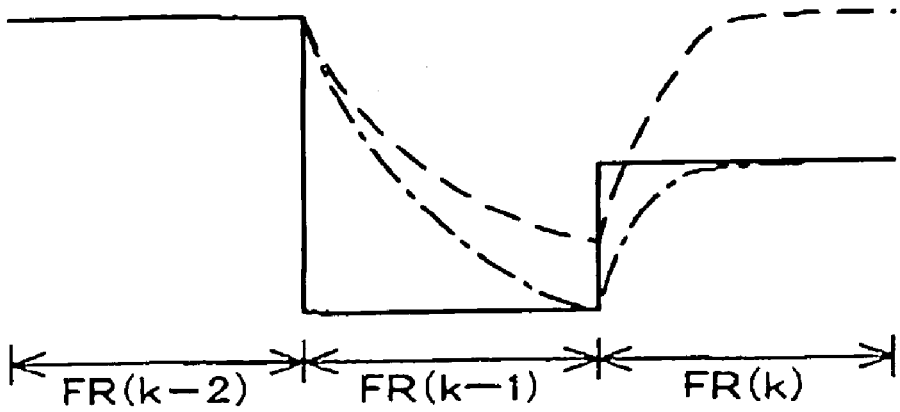
FIG. 6 shows how the modulated-drive processing section operates, and is a timing chart showing an actual luminance level in case where grayscale transition from a grayscale indicated by further previous grayscale data to a grayscale indicated by current grayscale data is decay→rise.

For example, as shown by a continuous line of FIG. 6, when the grayscale transition from the further previous frame to the current frame is decay→rise, this raises the following disadvantage. As shown by a broken like of FIG. 6, the grayscale transition from the further previous frame to the current frame does not sufficiently perform. Further, the luminance level at the start of the frame FR (k) does not sufficiently drop. When the pixel is driven in the current frame FR (k) in the same manner as in the case where the grayscale transition is sufficiently performed (shown by a chain line of FIG. 6) regardless of the foregoing condition, the grayscale transition is excessively emphasized, so that the excessive brightness occurs.

Figure 7:
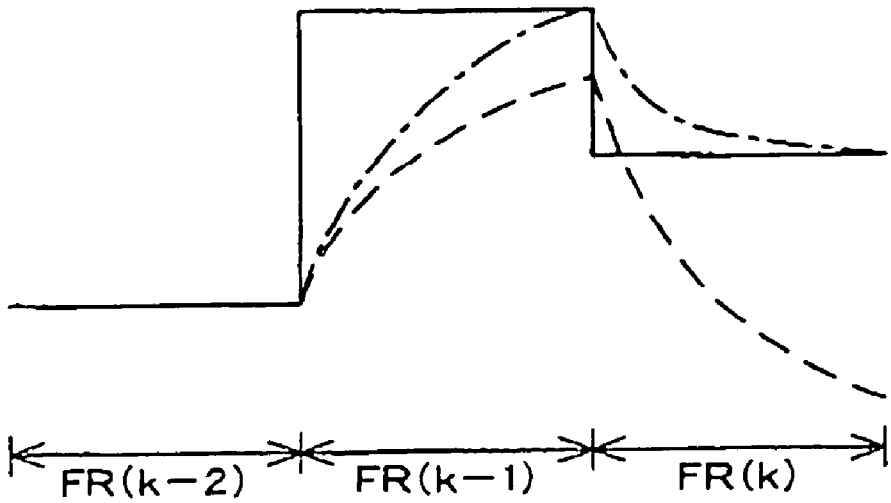
FIG. 7 shows how the modulated-drive processing section operates, and is a timing chart showing an actual luminance level in case where the grayscale transition from the grayscale indicated by the further previous grayscale data to the grayscale indicated by the current grayscale data is rise→decay.

Further, as shown by a continuous line of FIG. 7, in case where the grayscale transition from the further previous frame to the current frame is rise→decay, this brings about the following problem. As shown by a broken line of FIG. 7, the grayscale transition from the further previous frame to the previous frame is not sufficiently performed, and the luminance level at the start of the frame FR (k) does not sufficiently drop. When the pixel is driven in the current frame FR (k−1) in the same manner as in the case where the grayscale transition is sufficiently performed (shown by a chain line of FIG. 7) regardless of the foregoing condition, the grayscale transition is excessively emphasized, so that the poor brightness occurs.

When the excessive or poor brightness occurs, a grayscale thereof deviates from a range between a grayscale of the previous frame and a grayscale of the current frame, so that the excessive or poor brightness is conspicuous for the user. As a result, such condition significantly deteriorates the display quality of the image display device. Particularly, in the case where the excessive brightness occurs, even though a period in which the excessive brightness occurs is extremely short, the excessive brightness is conspicuous for the user, so that the display quality is particularly deteriorated.

On the other hand, as to each sub-pixel SPIX (i, j), the previous frame grayscale correction circuit 37 according to the present embodiment predicts a grayscale reached in the grayscale transition from the further previous frame to the previous frame in accordance with the uncorrected video data D00 (i, j, k−2) and the uncorrected video data D00 (i, j, k−1), and changes the video data D1 (i, j, k−1) of the previous frame FR (k−1) to a predicted value D0*a* (i, j, k−1). As a result, it is possible to prevent the occurrence of the excessive or poor brightness, thereby improving the display quality of the image display device 1.

Figure 27:
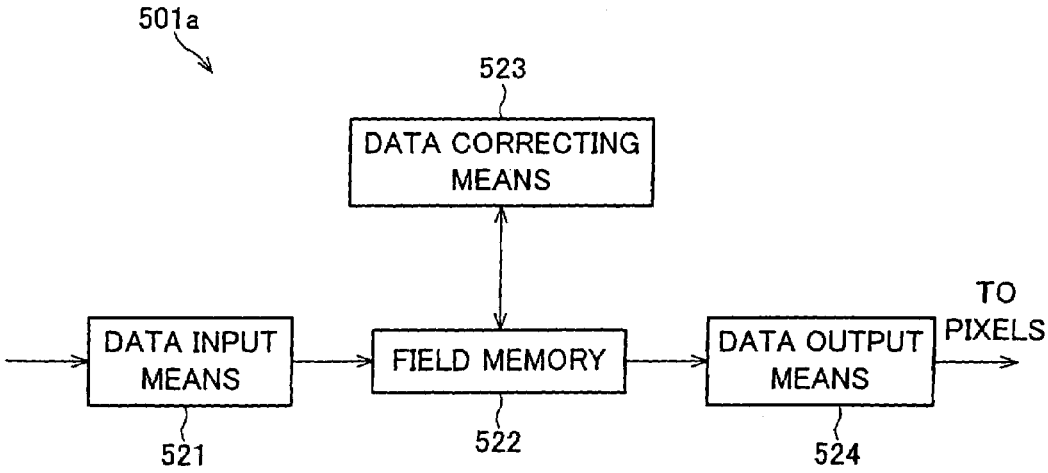
FIG. 27 shows another background art, and is a block diagram showing an important portion of an image display device.

Further, the frame memory 31 stores the uncorrected video data D1 (i, j, k). Thus, unlike a display device 501*a* shown in FIG. 27, even when an error occurs in correction, the error is not stored with passage of time. Therefore, even when predictive computing accuracy is reduced while preventing the occurrence of the excessive or poor brightness, the reduction in the predictive computing accuracy does not cause divergent or oscillating pixel grayscale level control unlike the image display device 501*a*. As a result, it is possible to realize the image display device 1, having a circuit size smaller than the image display device 501*a*, which can prevent the occurrence of the excessive or poor brightness.

Figure 1:
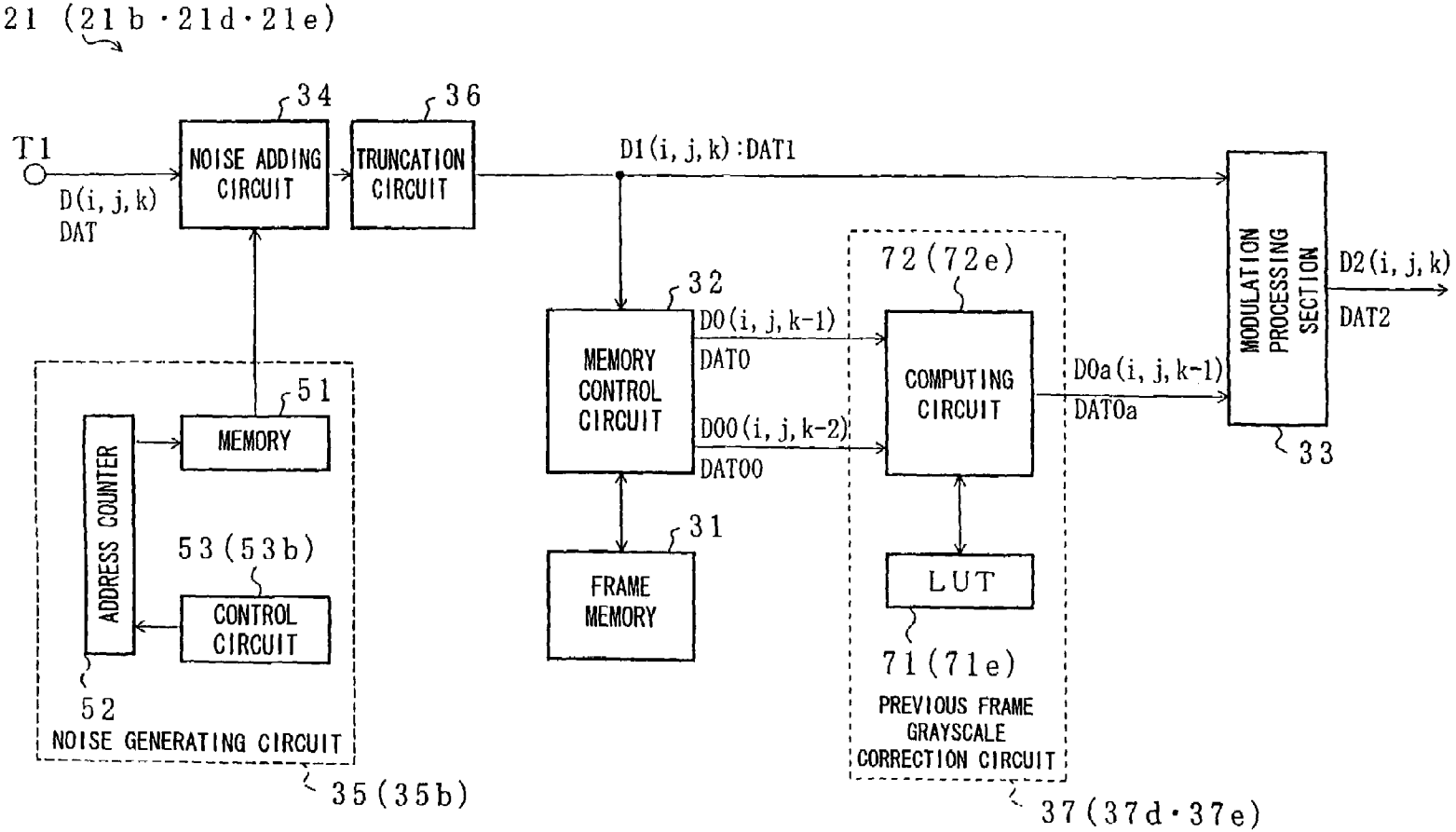
FIG. 1 shows one embodiment of the present invention, and is a block diagram showing an important portion of a modulated-drive processing section of an image display device.

In more detail, as shown in FIG. 1, the previous frame grayscale correction circuit 37 according to the present embodiment includes an LUT (Look Up Table) 71. The LUT 71 stores reached grayscales respectively corresponding to combinations of the previous grayscale and the current grayscale. The foregoing "reached grayscales respectively corresponding to combinations of the previous grayscale and the current grayscale" means "grayscales each of which is reached at a time when the sub-pixel SPIX (i, j) is driven in accordance with the next video data in case where the video data of the combination is inputted to the modulation processing section 33". Further, in the present embodiment, in order to reduce a storage capacity required in the LUT 71, the reached grayscales stored in the LUT 71 does not correspond to a reached grayscale of all the combinations of the grayscales but is limited to predetermined combinations, and the previous frame grayscale correction circuit 37 includes a computing circuit 72. The computing circuit 72 interpolates a reached grayscale corresponding to each combination stored in the LUT 71, and computes a reached grayscale corresponding to a combination of both the video data D00 (i, j, k−2) and the video data D0 (i, j, k−1), and outputs a predicted value D0*a* (i, j, k−1) as the computed result.

Further, in the present embodiment, in order to reduce the storage capacity required in the frame memory 31, the control circuit 32 reduces a data depth of the video data D1 (i, j, k) of the current frame FR (k). Thereafter, the control circuit 32 stores the data in the frame memory 31, and outputs thus stored data as the video data D0 (i, j, k) of the previous frame FR (k) in the next frame FR (k+1). Further, the control circuit 32 further reduces the data depth of the video data D0 (i, j, k−1) of the previous frame FR (k−1), and then stores the data in the frame memory 31, and outputs thus stored data as the video data D00 (i, j, k−1) of the further previous FR (k−1) in the next frame FR (k+1).

For example, in the present embodiment, the data depth of the video data D00 (i, j, k−2) of the further previous frame FR (k−2) and the data depth of the video data D0 (i, j, k−1) of the previous frame FR (k−1) are set to be 4 bits and 6 bits. In this case, even when R, G, and B are respectively stored, merely 30 bits are required. Thus, in case of using a general memory (a memory in which a width of a data bit is set to be $2^n$), although not only the video data D0 (i, j, k) but also the video data D00 (i, j, k−2) of the further previous frame FR (k−2) is stored, it is possible to use a memory having the same storage capacity as in the case where the video data D0 (i, j, k−1) of the previous frame FR (k−1) is stored.

Figure 8:
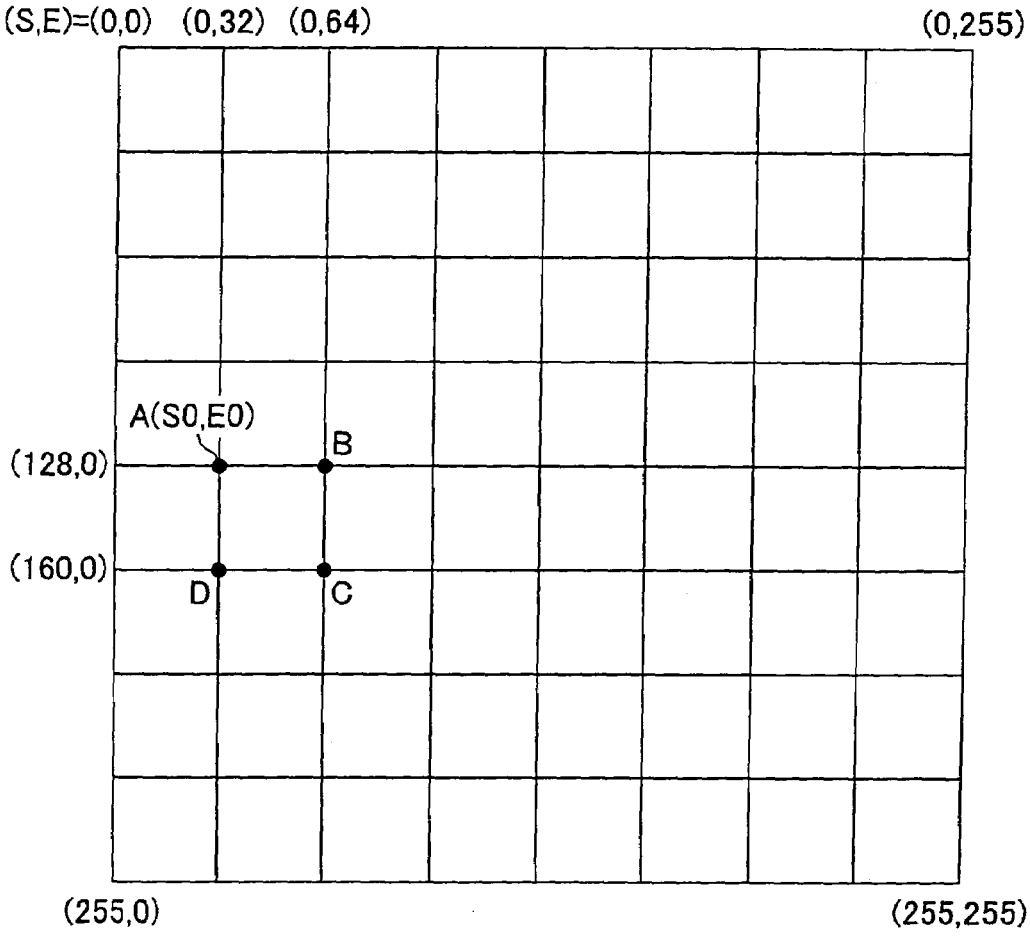
FIG. 8 shows a relationship between (i) an area represented by a combination of video data of a further previous frame and video data of a previous frame and (ii) a computing area.

Further, in the present embodiment, as shown in FIG. 8, an area represented by the combination of the grayscales is divided into computing areas of 8×8, and the LUT 71 stores reached grayscales as to four corners (points of 9×9) of each computing area. Note that, in FIG. 8 and FIG. 9, a vertical axis indicates a start grayscale (grayscale of the further previous frame), and a horizontal axis indicates an end grayscale (grayscale of the previous frame). As moving rightward and downward, the grayscale becomes larger. Further, for the convenience in description, each of FIG. 8, FIG. 9, and FIG. 12 described later shows a grayscale which has not been subjected to truncation, that is, a value (quadrupled value) obtained by extending the video data D1 (i, j, k) of 6 bits to 8 bits.

Here, FIG. 9 shows an example of a value in case of adopting a liquid crystal element which is in a vertical-alignment mode and a normally black mode. In the liquid crystal element, a response speed of the grayscale transition in "decay" is lower than that of the grayscale transition in "rise". Thus, even when the liquid crystal element is driven after performing modulation so that the grayscale transition is emphasized, a difference tends to occur between an actual grayscale transition and a desired grayscale transition in the grayscale transition from the further previous frame to the previous frame.

Thus, an area $\alpha$1 in which an actually reached grayscale is much larger than a grayscale (E) that should be reached is wider than an area $\alpha$2 in which the reached grayscale is much smaller than the grayscale that should be reached. Note that, the areas $\alpha$1 and $\alpha$2 are different from each other in terms of the video data D1 (i, j, k) and the actual grayscale so that the difference is recognized by the user when the previous frame grayscale correction circuit 37 does not perform correction and the modulation processing section 33 corrects the video data D1 (i, j, k) of the current frame FR (k) in accordance with the video data D1 (i, j, k−1) of the previous frame FR (k−1).

Further, when a combination (S, E) of both the video data D00 (i, j, k−2) and D0 (i, j, k−1) is inputted, the computing circuit 72 specifies which computing area the combination belongs to.

Further, when an upper left corner, an upper right corner, a lower right corner, and a lower left corner are respectively regarded as A, B, C, and D, and a width of the computing area is regarded as Y×X, and a value obtained by normalizing a difference (1, 1) between a combination (S0, E0) positioned at the upper left corner and the aforementioned combination (S, E) is (Δy, Δx)=((S−S0)/Y, (E−E0)/X), the computing circuit 72 reads out the respective reached grayscales A, B, and C from the LUT 71 in case where Δx>=Δy, and computes D0*a* (i, j, k−1) in accordance with the following equation (1).

$$D0a(i,j,k-1)=A+\Delta x\cdot(B-A)+\Delta y\cdot(C-B) \quad (1)$$

Further, in case where Δx<Δy, the computing circuit 72 reads out the respective reached grayscales A, C, and D from the LUT 71, and computes D0*a* (i, j, k−1) in accordance with the following equation (2).

$$D0a(i,j,k-1)=C+\Delta x\cdot(C-D)+(1-\Delta y)\cdot(D-A) \quad (2)$$

For example, in FIG. 8 and FIG. 9, when (S, E) is (144, 48), a computing area surrounded by (128, 32), (128, 64), (160, 32) is specified, and the video data D0*a* (i, j, k−1) of the previous frame FR (k−1) after correction is 60. Thus, unlike the case where the modulation processing section 33 corrects the video data D1 (i, j, k) of the current frame FR (k) in accordance with the video data D1 (i, j, k−1) of the previous frame FR (k−1)=48, the video data D1 (i, j, k) is corrected in accordance with the corrected video data D0*a* (i, j, k−1)=60, so that it is possible to prevent the occurrence of the excessive brightness.

Note that, the foregoing description explains the example where the data depth (bit width) of the reached grayscale stored in the LUT 71 is the same as a value (6 bits) of the video data D1 (i, j, k). However, in case where it is required to reduce the storage capacity of the LUT 71, it is desired to set the data depth (bit width) of each reached grayscale stored in the LUT 71 so as to correspond to the data depth, not being large, which is selected from (i) the data depth of the video data D00 (i, j, k−2) of the further previous frame FR (k−2) and (ii) the data depth of the video data D0 (i, j, k−1) of the previous frame FR (k−1).

Also in the arrangement, the data depth of the reached grayscale is set to have the same bit width of effective digits of computation using the further previous and previous video data, that is, so as to correspond to a smaller bit width. Thus, it is possible to reduce the storage capacity required in the LUT 71 while preventing deterioration of the computing accuracy.

Embodiment 2

Figure 10:
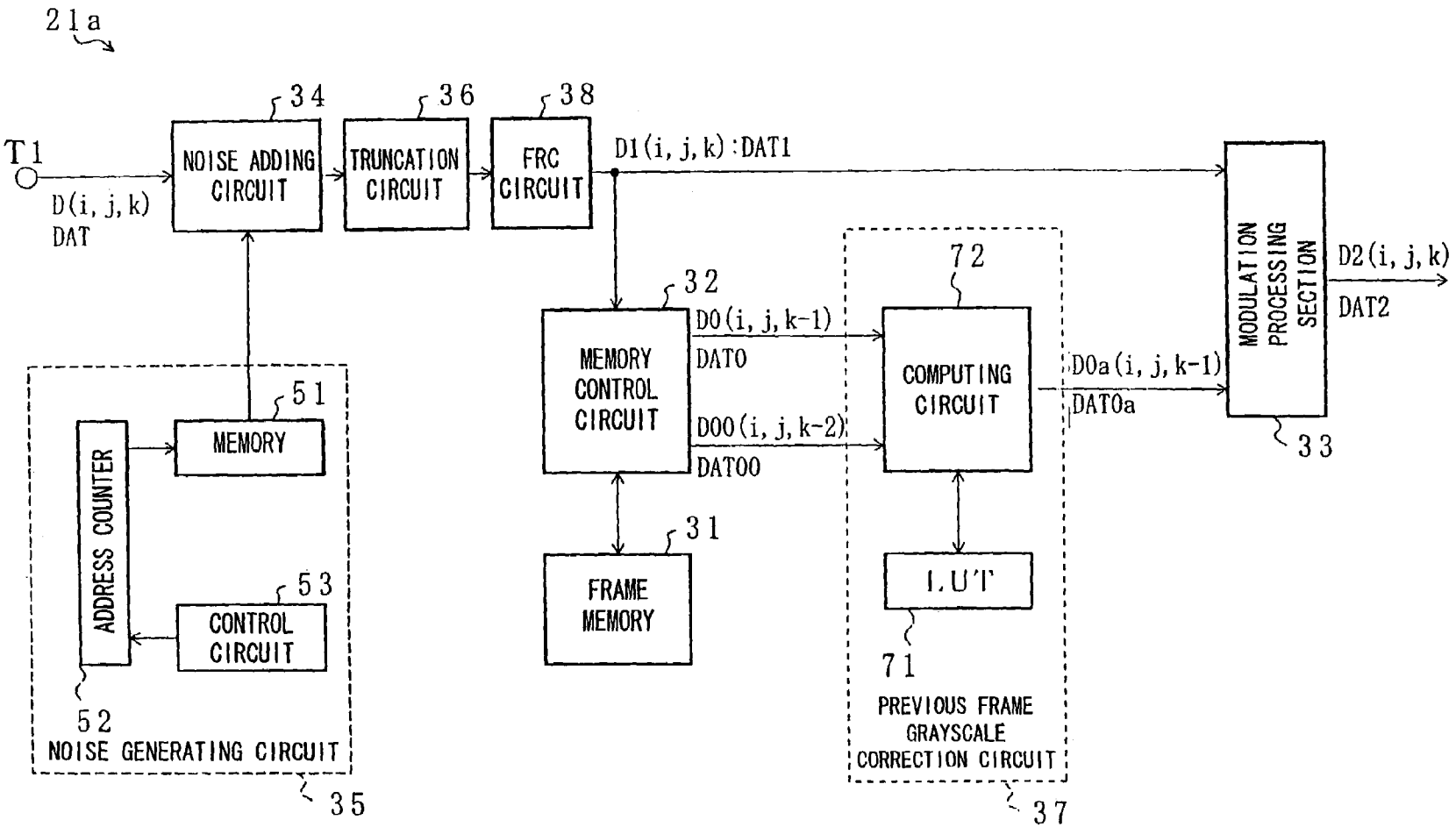
FIG. 10 shows another embodiment of the present invention, and is a block diagram showing an important portion of a modulated-drive processing section.

As shown in FIG. 10, a modulated-drive processing section 21*a* according to the present embodiment includes an FRC (Frame Rate Control) circuit (least significant bit control means) 38 provided between (i) the truncation circuit 36 and (ii) the frame memory 31 and the modulation processing section 33.

According to the video data D (i, j, k), the FRC circuit 38 varies a least significant bit of the video data, outputted by the truncation circuit 36, on the basis of a predetermined pattern, and then outputs thus varied least significant bit as the video data D1 (i, j, k). The pattern is set so that a value of a bit truncated by the truncation circuit 36 corresponds to an average value of values constituting the pattern. For example, when the truncated value (2 bits) is "01", the value is ¼ with respect to the least significant bit of the video data outputted by the truncation circuit 36, so that (0, 0, 0, 1) is for example set as a pattern corresponding to the foregoing pattern. Likewise, patterns of (0, 0, 0, 0), (1, 0, 1, 0), and (1, 1, 1, 0) are set so as to respectively correspond to "00", "10", and "11".

In the foregoing arrangement, due to the FRC circuit 38, the least significant bit of the video data D1 (i, j, k) varies on the basis of such a pattern that a value of a bit truncated by the truncation circuit 36 corresponds to an average value of values constituting the pattern. Thus, it is possible to make an average value of the luminance of the sub-pixel SPIX (i, j) correspond to the luminance indicated by video data before being truncated by the truncation circuit 36.

Note that, in case where the response speed of the sub-pixel SPIX (i, j) is so low that the sub-pixel SPIX (i, j) cannot vary the luminance in accordance with variation of the corrected video data D2 (i, j, k), an average value of the luminance of the sub-pixel SPIX (i, j) does not correspond to the foregoing desired value. However, in the modulated-drive processing section 21*a* according to the present embodiment, a bit varied by the FRC circuit 38 is a least significant bit of the video data D1 (i, j, k), and the modulation processing section 33 emphasizes the grayscale transition from the previous frame FR (k−1) to the current frame FR (k). Thus, the modulated-drive processing section 21*a* can set the average value of the luminance of the sub-pixel SPIX (i, j) to be the foregoing desired value without any trouble.

Here, in case of the pixel array 2 in which an area occupied by each sub-pixel SPIX (i, j) is extremely small and spatial resolution and luminance resolution are set to be close to or over a limit of human visual sense, that is, in case of the pixel array 2 on the assumption that it is viewed at such distance that it is impossible to recognize each pixel, even when the noise adding circuit 34 adds a fixed noise of approximately 5 bits in a time-series manner, there is not possibility that the noise pattern is recognized by the user of the image display device. Examples of such image display device include an XGA (extended Graphic Array) display of 15 inches and the like. In this case, a gap (fineness) between the sub-pixels SPIX (i, j) is set to be approximately 300 μm.

However, in such arrangement that the fixed noise is added in a time-series manner when the spatial resolution and the luminance resolution of the pixel array 2 do not exceed the aforementioned limit, there is a possibility that the noise pattern may be recognized by the user of the image display device 1 when an image displayed in the pixel array 2 is under a specific condition (for example, specific brightness or specific movement). Examples of such image display device include the VGA display of 15 inches and the like.

On the other hand, in the modulated-drive processing section 21*a* according to the present embodiment, the FRC circuit 38 changes the least significant bit of the video data D1 (i, j, k). Thus, even in case of applying the modulated-drive processing section 21*a* to such image display device, it is possible to prevent the noise pattern from being recognized by the user, so that it is possible to improve the apparent display quality of the image display device 1*a* compared with the case where the fixed noise is added in a time-series manner.

Embodiment 3

Incidentally, Embodiments 1 and 2 explain the case where: the noise added to the video data D (i, j, *) by the noise adding circuit 34 is fixed in a time-series manner, and the noise of the same value is always added to the video data D (i, j, *) to the sub-pixel SPIX (i, j). On the other hand, the present embodiment will explain a case where the noise added to the video data D (i, j, *) by the noise adding circuit 34 is varied in a time-series manner. Note that, this arrangement can be applied to both the Embodiments 1 and 2. Hereinafter, the case where the arrangement is applied to Embodiment 1 is described with reference to FIG. 1.

That is, in a modulated-drive processing section 21*b* according to the present embodiment, instead of the noise generating circuit 35, there is provided a noise generating circuit 35*b* for generating a noise which varies in a time-series manner. In the noise adding circuit 35*b* according to the present embodiment, a control circuit 53*b* provided instead of the control circuit 53 changes a phase difference between a reset timing of the address counter 52 and first video data D (1, 1, k) of the frame FR (k) for each frame.

For example, in the first frame FR (k), the control circuit 53*b* resets the address counter 52 at a time when the first video data D (1, 1, k) is applied, and noise data stored in a first address of the memory 51 is added to the first video data D (1, 1, k). While, in the next frame FR (k+1), the control circuit 53*b* sets the reset timing of the address counter 52 to be earlier by single video data, so that noise data stored in a second address of the memory 51 is added to the first video data D (1, 1, k+1).

In this manner, in the present embodiment, the noise adding circuit 34 varies the noise, added to the video data D (i, j, *), in a time-series manner. Here, as described above, in the case where the spatial resolution and the luminance resolution of the pixel array 2 are set to be close to or over a limit of human visual sense, even when the fixed noise is added in a time-series manner, there is no possibility that the noise pattern is recognized by the user of the image display device 1.

However, in the case where the spatial resolution and the luminance resolution of the pixel array 2 are far below the limit of human visual sense, and each sub-pixel SPIX (i, j) is recognized by the user of the image display device, when the fixed noise is added in a time-series manner as described above, the noise pattern is recognized by the user of the image display device. Examples of such image display device include a VGA display of 20 inches, an XGA display of 40 inches, and the like.

On the other hand, in the modulated-drive processing section 21*b* according to the present embodiment, the noise added to the video data D (i, j, *) by the noise adding circuit 34 is varied in a time-series manner. Thus, even in the case where the modulated-drive processing section 21*b* is applied to such image display device, it is possible to prevent the noise pattern from being recognized by the user, so that it is possible to improve the apparent display quality of the image display device 1*b* compared with the case where the fixed noise is added in a time-series manner.

Incidentally, in order to display a stable still image free from any flicker and noise, the modulated-drive processing section 33 according to the respective embodiments does not emphasize the grayscale transition and outputs the video data D1 (i, j, k) of the current frame FR (k) without any modification when a difference between the video data D0*a* (i, j, k−1) of the previous frame FR (k−1) and the video data D1 (i, j, k) of the current frame FR (k) is smaller than a predetermined threshold value.

In this case, the threshold value is set so as to correspond to a variation width at which the noise varies in a time-series manner. In more detail, the threshold value is as large as or larger than the variation width at which the noise varies in a time-series manner, and is set to be such a small value that insufficient grayscale transition due to the insufficient response speed of the sub-pixel SPIX (i, j) is not recognized even when the grayscale transition is not emphasized. For example, in case of the foregoing values, that is, in case where the video data D (i, j, k) is 8 bits, and a volume of the noise is ±5 bits, and the truncation circuit 36 truncates 2 bits, the threshold value is set to be 8 grayscales ($=2^{(5-2)}$).

In this manner, the threshold value is set to be a value which is as large as or larger than the variation width at which the noise varies in a time-series manner. Thus, in the case where a still image is displayed, even when the noise causes the video data D1 (i, j, k) to so vary that the grayscale transition occurs, the modulation processing section 33 does not emphasize the grayscale transition and outputs the video data D1 (i, j, k) of the current frame FR (k) without any modification. In this manner, in the case of the grayscale transition which can be brought about merely by adding the noise data, the modulation processing section 33 according to Embodiment 3 does not emphasize the grayscale transition, and the modulation processing section 33 obtained by adding the FRC circuit 38 to the arrangement of Embodiment 3 does not emphasize the grayscale transition in case of the grayscale transition which can be brought about merely by adding the noise data and causing the FRC circuit 38 to change the least significant bit. Thus, the grayscale transition caused by the noise is not emphasized, so that it is possible to prevent such disadvantage that: due to the grayscale transition caused by the noise, the noise pattern is recognized by the user.

Further, in the case where the noise added to the video data D (i, j, *) by the noise adding circuit 34 is varied in a time-series manner like the present embodiment, that is, in the case where it is assumed that an image is viewed at a distance shorter than that of Embodiment 1 (at such a distance that each sub-pixel SPIX (i, j) is recognized by the user of the image display device), it is more desirable to set a maximum value of an absolute value of the noise data generated by the noise generating circuit 35 to be not more than 8 grayscales.

Embodiment 4

The foregoing description explains the example where the maximum value of the noise data generated by the noise generating circuit is constant. However, the present embodiment will explain an arrangement in which the maximum value of the noise data is varied in accordance with a grayscale indicated by the video data D (i, j, k) inputted to the input terminal T1. Note that, this arrangement can be applied to each of Embodiments 1 to 3. Hereinafter, a case where the foregoing arrangement is applied to Embodiment 1 will be described with reference to FIG. 11.

That is, in a modulated-drive processing section 21*c* according to the present embodiment, instead of the noise generating circuit 35 shown in FIG. 1, there is provided a noise generating circuit 35*c* which can change the volume of the outputted noise data. Further, there is provided a grayscale determination section (providing non-limiting exemplary support for the noise amount control means) 39 for detecting a display grayscale level of the video data D (i, j, k) and instructing the noise generating circuit 35*c* to output a noise whose volume corresponds to the detection result.

The grayscale determining section 39 averages the video data D supplied to the sub-pixel SPIX contained in a block, such as an MPEG (Moving Picture Expert Group) block, which has a predetermined size. In case where thus obtained average value is large, the grayscale determining section 39 gives instruction to output a noise whose maximum value is larger than that in the case where the average value is small. For example, the grayscale determining section 39 gives instruction to output a noise having larger value in proportion to the average value.

While, the noise generating circuit 35*c* includes a multiplication circuit 54 for multiplying a value, indicated by the grayscale determining section 39, by an output of the memory 51, so as to output thus multiplied value. The multiplication circuit 54 changes the maximum value of the noise data outputted by the noise generating circuit 35*c* so that the maximum value corresponds to the indicated value.

In the foregoing arrangement, the maximum value of the noise is set to be large in the case where the average value of the video data D in the block is large, that is, in the case where: the noise pattern is hardly recognized by the user even when the volume of the noise is made large, because a relative volume of the noise is smaller than when the average value is small. On the other hand, the maximum value of the noise is set to be small in the case where the average value of the video data D is high, that is, in the case where: the noise pattern may be recognized by the user unless the volume of the noise is made smaller, because the relative volume of the noise is larger than when the average value is large. As a result, no matter what the average value of the luminance of the block may be, it is possible to set the maximum value of the noise to be a value suitable for the average value, so that it is possible to realize the image display device whose display quality is higher than that in the case where the maximum value of the noise is fixed.

Note that, the foregoing description explains the example where a block for computing the average value corresponds to the MPEG block, but the arrangement is not limited to this. It may be so arranged that an average value of a block having an arbitrary size is set. However, in case of displaying an image which has been encoded for each block like an MPEG image, it is desirable to set the average value so that a block size for encoding is substantially the same as a block size for detecting the average value.

Note that, the foregoing description explains the example where the video data D of all the sub-pixels SPIX contained in the block are averaged, but the arrangement is not limited to this. As long as it is so arranged as to average the video data D supplied to a predetermined number of sub-pixels SPIX in the block, for example, the sub-pixels (i, j) corresponding to a certain scanning signal line GL in the block, it is possible to prevent the following disadvantage. That is, it is possible to prevent such a disadvantage that: when the sub-pixel SPIX (i, j) whose indicated grayscale is largely different from peripheral grayscales exists in the block, the maximum value of the noise is set to be an inappropriate value in accordance with the video data D (i, j, k) to the sub-pixel SPIX (i, j).

Embodiment 5

Incidentally, the foregoing description explains the example where the previous frame grayscale correction circuit 37 always corrects the previous frame video signal DAT0. On the other hand, in a modulated-drive processing section 21*d* according to the present embodiment, in case where a difference (absolute value) between a predicted value D0*a* (i, j, k−1) obtained by the previous frame grayscale correction circuit 37 and the video data D0 (i, j, k−1) of the previous frame FR (k−1) is not less than a predetermined threshold value, the previous frame grayscale correction circuit 37*d* outputs the predicted value D0*a* (i, j, k−1). Further, in the other case, the previous frame grayscale correction circuit 37*d* outputs the previous frame video signal DAT0 without any modification. Note that, also this arrangement can be applied to all the respective embodiments described above. Hereinafter, a case where the arrangement is applied to Embodiment 1 will be described with reference to FIG. 1.

That is, in the present embodiment, as an example where a grayscale of each video data D1 (i, j, k) is 6 bits, the foregoing threshold value is set to be approximately 2 grayscales. Note that, accuracy in prediction drops due to various factors such as a quantization noise. Thus, the foregoing threshold value may be set to be approximately 2 to 4 grayscales according to these factors.

Here, in case where a difference between the predicted value and a target value (D0 (i, j, k−1)) is small, a grayscale of the sub-pixel SPIX (i, j) approaches a grayscale indicated by the video data D0 (i, j, k−1) in the previous frame FR (k−1) compared with a case where the foregoing difference is large. Thus, even when the previous frame grayscale correction circuit 37*d* does not perform correction, and the modulation processing section 33 corrects the video data D1 (i, j, k) of the current frame FR in accordance with the video data D0 (i, j, k−1), there is little possibility that the excessive or poor brightness occurs. Even when the excessive or poor brightness occurs, the occurrence is slight.

Further, in the case where the difference between the predicted value and the target value is small, a relative error in the prediction is relatively larger than that in the case where the difference is large. Thus, when the grayscale transition is emphasized by the modulation processing section 33, variation of the grayscale that is caused by the error in the prediction tends to be recognized by the user.

On the other hand, in the case where the difference between the predicted value and the target value (D0 (i, j, k−1)) is large, the excessive or poor brightness tends to occur unless the previous frame video signal DAT0 is corrected. Further, the relative error in the prediction is small, so that the variation of the grayscale that is caused by the error in the prediction is hardly recognized by the user.

In the present embodiment, in case where the difference between the predicted value and the target value (D0 (i, j, k−1)) is smaller than the threshold value, that is, in case where the excessive or poor brightness hardly occur unless the previous frame video signal DAT0 is corrected and the error in the prediction tends to deteriorate the display quality when the previous frame video signal DAT0 is corrected, the previous frame grayscale correction circuit 37*d* does not correct the previous frame video signal DAT0. Merely in case where the excessive or poor brightness occurs unless the previous frame video signal DAT0 is corrected, the previous frame grayscale correction circuit 37*d* corrects the previous frame video signal DAT0. As a result, it is possible to prevent occurrence of the excessive or poor brightness while suppressing deterioration of the display quality that is caused by the error in the prediction.

Embodiment 6

Embodiment 5 describes such arrangement that whether the previous frame grayscale correction circuit 37*d* needs to perform the correction or not is determined in accordance with the difference between the predicted value and the target value. The present embodiment will describe such arrangement that: information indicative of whether or not it is necessary to perform the correction is written in the LUT in advance, and the previous frame grayscale correction circuit determines whether or not it is necessary to perform the correction with reference to the information. Note that, also this arrangement can be applied to the respective embodiments, but the following description will explain a case where the arrangement is applied to Embodiment 1.

That is, an LUT 71*e* according to the present embodiment is arranged as follows. As shown in FIG. 12, the same values as in FIG. 9 are stored in areas α1 and α2, that is, areas which are so different from each other in terms of the video data D1 (i, j, k) and the actual grayscale that the difference is recognized by the user when the previous frame grayscale correction circuit 37 does not perform correction and the modulation processing section 33 corrects the video data D1 (i, j, k) of the current frame FR (k) in accordance with the video data D1 (i, j, k−1) of the previous frame FR (k−1). However, other area α3 stores the target value (E) itself.

While, when a combination (S, E) of both the video data D00 (i, j, k−2) and D0 (i, j, k−1) is inputted, and which computing area the combination belongs to is specified, a computing circuit 72*e* according to the present embodiment reads out a predetermined reached grayscale out of the reached grayscales A to D positioned at four corners of the computing area. It further determines whether or not the foregoing reached grayscale corresponds to a grayscale of a boundary of the computing area. This is done to determine whether the target value is recorded or not as the reached grayscale, that is, whether the combination (S, E) belongs to the area α3 or not. Further, when it is determined that the combination (S, E) belongs to the area α3, the computing circuit 72*e* does not correct the previous frame video signal DAT0. The computing circuit 72*e* corrects the previous frame video signal DAT0 merely when it is determined that the combination (S, E) belongs to the areas α1 and α2.

Thus, as in Embodiment 5, in case where the excessive or poor brightness do not occur and deterioration of the display quality that is caused by the error in the prediction is anticipated, the previous frame video signal DAT0 is not corrected. Merely when the white the excessive or poor brightness occurs, it is possible to correct the previous frame video signal DAT0.

Embodiment 7

The present embodiment will describe an arrangement for changing a correction process, performed by the previous frame grayscale correction circuit, in accordance with temperature. Note that, this arrangement can be applied to each of Embodiments 1 to 6, but the following description will explain a case where the arrangement is applied to Embodiment 6.

Figure 13:
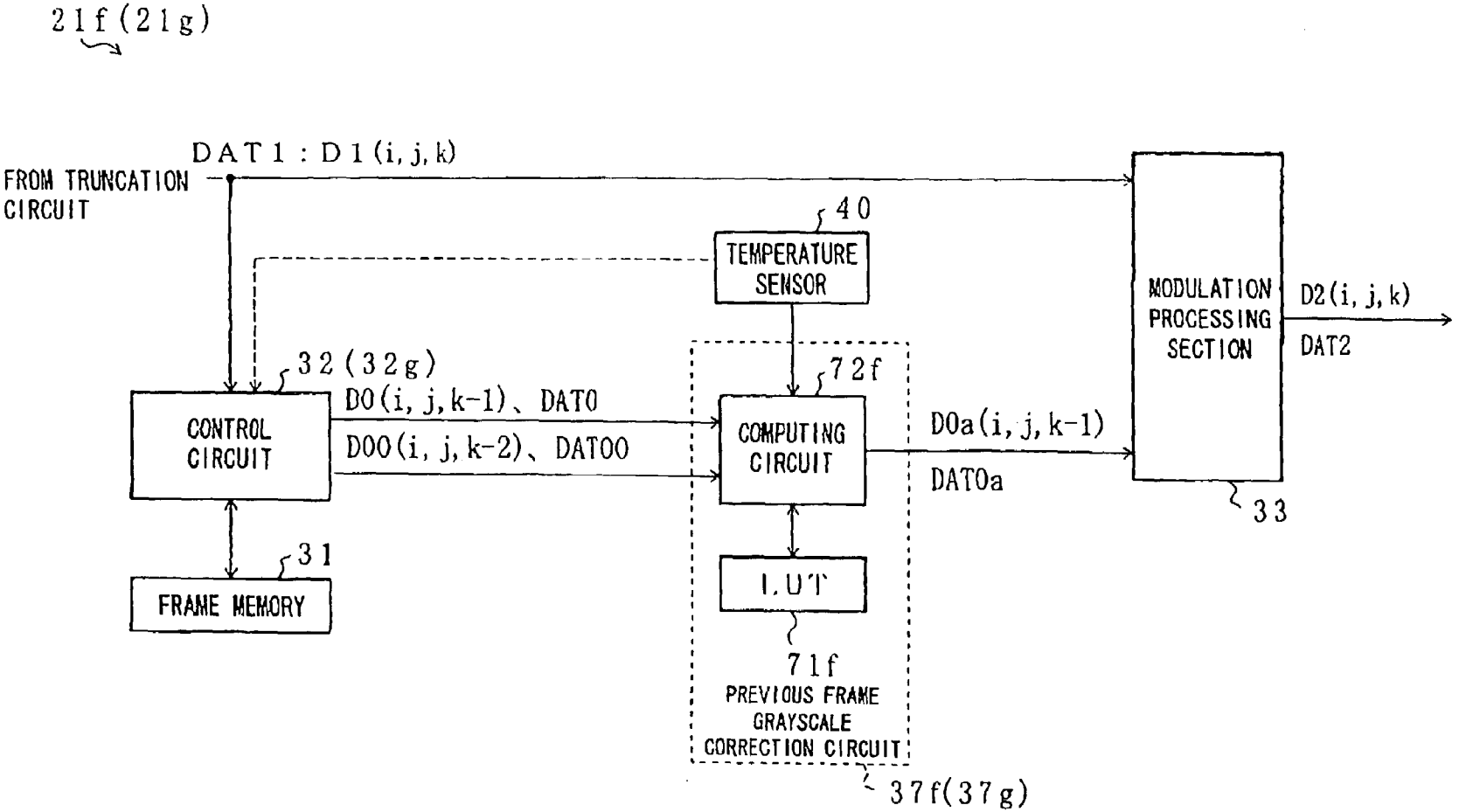
FIG. 13 shows still another embodiment of the present invention, and is a block diagram showing an important portion of a modulated-drive processing section.

That is, as shown in FIG. 13, a modulated-drive processing section 21*f* according to the present embodiment includes not only the arrangement of Embodiment 6 but also a temperature sensor 40 for detecting temperature of the sub-pixel SPIX. When a combination of the video data D00 of a certain further previous frame and the video data D0 of the previous frame is inputted, a previous frame grayscale correction circuit 37*f* determines whether it is necessary to correct the video data D0 or not and changes the corrected video data D0*a* in accordance with temperature detected by the temperature sensor 40.

Specifically, the previous frame grayscale correction circuit 37*f* according to the present embodiment includes a plurality of LUTs 71*f* respectively corresponding to predetermined temperature ranges. Each of the LUTs 71*f* stores reached values in a corresponding temperature range as in the LUT 71.

While, the computing circuit 72*f* of the previous frame grayscale correction circuit 37*f* selects the LUT 71*f*, which is referred to in performing interpolation computation, from the LUTs 71*f* in accordance with temperature information sent from the temperature sensor 40.

Here, in case where a liquid crystal element is adopted as the sub-pixel SPIX for example, a response speed of the liquid crystal element varies according to temperature. In this manner, in the case where the sub-pixel SPIX whose response speed varies according to temperature is adopted, temperature influences a condition of whether or not correction of the video data D1 that is performed by the modulation processing section 33 causes the excessive or poor brightness when the previous frame grayscale correction circuit 37*f* does not perform any correction.

However, in the foregoing arrangement, even when the response speed of the sub-pixel SPIX is so varied by temperature that a correction operation required in preventing occurrence of the excessive or poor brightness is changed, the previous frame grayscale correction circuit 37*f* can correct the previous frame video signal DAT0 in accordance with temperature of the current sub-pixel SPIX, so that it is possible to prevent occurrence of the excessive or poor brightness regardless of temperature.

Further, when temperature rises to be in a predetermined temperature range, the previous frame grayscale correction circuit 37*f* according to the present embodiment stops correcting the previous frame video signal DAT0. Thus, when temperature so rises that the sub-pixel SPIX (i, j) can respond at a sufficient speed which prevents occurrence of the excessive or poor brightness, the modulation processing section 33 corrects the video signal DAT of the current frame, in accordance with the uncorrected previous frame video signal DAT0 and the video signal DAT of the current frame, so as to emphasize the grayscale transition from the previous frame to the current frame.

As a result, it is possible to prevent the drop of the response speed of the image display device 1 without bringing about the following phenomenon: the grayscale transition is suppressed by the previous frame grayscale correction circuit 37*f* regardless of a condition of temperature which does not bring about the excessive or poor brightness caused by insufficient response.

Note that, the foregoing description explains the example where the LUT 71*f* is switched. However, the reached value monotonously varies with respect to variation of temperature, so that it may be so arranged that: the computing circuit 72*f* reads out reached values from two LUTs 71*f* indicative of temperatures closest to the current temperature so as to interpolate both the temperatures, thereby computing a reached value of the current temperature. In this arrangement, even when there are few LUTs 71*f*, it is possible to prevent occurrence of the excessive or poor brightness with high accuracy.

Embodiment 8

The present embodiment will describe an arrangement in which a bit width of the video data D00 (i, j, k−2) of the further previous frame that is stored in the frame memory 31 and a bit width of the video data D0 (i, j, k−1) of the previous frame that is stored in the frame memory 31 are varied in accordance with temperature. Note that, the arrangement can be applied to each of Embodiments 1 to 7, but the following description will explain a case where the arrangement is applied to Embodiment 7.

That is, in a modulated-drive processing section 21*g* according to the present embodiment, as shown in FIG. 13, the bit width of the video data D00 (i, j, k−2) of the further previous frame that is stored in the frame memory 31 and the bit width of the video data D0 (i, j, k−1) of the previous frame that is stored in the frame memory 31 are varied in accordance with temperature, and the bit width of the video data D00 (i, j, k−2) of the further previous frame is enlarged as it corresponds to a lower temperature range, and the bit width of the video data D0 (i, j, k−1) of the previous frame is reduced with the reduction corresponding to the increment of that bit width. Note that, the control circuit 32*g* and a control circuit 32*i* described later, provide one form of non-limiting support for the bit width control means.

Here, in order to reduce the storage capacity of the frame memory 31, a total of the bit widths of both the video data D00 (i, j, k−2) and D0 (i, j, k−1) stores in the frame memory 31 is limited to a predetermined bit width (for example, 10 bits), and the bit widths of the video data D00 (i, j, k−2) and D0 (i, j, k−1) are set so as to most exactly correct the video data D0 (i, j, k−1) of the previous frame. While, a grayscale reached by the sub-pixel SPIX (i, j) is more susceptible to the video data of the further previous frame due to the grayscale transition from the further previous frame to the previous frame as the response speed of the sub-pixel SPIX (i, j) is lower. Thus, when temperature varies, also the most appropriate allocation of the bit widths of the video data D00 (i, j, k−2) and D0 (i, j, k−1) varies.

When the response speed of the sub-pixel SPIX is so varied by temperature that the most appropriate allocation of the bit widths varies, a previous frame grayscale correction circuit 37*g* according to the present embodiment changes the allocation of the bit widths of both the video data D00 (i, j, k−2) and D0 (i, j, k−1) in accordance with temperature of the current sub-pixel SPIX, thereby enlarging the bit width of the video data D00 (i, j, k−2) of the further previous frame as it goes into a lower temperature range. As a result, it is possible to keep the allocation of the bit widths in an appropriate condition regardless of the temperature variation, so that it is possible to correct the video data D0 (i, j, k−1) with high accuracy. Thus, it is possible to more exactly prevent occurrence of the excessive or poor brightness.

For example, when the total of the bit widths of the video data of the further previous frame and the previous frame is 10 bits as exemplified by the foregoing values, the bit width of the video data D00 (i, j, k−2) of the further previous frame is set to 4 bits in an ordinary temperature range, and the bit width is set to 5 bits at temperature lower than the ordinary temperature range.

Embodiment 9

Incidentally, each of the aforementioned embodiments explains the example where reached values are stored in the LUTs 71 (71*e*•71*f*), but the arrangement is not limited to this. As described above, occurrence of the excessive brightness tends to deteriorate the display quality, it may be so arranged that: a grayscale indicative of a value larger than a reached value is written in the LUT 71 so as to surely prevent the occurrence of the excessive brightness, and the previous frame grayscale correction circuit 37 (37 to 37*f*) corrects the grayscale to be larger than the reached value when it is necessary to correct the previous frame video data DAT0.

In this arrangement, it is possible to further suppress emphasis of the grayscale transition from the further previous frame to the previous frame compared with the case where the reached value is written, so that it is possible to prevent occurrence of the excessive brightness without fail.

Further, the correction process performed by the previous frame grayscale correction circuit may be changed in accordance with a type of the image. Note that, this arrangement can be applied to each of Embodiments 1 to 8, but the following description will explain a case where the foregoing arrangement is applied to Embodiment 6.

Figure 14:
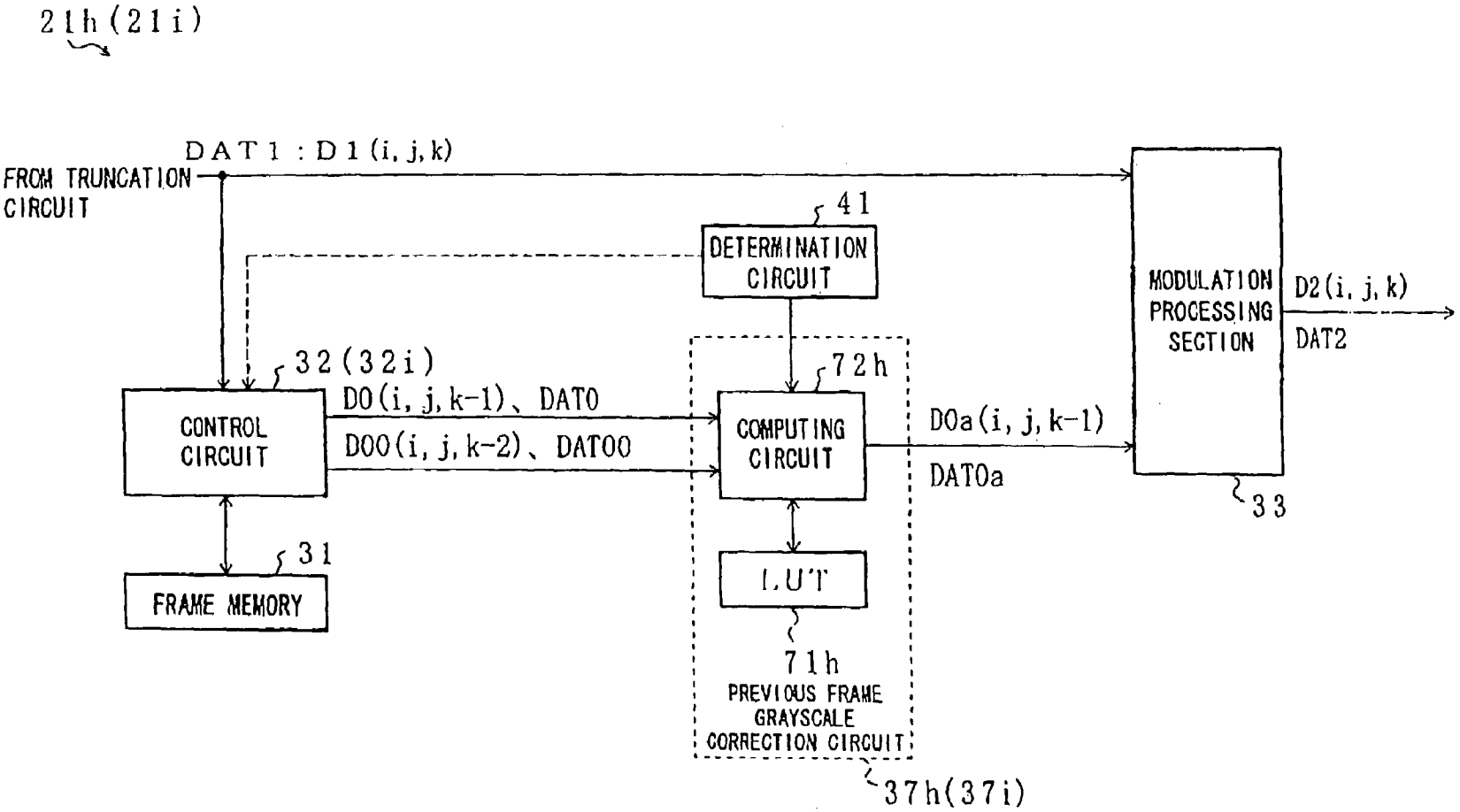
FIG. 14 shows further still another embodiment of the present invention, and is a block diagram showing an important portion of a modulated-drive processing section.

Specifically, in addition to the arrangement of Embodiment 6, a modulated-drive processing section 21*h* according to the present embodiment includes a determination circuit 41 for determining a type of image as shown in FIG. 14, and a previous frame grayscale correction circuit 37*h* changes (i) whether or not to correct the video data D0 and (ii) corrected video data D0*a*, in accordance with the determination result given by the determination circuit 41, in case where a combination of the video data D00 of a certain further previous frame and the video data D0 of the previous frame is inputted.

Specifically, the previous frame grayscale correction circuit 37*h* according to the present embodiment includes a plurality of LUTs 71*h* respectively corresponding to predetermined temperature ranges. As in the LUT 71, reached values corresponding to types of images are stored in each of the LUTs 71*h*. While, a computing circuit 72*h* of the previous frame grayscale correction circuit 37*h* selects an LUT 71*h*, which should be referred to in interpolation computation, from the LUTs 71*h*, in accordance with information provided from the determination circuit 41.

Here, in case where the previous frame grayscale correction circuit 37*h* corrects the grayscale so that its value is larger than the reached value when it is necessary to correct the previous frame video signal DAT0 as described above, when a corrected value is set to be much larger than the reached value, it is possible to prevent occurrence of the excessive brightness without fail but the response speed drops. Thus, a difference between the corrected value and the reached value is set so as to suppress the occurrence of the excessive brightness while preventing the response speed from significantly dropping. However, an appropriate value as the foregoing difference varies due to a type of an image. Thus, in case where the difference is fixed, when many types of images are inputted, it is difficult to set appropriate values with respect to all the types of images.

On the other hand, in the modulated-drive processing section 21*h* according to the present embodiment, the difference between the corrected value and the reached value is changed in accordance with types of images. Thus, no matter what type of images, i.e., a fast-moving image or a slow-moving image, may be inputted, it is possible to suppress the occurrence of the excessive brightness while preventing the response speed from significantly dropping.

Further, in case where the type of the image is a slow-moving image, and it is anticipated that insufficient response will not bring about the excessive or poor brightness even when the previous frame grayscale correction circuit 37*h* does not correct the previous frame video signal DAT0, the previous frame grayscale correction circuit 37*h* according to the present embodiment stops correcting the previous frame video signal DAT0. As a result, it is possible to prevent the response speed of the image display device 1 from dropping without bringing about the following phenomenon: although an image is displayed while preventing occurrence of the excessive or poor brightness caused by slow movement and insufficient response, the grayscale transition is suppressed by the previous frame grayscale correction circuit 37*h*.

Embodiment 10

The present embodiment will describe an arrangement in which a bit width of the video data D00 (i, j, k−2) of the further previous frame that is stored in the frame memory 31 and a bit width of the video data D0 (i, j, k−1) of the previous frame that is stored in the frame memory 31 are varied in accordance with types of images. Note that, this arrangement can be applied to each of Embodiments 1 to 9, but the following description will explain a case where the foregoing arrangement is applied to Embodiment 7.

That is, in a modulated-drive processing section 21*i* according to the present embodiment, as shown in FIG. 14, a control circuit 32*i* varies the bit width of the video data D00 (i, j, k−2) of the further previous frame that is stored in the frame memory 31 and the bit width of the video data D0 (i, j, k−1) of the previous frame that is stored in the frame memory 31 in accordance with a detection result given by the determination circuit 41. In case where the type of the image is a faster-moving image, the bit width of the video data D00 (i, j, k−2) of the further previous frame is enlarged, and the bit width of the video data D0 (i,j,k−1) of the previous frame is reduced with the reduction corresponding to an increment of that bit width.

Here, in order to reduce the storage capacity of the frame memory 31, a total of the bit widths of both the video data D00 (i, j, k−2) and D0 (i, j, k−1) stored in the frame memory 31 is limited to a predetermined bit width (for example, 10 bits), and the bit widths of the video data D00 (i, j, k−2) and D0 (i, j, k−1) are set so as to most exactly correct the video data D0 (i, j, k−1) of the previous frame. While, a grayscale reached by the sub-pixel SPIX (i, j) is more susceptible to the video data of the further previous frame due to the grayscale transition from the further previous frame to the previous frame in case where a faster-moving image is inputted. Thus, when the type of the image varies and a predicted speed of movement varies, also the most appropriate allocation of the bit widths of the video data D00 (i, j, k−2) and D0 (i, j, k−1) varies.

When the response speed of the sub-pixel SPIX is so varied by the variation of the type of the image that the most appropriate allocation of the bit widths varies, the previous frame grayscale correction circuit 37*i* according to the present embodiment changes the allocation of the bit widths of both the video data D00 (i, j, k−2) and D0 (i, j, k−1) in accordance with the type of the current image, thereby enlarging the bit width of the video data D00 (i, j, k−2) of the further previous frame when the type of the image is a faster-moving image. As a result, it is possible to keep the allocation of the bit widths in an appropriate condition regardless of the type of the image, so that it is possible to correct the video data D0 (i, j, k−1) with higher accuracy. Thus, it is possible to more exactly prevent occurrence of the excessive or poor brightness.

Embodiment 11

Each of the following embodiments will describe an arrangement in which it is possible to improve the response speed of the pixel even in case of grayscale transition to a minimum grayscale.

Figure 15:
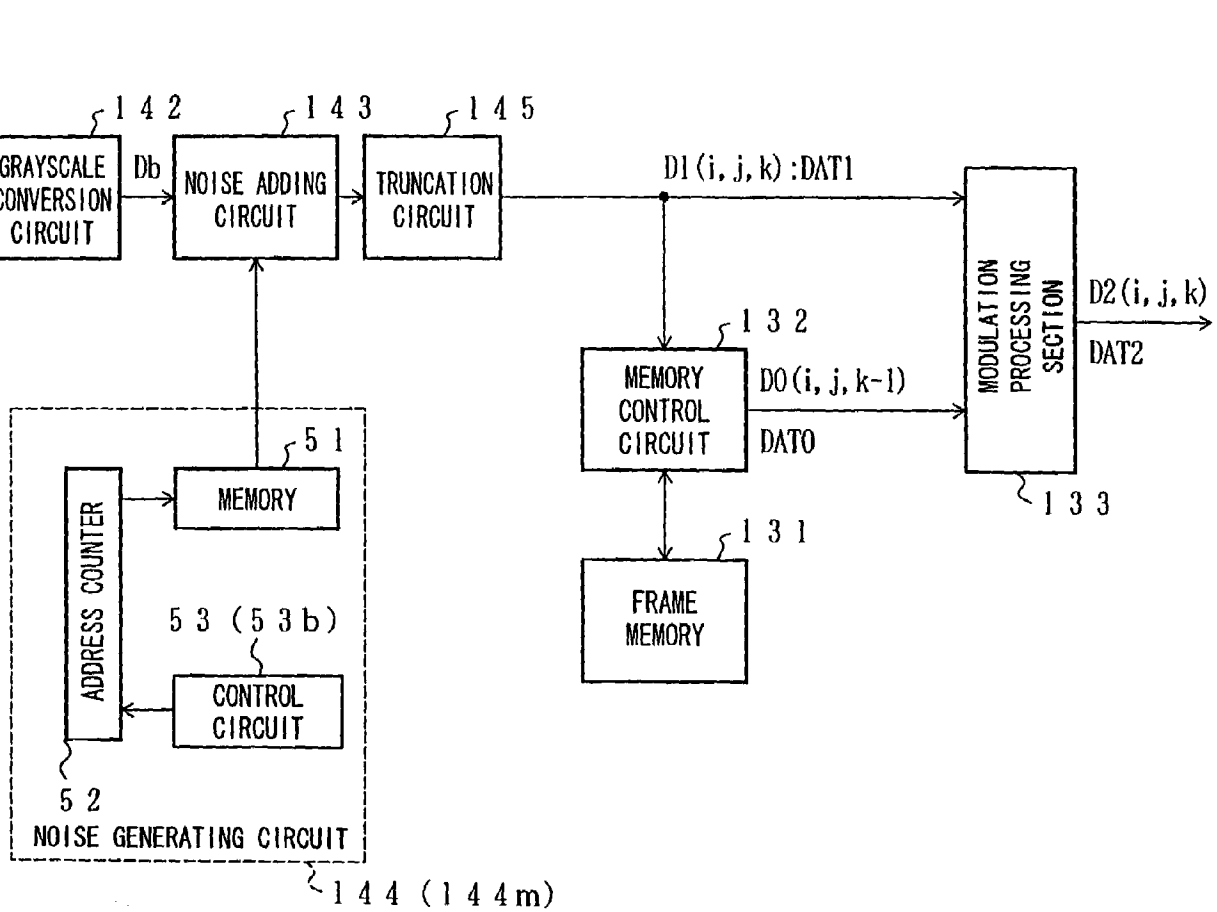
FIG. 15 shows another embodiment of the present invention, and is a block diagram showing an important portion of a modulated-drive processing section.

In more detail, as shown in FIG. 15, a modulated-drive processing section 21*j* according to the present embodiment includes: as a circuit for R, a frame, memory (one non-limiting example supporting the storage means) 131 for storing video data, supplied to the sub-pixel SPIX of R, which corresponds to one frame, until the next frame; a memory control circuit 132 for writing video data of the current frame FR (k) in the memory frame 131 and reading out video data D0 (i, j, k−1) of the previous frame FR (k−1) from the frame memory 131, so as to output the video data D0 (i, j, k−1) as a previous frame video signal DAT0; and a modulation processing section (one non-limiting example supporting the correction means) 133 for correcting the video data of the current frame FR (k) so as to emphasize the grayscale transition from the current frame to the previous frame, and outputting the corrected video data D2 (i, j, k) as a corrected video signal DAT2.

Further, a pixel array 2*j* (see FIG. 2) according to the present embodiment is set so as to have a γ property larger than γ of the video data D, supplied to the sub-pixel SPIX, which is inputted to the input terminal T1, and the modulated-drive processing section 21*j* includes a BDE (Bit-Depth Extension) circuit which has: a γ conversion circuit 141 for performing γ conversion with respect to the video data D, supplied to the sub-pixel SPIX, which is inputted to the input terminal T1, so as to convert the video data D into video data Da for displaying an image in a display device having a larger γ property; a grayscale conversion circuit 142 for compressing a possible value range, in which the video data Da is indicated, so as to generate video data Db which has the same bit width as that of the video data Da, and can represent a value lower than a black level of the video data Da, and can represent a value higher than a white level of the video data Da; a noise adding circuit 143 for adding a noise generated by a noise generating circuit (one non-limiting example supporting the noise generating means) 144 to the video data Db, so as to output the video data Db; and a truncation circuit 145 for truncating a less significant bit of video data outputted from the noise adding circuit 143 so as to reduce the bit width of the video data.

The video data D1 (i, j, k) outputted from the truncation circuit 145 is inputted to the modulation processing section 133 and the memory control circuit 132 as video data of the current frame FR (k). Note that, the γ conversion circuit 141 and the grayscale conversion circuit 142 correspond to one non-limiting example supporting the tone conversion means, and the noise adding circuit 143 and the truncation circuit 145 correspond to one non-limiting example supporting the noise adding means. Further, in the present embodiment, the sub-pixels SPIX (1, j), (4, j) . . . display R, so that video data D (1, j, k), D (4, j, k) . . . are inputted to the input terminal T1.

In the present embodiment, the video data D for displaying an image in a display device having a property of γ=2.2 is inputted to the input terminal T1 as a general video signal, and the γ property of the pixel array 2*j* is set so that γ=2.8. Further, the γ conversion circuit 141 generates the video data Da having the same property as the γ property of the pixel array 2*j*, that is, the video data Da for displaying an image in a display device having a property of γ=2.8. Further, the γ conversion circuit 141 according to the present embodiment converts the video data D into the video data Da having a wider bit width in order to suppress occurrence of an error caused by the γ conversion. For example, a video signal of 8 bits is inputted to the input terminal T1 as a general video signal so as to correspond to each color, and the γ conversion circuit 141 converts the video data D of 8 bits into the video data Da of 10 bits.

Figure 16:
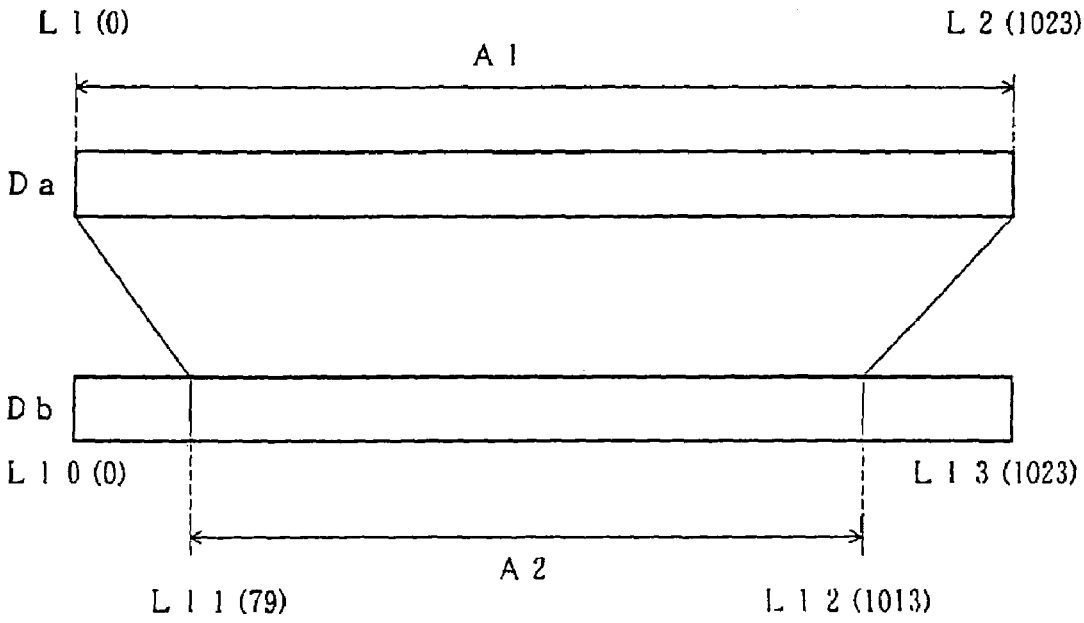
FIG. 16 shows how a grayscale conversion circuit provided in the modulated-drive processing section operates, and shows a relationship between (i) a value range before performing grayscale conversion and (ii) a value range after performing the grayscale conversion.

Further, as shown in FIG. 16, the grayscale conversion circuit 142 compresses a possible value range A1, in which the video data Da is indicated, so as to convert the value range A1 into a value range A2 narrower than the value range A1. Further, when the video data Db can represent grayscales L10 to L13, the value range A2, that is, a range from a grayscale L11 to a grayscale L12 is so set that: L10<L11, and L12<L13. In the present embodiment, each of the video data Da and Db is 10 bits, and L1=L10=0, and L2=L13=1023, and the foregoing L11 and L12 are set to 79 and 1013 for example. Note that, in the video data Da, a smallest grayscale (L1) indicates black, and a largest grayscale (L2) indicates white.

While, the noise generating circuit 144 outputs such a random noise that a pseudo outline does not occur in an image displayed in the pixel array 2*j*, and an average value of thus outputted random noise is 0. Further, when a maximum value of noise data is too large, there is a possibility that a noise pattern may be recognized by a user of an image display device 1*j*, so that a maximum value of the noise is set so that the noise pattern is not recognized.

In the present embodiment, the video data Db (i, j, k), supplied to the sub-pixel SPIX (i, j), which is inputted to the noise adding circuit 143, is represented by 10 bits, and the volume of the noise data is set to be within ±7 bits. Note that, the noise generating circuit 144 is arranged in the same manner as the noise generating circuit 35 according to Embodiment 1 except for the volume of the generated noise.

Further, the truncation circuit 145 truncates less significant 2 bits from the video data of 10 bits that is outputted from the noise generating circuit 144, and outputs the video data as video data D1 (i, j, k) of 8 bits. Accordingly, in the frame memory 131, a storage area for storing the video data D1 (i, j, k) of the current frame FR (k) is set so that single video data D1 (i, j, k) corresponds to 8 bits.

Thus, it is possible to reduce the number of bits of the video data processed by circuits positioned after the truncation circuit 145 so that there is no apparent difference from the case of displaying an image based on the video data D before truncating, while preventing the noise pattern and the pseudo outline from occurring in an image displayed in the pixel array 2*j*.

Here, the added noise is recognized by the user of the image display device 1*j* in terms of (i) how largely an observed grayscale is different from a grayscale of peripheral pixels (regulation) and (ii) how largely the luminance of the observed grayscale is different from target luminance (error). Generally, it is known that: in a field of visualization based on 100 ppi like the image display device 1, an allowable limit of the error is approximately 5% with respect to white luminance, and an allowable limit of the regulation is approximately 5% with respect to the display grayscale.

When the grayscale of the sub-pixel SPIX is increased by X grayscale, computation is performed with respect to how the transmittance of the pixel increases with respect to the peripheral luminance (transmittance before increasing the grayscale) in terms of percent. As a result of the computation, in case where the γ property of the pixel array 2*j* is γ=2.8 and the video data Db is represented by 10 bits, when x is 32 to 48 grayscales, the regulation of almost all the grayscales is within the foregoing allowable limit. Likewise, when the display grayscale of the pixel is increased by X grayscale, computation is performed with respect to how the transmittance of the pixel increases with respect to an original transmittance (transmittance before increasing the grayscale) in terms of percent. As a result of the computation, in case where the γ property of the pixel array 2*j* is γ=2.8 and the video data Db is represented by 10 bits, when x is 32 to 48 grayscales, the regulation of almost all the grayscales is within the foregoing allowable limit. As a result, in case of the noise of 32 to 48 grayscales, almost all the grayscales are below the allowable limit, so that it is possible to prevent the user from feeling deterioration of the apparent display quality.

Thus, on the assumption that the user views an image at such a distance that it is impossible to recognize each pixel, it is preferable to set, in a range of from 2 to 3 pixels (6 to 9 sub-pixels), the regulation and the error so as not to exceed 5%. Here, when the noise data is indicated by substantially normal distribution, 32 to 48 [grayscales]$\times 6^{(1/2)}$ to $9^{(1/2)}$=80 to 144 [grayscales]. Thus, even when a fixed noise of 7 bits is added in a time series manner, that is, a fixed noise is added in a time-series manner so that its bit width is smaller than that of the video data Db by approximately 3 bits, there is no possibility that the noise pattern may be recognized by the user of the image display device.

Here, it is general that: even when the pixel size is larger, a distance at which the user views an image does not increase in proportion to the pixel size. Thus, as the pixel size is larger, the allowable level of the noise data is lower. Therefore, in a value range of 1 to 144 grayscales (within 7 bits), a value range preferably used in many image display devices 1 as a maximum value of an absolute value of the noise data is 48 to 80 grayscales. It is more preferable to set the value to be 63 grayscales (6 bits).

In this arrangement, the video data D1 (i, j, k) of the current frame FR (k) is corrected so that the modulation processing section 133 emphasizes the grayscale transition from the previous frame FR (k−1) to the current frame FR (k), so that it is possible to improve the response speed of the sub-pixel SPIX.

Besides, in the foregoing arrangement, the pixel array 2*j* is set so as to have a γ property larger than that of the video data D inputted to the input terminal T1, and the video data D inputted to the input terminal T1 is converted into video data Da having a larger γ property by the γ conversion circuit 141. Further, the grayscale conversion circuit 142 converts the vide data Da into video data Db which enables a grayscale to be displayed on the basis of a value lower than that of a black level of the video data Da. Thereafter, the modulation processing section 133 emphasizes the grayscale transition from the previous frame to the current frame.

Figure 17:
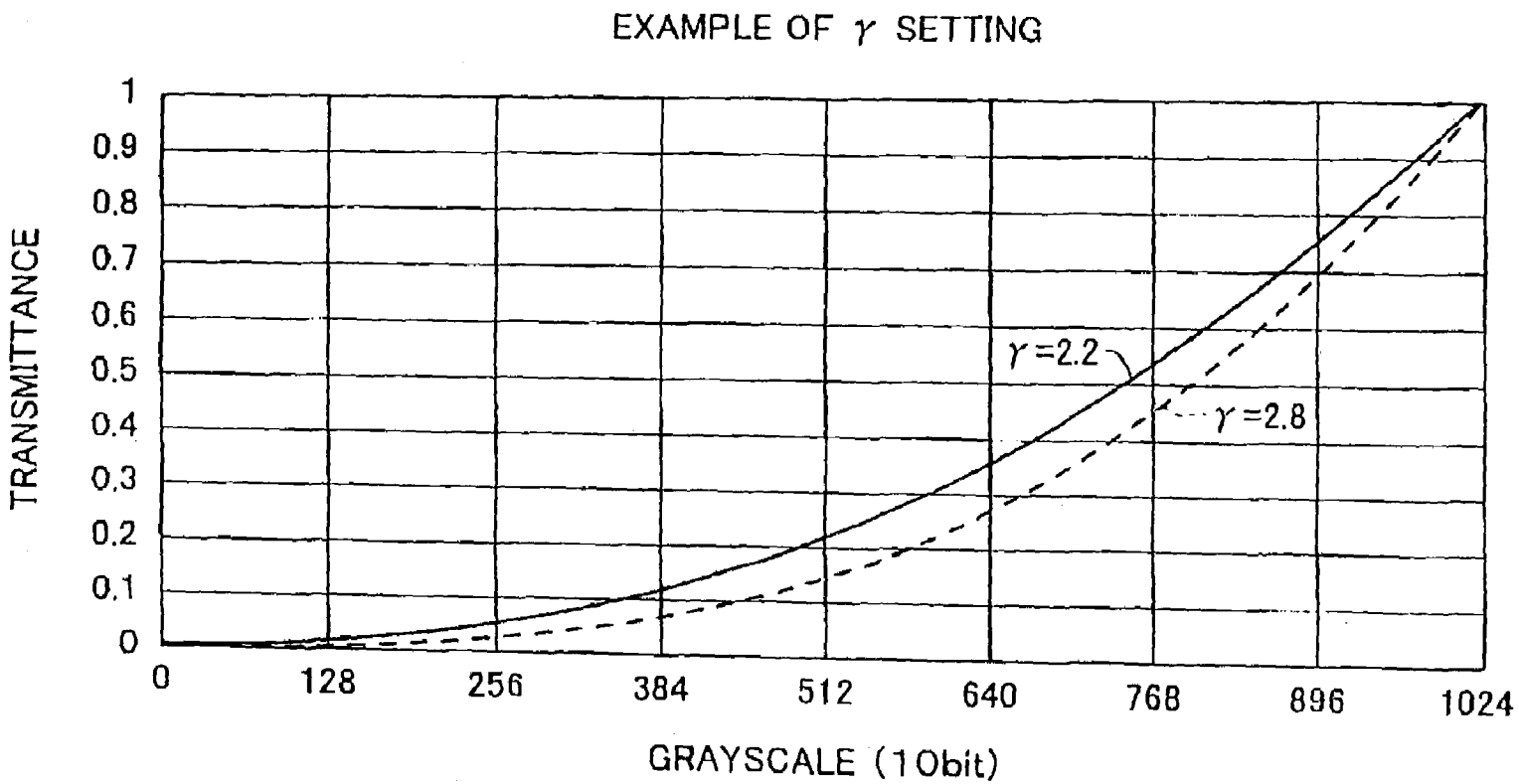
FIG. 17 shows how a γ conversion circuit provided in the modulated-drive processing section operates, and shows γ properties before and after performing the grayscale conversion.

In the arrangement, as shown in FIG. 17, due to the γ conversion, grayscales displayed by the sub-pixels SPIX are more liable to be blackened. Further, due to the grayscale conversion, predetermined grayscales thereof (grayscales L10 to L11 shown in FIG. 16) are allocated as grayscales whose levels are lower than the black level of the video data D.

In other words, in the present embodiment, the γ property at least in the display grayscale area is set to be larger than the γ property of the inputted video data. Further, in the present embodiment, it is more preferable to set the γ property to be larger also in an area for emphasizing the transition of low grayscales.

Thus, the modulation processing section 133 can use the grayscales L10 to L11, whose levels are lower than the black level in the case where the grayscale transition is not emphasized, so as to emphasize the grayscale transition.

As a result, unlike the arrangement in which the corrected video data D2 indicative of a black level in the case where the grayscale transition is not emphasized is identical with the corrected video data D2 in the case where the grayscale transition is most emphasized so that the grayscales are reduced, it is possible to further emphasize the grayscale transition so that the grayscales are reduced, thereby improving the response speed of the sub-pixel SPIX.

Here, in case where a liquid crystal cell in a vertical alignment mode is used in a normally black mode, when the grayscale varies so as to be a larger grayscale (grayscale transition in "rise"), a slant electric field generated by a voltage applied to the pixel electrode causes liquid crystal molecules to slant with respect to a direction parallel to a substrate of the liquid crystal cell. While, in case where the grayscale varies so as to be a smaller grayscale (grayscale transition in "decay"), the liquid crystal molecules are restored so as to be in a vertical direction due to a force that a vertical alignment film formed on the substrate exerts in a vertical direction. Thus, in the case of using the liquid crystal cell, the grayscale transition in "decay" tends to be slower than the grayscale transition in "rise".

However, the modulated-drive processing section 21*j* arranged in the foregoing manner further emphasizes the grayscale transition in "decay", so that it is possible to further reduce the response speed in "decay". As a result, even in the case of using such a liquid crystal cell, it is possible to realize the image display device 1*j* having the sufficiently high response speed.

Particularly, the response speed of the liquid crystal is low at a low temperature, so that the grayscale transition in "decay" tends to be slow. However, the modulated-drive processing section 21*j* enhances the response speed in the grayscale transition in "decay", so that the modulated-drive processing section 21*j* can be preferably used under a condition of low temperature.

Further, in the present embodiment, the BDE circuit having the noise adding circuit 143 and the truncation circuit 145 is provided at a previous stage of the frame memory 131. Thus, it is possible to reduce the data amount of the video data D1 (i, j, k) stored in the frame memory 131 without apparently deteriorating the display quality of an image displayed in the pixel array 2*j*.

In the present embodiment, although the bit width of the video data Db inputted to the noise adding circuit 143 is 10 bits, the bit width of the video data D1 (i, j, k) stored in the frame memory 131 is reduced so as to be 8 bits. Thus, it is possible to reduce the memory capacitance required in the frame memory 131. Further, in circuits positioned after the truncation circuit 145, that is, in the memory control circuit 132, the previous frame grayscale correction circuit 137, the modulation processing section 133, the control circuit 12 of FIG. 2, and the data signal line driving circuit 3 of FIG. 2, the bit width of the video data is reduced from 10 bits to 8 bits. Thus, it is possible to reduce the number of wirings for connection thereof to ⅘ and to reduce an area occupied by the wirings to ⅘, thereby reducing a computing amount in the circuits.

Note that, it is necessary to transfer the video data at a comparatively high speed. Thus, in order to transfer the video data by circuits whose response speeds are comparatively low, it is necessary to provide a plurality of circuits in parallel and to operate them alternately. Therefore, when the number of bits of the video data increases, an area occupied by the circuits increases. However, in the foregoing arrangement, the bit width is reduced to 4/5. Thus, unlike the case of 10 bits, even in the case where the circuits operating in parallel to each other are provided, it is possible to prevent the area occupied by the circuits from increasing.

Further, in the foregoing arrangement, the BDE circuit having the noise adding circuit 143 and the truncation circuit 145 is provided at the previous stage of the frame memory 131 and the modulation processing section 133. Thus, unlike the case where the BDE circuit is provided at the following stage of the modulation processing section 133, the arrangement does not bring about the following disadvantage: after the modulation processing section 133 emphasizes the grayscale transition as much as possible so that the excessive brightness does not occur, the BDE circuit adds the noise, so that the excessive brightness is recognized. As a result, according to the foregoing arrangement, although the addition of noise and the emphasis of the grayscale transition are performed together, it is possible to prevent the occurrence of the excessive brightness.

Figure 28:
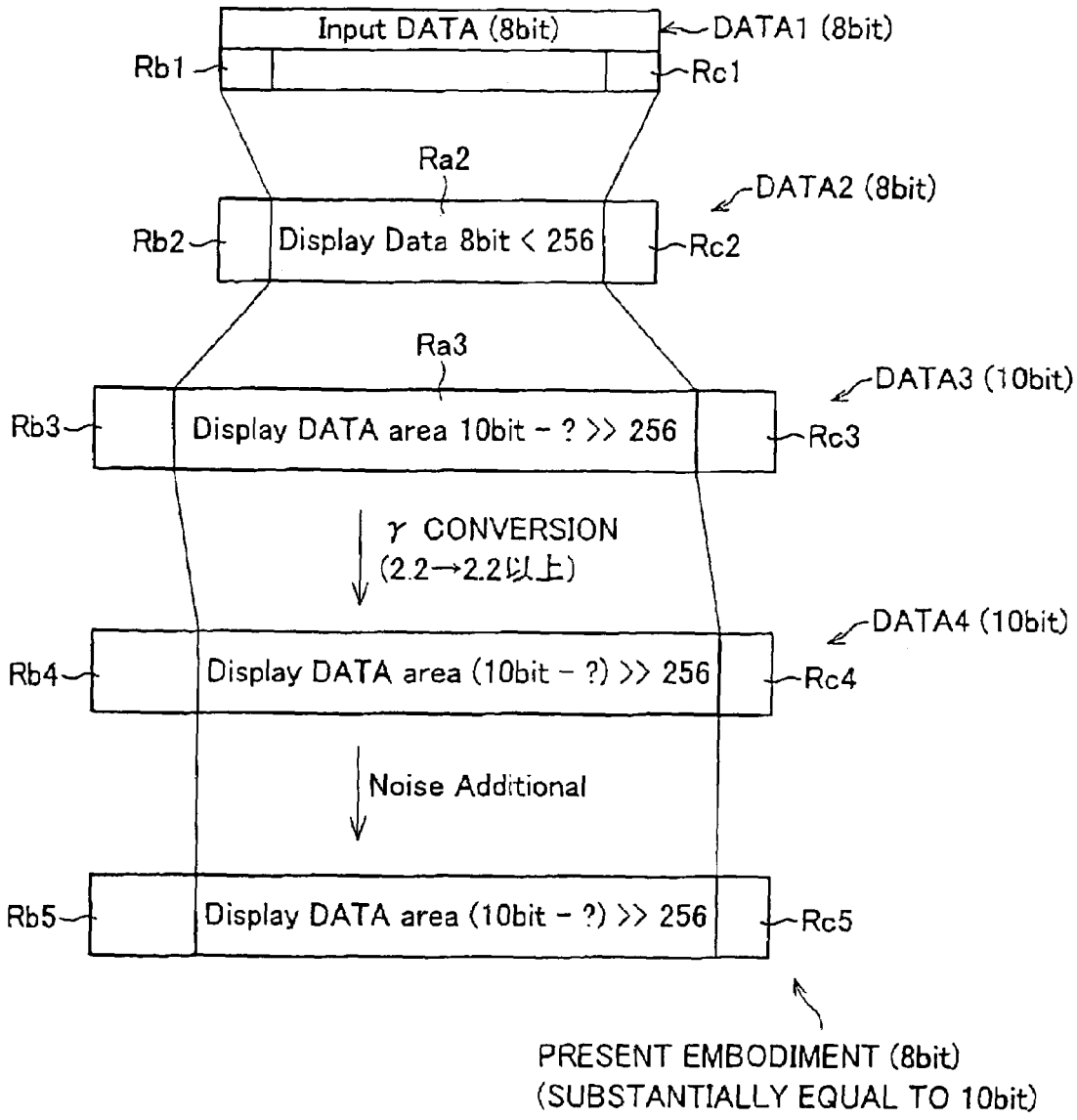
FIG. 28 further details the condition shown in FIG. 16.
Figure 29:
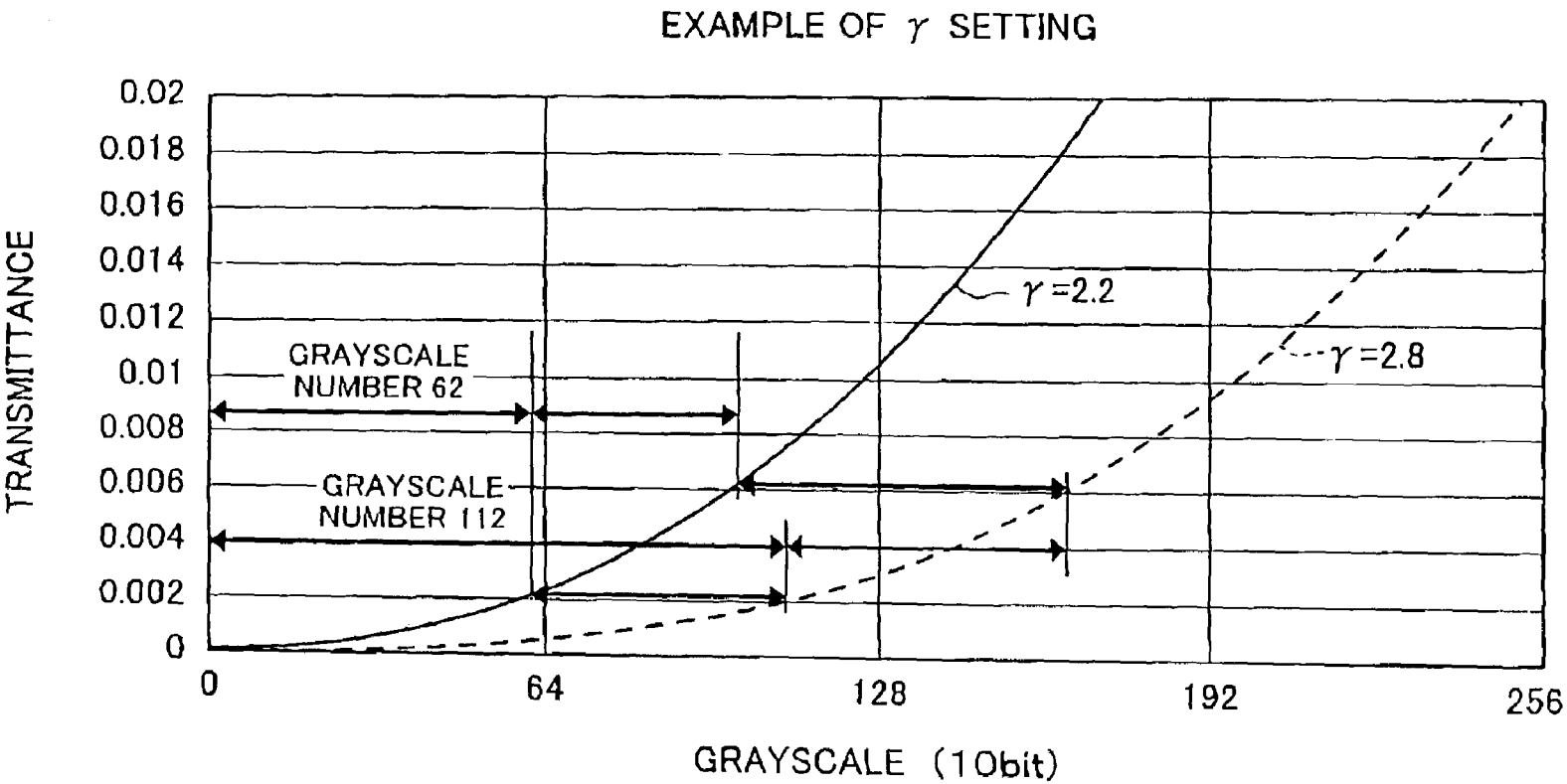
FIG. 29 further details the condition shown in FIG. 17.

The following description will further detail the foregoing effect, by comparing with some comparative examples, with reference to FIG. 28 and FIG. 29.

First, as a first comparative example, it is so arranged that: the members 141 to 145 are omitted, and the pixel array 2 whose γ property is the same as the γ property of the inputted video data is used. In this arrangement, as shown by DATA 1 of FIG. 28, 8-bit video data D (first tone data) inputted to the input terminal T1 is inputted to the memory control circuit 132 and the modulation processing section 133 without any modification.

In this case, the DATA 1 has no room for further emphasizing the transition of the substantially full grayscales (for example, grayscale transition between white and black), so that the modulation processing section 133 cannot sufficiently emphasize the transition of the substantially full grayscales. As a result, in the grayscales displayed in the pixel array 2, there occur areas Rb1 and Rc1, each of which cannot sufficiently reduce the response speed of the sub pixels since the grayscale transition is not sufficiently emphasized.

Next, as a second comparative example, it is so arranged that: merely the grayscale conversion circuit 142 is provided, and as shown by DATA 2 of FIG. 28, the inputted video data D is allocated to an area Ra2 narrower than the video data D, and is outputted. In this arrangement, there is a possibility that the following disadvantage may occur.

In more detail, the area Ra2 obtained after the conversion is set so that: within the area Ra2, the grayscale transition emphasis performed by the modulation processing section 133 enables the response speed of the sub pixels to be improved in the whole range of the inputted video data. Thus, it is possible to cause the sub pixels SPIX to respond at a sufficiently high speed regardless of a type of the inputted video data D.

In other words, the area Ra2 obtained after the conversion is limited compared with an area which enables data to be expressed in accordance with a bit width allocated to the DATA 2 (in this example, 8 bits), and there are remaining areas Rb2 and Rc2. Thus, the modulation processing section 133 can emphasize the grayscale transition from the one grayscale in the area Ra2 to the other grayscale in the area Ra2 by using the areas Rb2 and Rc2. As a result, even in the case of the transition of the substantially full grayscales (for example, the grayscale transition between an upper limit and a lower limit of the area Ra2), it is possible to further emphasize the grayscale transition by using the areas Rb2 and Rc2, thereby causing the sub pixels SPIX to respond at a sufficiently high speed.

However, according to the arrangement, the number of grayscales (grayscale number: the number of grayscales in the area Ra2) outputted by the grayscale conversion circuit 142 is smaller than the number of grayscales which can be expressed by the bit width (in this example, 8 bits) of the video data D, so that the display quality (the number of grayscales, the number of colors) is deteriorated.

Next, as a third comparative example, it is so arranged that: a bit width varying circuit (not shown) is provided at the previous stage of the grayscale conversion circuit 142, and as shown by DATA 3, the bit width varying circuit enlarges the bit width of the inputted video data D (for example, the bit width varying circuit enlarges the bit width from 8 bits to 10 bits). In this arrangement, there is a possibility that the following disadvantage may occur.

In more detail, according to the arrangement, an area Ra3 of grayscales outputted by causing the grayscale conversion circuit 142 to convert the video data D is an area obtained by removing remaining areas Rb3 and Rc3 from an area which enables data whose bit width has been enlarged to be expressed. However, the number of grayscales which can be expressed in the area Ra3 extraordinarily exceeds the number of grayscales (in this example, 256 grayscales) which the inputted video data D can indicate. Thus, unlike the second comparative example, it is possible to suppress deterioration of the display quality.

However, even in this arrangement, if it is impossible to have sufficient grayscales on the side of low grayscales, there is a possibility that a serious display error may occur. In more detail, human visual sense has a logarithmic sensitivity scale with respect to an energy of light (luminance), so that the human visual sense is more sensitive to the conversion as a displayed image is darker. In other words, in a relatively dark area, when a slight error occurs, the error is recognized as an abnormal image by person.

Thus, when there are not sufficient grayscales on the side of low grayscales, the display error occurs. As a result, it is difficult to sufficiently enlarge a size (size of Rb3) of an area which can be obtained in causing the modulation processing section 133 to emphasize the grayscale transition, so that it is difficult to improve the response speed and suppress deterioration of the display quality at once. Particularly, according to the arrangement in which the noise adding circuit 143 to the truncation circuit 145 are provided like the present embodiment, it is impossible to avoid occurrence of some errors caused by adding the noise. Thus, in a relatively bright area (on the side of high grayscales), even when the errors are not recognized, there is a possibility that the display error may significantly deteriorate the display quality unless sufficient grayscales are prepared on the side of low grayscales.

Meanwhile, as a fourth comparative example, it is so arranged that: as shown by DATA 4 of FIG. 28, the γ property of the pixel array 2*j* is set to be a larger value (for example, 2.8), and the γ conversion circuit 141 is provided at the previous stage of the grayscale conversion circuit 142. In this arrangement, it is possible to improve the response speed of the sub pixels SPIX without deteriorating the display quality. While, there is a possibility that the bit width of the video data which needs to be processed by a circuit provided at the following stage of the grayscale conversion circuit 142 may be larger.

In more detail, according to the arrangement, by performing the γ conversion, it is possible to allocate more grayscales on the side of low grayscales than in the third comparative example. For example, as shown in FIG. 17 and FIG. 29, the number of grayscales on the side of low grayscales is enlarged in the case where γ=2.8 compared with the case where γ=2.2. Here, when a grayscale which causes the transmittance to be 0.002 is set to be a black level in order to realize a contrast ratio of 500 as shown in FIG. 29, the number of grayscales which can express proximity of black (transmittance is 0.002 to 0.006) is 40 in the case where γ=2.2, and the number is 52 in the case where γ=2.8. Thus, by performing the grayscale conversion so that γ is larger, the modulated drive processing section 21*j* can select grayscales, whose luminance more exactly corresponds to an input, in the low grayscales.

Further, when a grayscale which causes the transmittance to be 0.002 is set to be a black level, as shown in FIG. 29, the number of grayscales lower than the black level is 62 in the case where γ=2.2, and the number is 112 in the case where γ=2.8. Thus, by performing the grayscale conversion so that γ is larger, the modulated drive processing section 21*j* can more surely emphasize the grayscale transition, so that it is possible to more exactly improve the response speed of the sub pixels SPIX.

Note that, the foregoing description explains the example where a grayscale which causes the transmittance to be 0.002 is set to be a black level. However, in case where a still image is prioritized, a grayscale whose transmittance is lower is set to be a black level, and the number of grayscales in the proximity of black is increased. Adversely, in case where a moving image is prioritized, a grayscale whose transmittance is larger is set to be a black level, and the number of grayscales lower than the black level is increased.

In both the cases, it is possible to sufficiently enlarge a size (size of Rb4) of an area which can be obtained in causing the modulation processing section 133 to emphasize the grayscale transition. Thus, it is possible to suppress the occurrence of the display error, and it is possible to improve the response speed and to suppress deterioration of the display quality. Note that, in FIG. 28, Rc4 is an area, corresponding to the side of high grayscales, which is used to emphasize the grayscale transition.

However, according to the arrangement of the fourth comparative example, unlike the present embodiment, the noise adding circuit 143 to the truncation circuit 145 are not provided. Accordingly, a circuit positioned after the grayscale conversion circuit 142 needs to process data whose bit width has been enlarged (for example, 10-bit width). Thus, the frame memory 131 is required to have more storage capacity. Further, it is necessary to arrange the pixel array 2*j* so that it is possible to display an image based on vide data having wider bit width (for example, 10 bits), so that cost of a driver IC and the like increases.

On the other hand, in the modulated drive processing section 21*j* according to the present embodiment, the noise adding circuit 143 to the truncation circuit 145 are provided at the following stage of the grayscale conversion circuit 142. Thus, it is possible to reduce a bit width of a video signal which should be processed by a circuit positioned after the grayscale conversion circuit 142 compared with the fourth comparative example. Further, as described above, after adding the noise, the less significant bit is rounded, thereby generating the video data D1.

Thus, unlike the arrangement in which the less significant bit is merely truncated without adding the noise, it is possible to suppress the occurrence of the pseudo outline and it is possible to keep the display quality so that a displayed image is not apparently different from an image displayed on the basis of data whose bit width has been enlarged (for example, 10-bit width) though the bit width is reduced. Note that, in FIG. 28, Rb5 and Rc5 are areas, respectively corresponding to the side of low grayscales and the side of high grayscales, which are used to emphasize the grayscale transition.

Figure 18:
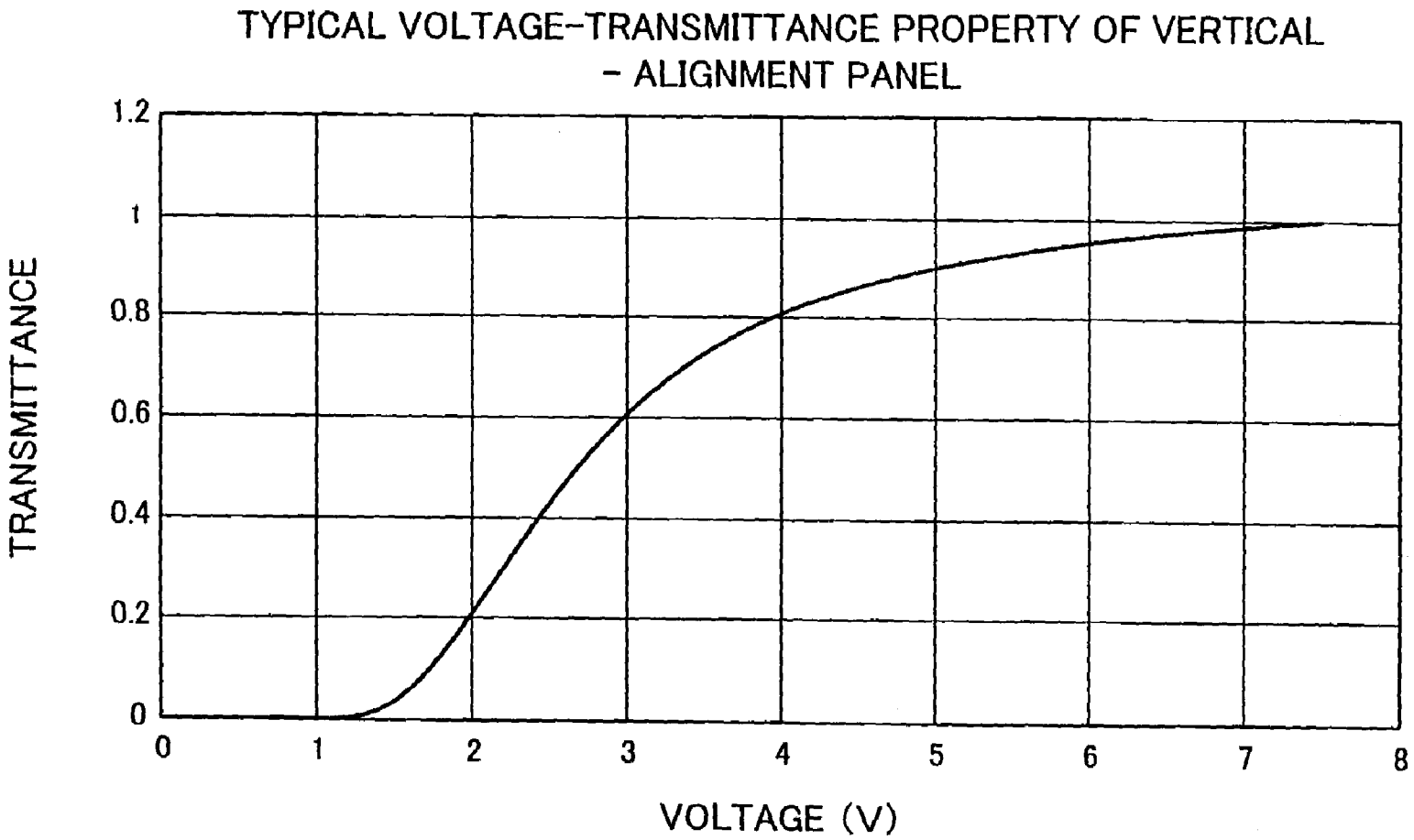
FIG. 18 is a graph showing a voltage-transmittance property of a liquid crystal cell used in a pixel array of the image display device.

The following description will detail the improvement of the response speed by giving an example where the liquid crystal cell in a vertical alignment mode is used in a normally black mode. That is, a typical liquid crystal cell has a voltage-transmittance property shown in FIG. 18 for example, and a voltage (white voltage) applied in displaying a grayscale of a white level is set to be approximately 7.5[V] for example.

Here, when a black voltage is set to be 0[V], it is possible to realize 1000 or more contrasts, but it is troublesome to design a network of resistors used to generate voltages corresponding to respective grayscales. Thus, in order to realize approximately 500 contrasts like a general television, the black voltage is set to be approximately 0.6[V] to 1.1[V].

Figure 19:
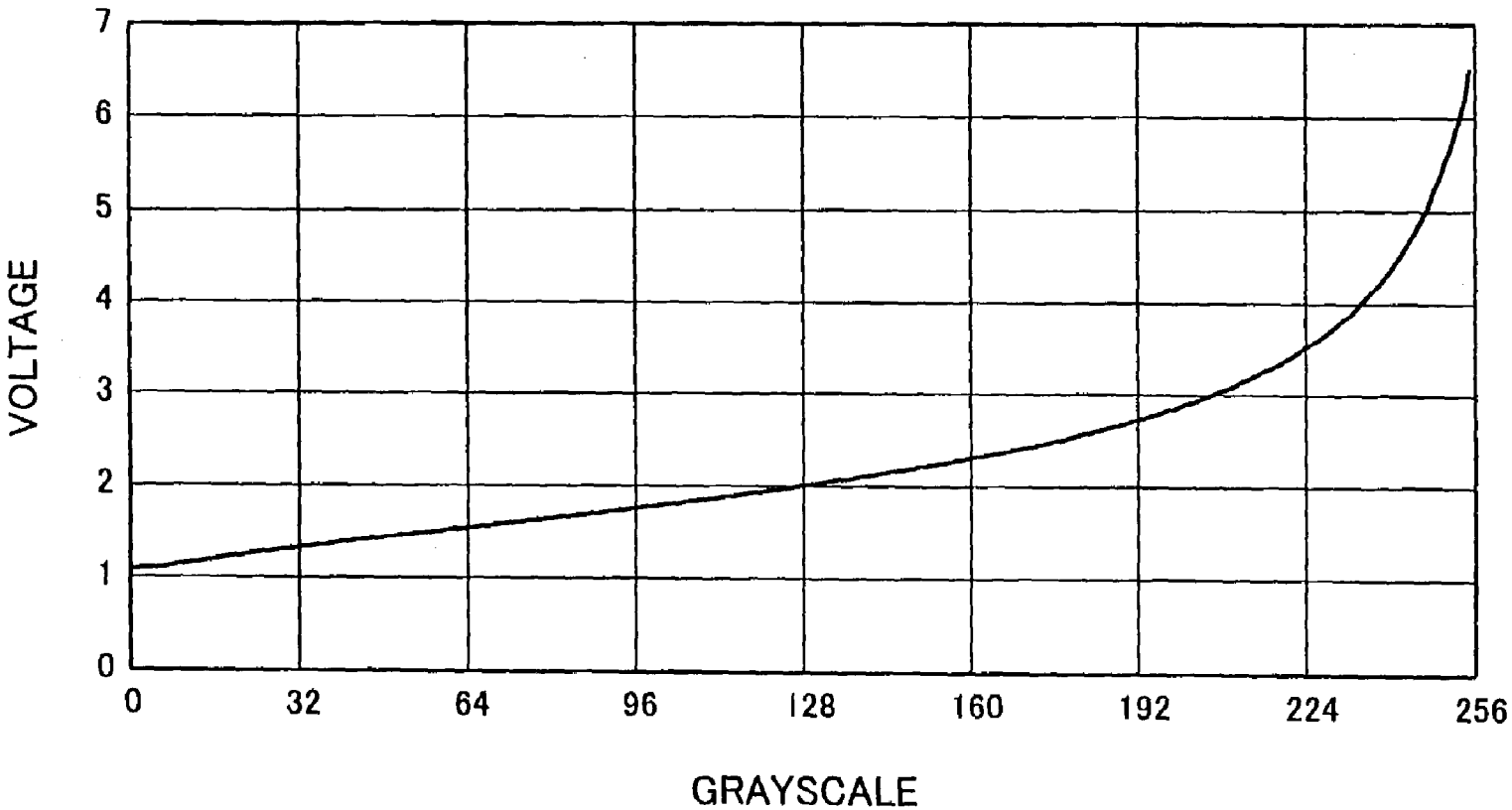
FIG. 19 shows a comparative example, and is a graph showing a relationship between (i) a grayscale received by a data signal line driving circuit of an image display device and (ii) a voltage applied to a pixel.

As a comparative example, the following description explains an arrangement in which: a pixel array whose γ property is set to γ=2.2 displays an image based on video data D whose γ property is set to γ=2.2 without converting the video data D by means of the γ conversion circuit 141 and the grayscale conversion circuit 142. In such an arrangement, a grayscale-voltage property of a data signal line driving circuit of the pixel array is set as shown in FIG. 19. Note that, as described above, when the black level is raised, it is troublesome to design a network of resistors. Thus, in the case where γ=2.2, the black voltage is set to be 1.1[V] as shown in FIG. 19.

Figure 20:
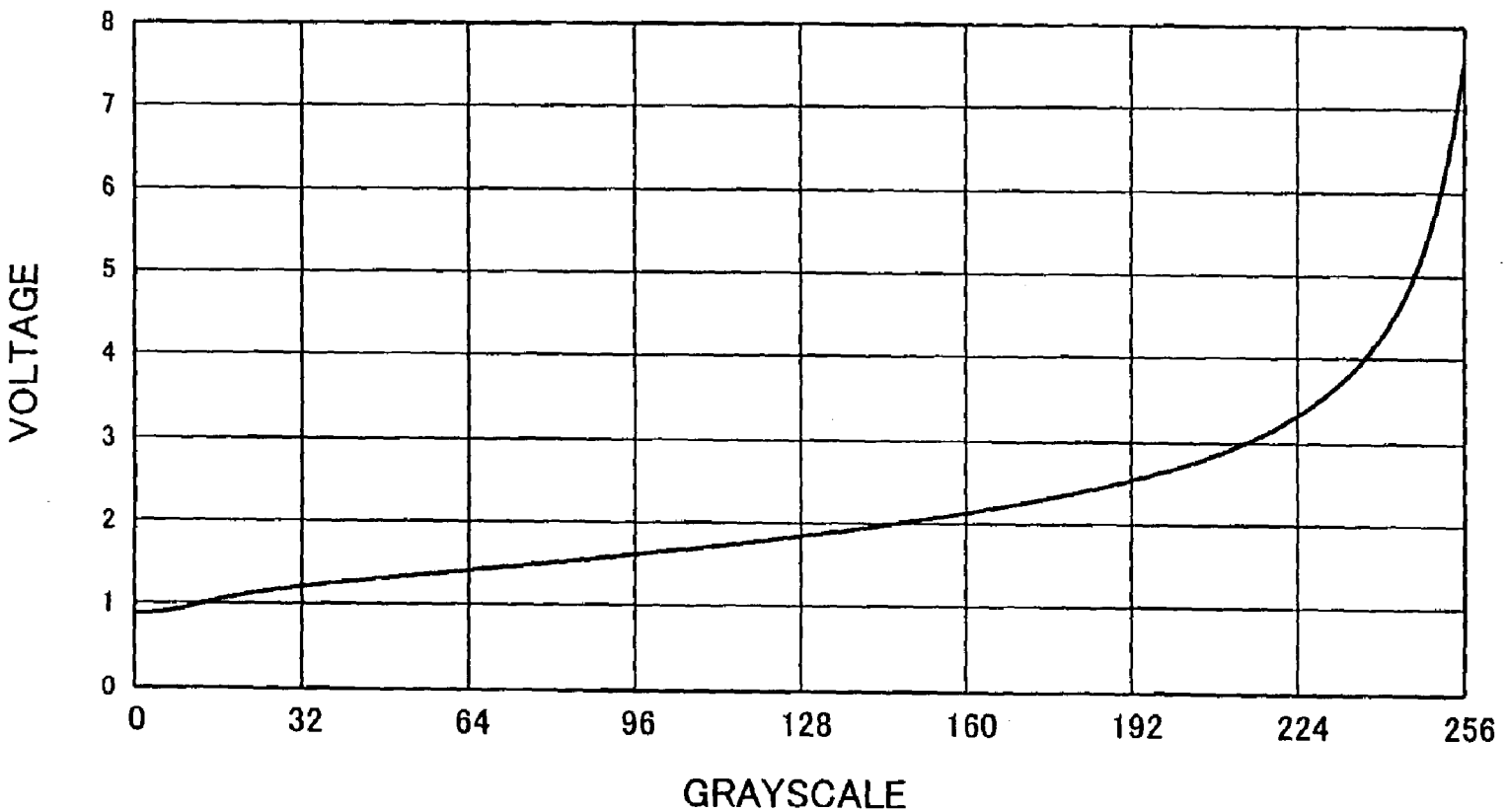
FIG. 20 is a graph showing a relationship between (i) a grayscale received by a data signal line driving circuit of the image display device according to the foregoing embodiment and (ii) a voltage applied to the pixel.

While, the pixel array 2*j* according to the present embodiment is set so that γ=2.8, and the grayscale-voltage property of the data signal line driving circuit 3 is set as shown in FIG. 20. Here, the pixel array 2*j* is set so that γ=2.8, so that it is possible to set the black voltage to be low without taking any trouble in designing unlike the case where γ=2.2. Thus, in an example of FIG. 20, a lowest voltage which can be applied by the data signal line driving circuit 3 is set to be 0.8[V] for example. Note that, in this case, this arrangement realizes approximately 900 contrasts.

Further, the video data D is converted into the video data Db by the γ conversion circuit 141 and the grayscale conversion circuit 142 according to the present embodiment converts as shown in FIG. 21, and the data signal line driving circuit 3 applies a voltage shown in FIG. 21 in accordance with each video data Db.

In the present embodiment, in case where the modulation processing section 133 outputs the video data D1 (i, j, k) of the current frame FR (k) without any modification like the case where a still image is displayed, when the video data D (i, j, k) indicates a black level, the video data Db (i, j, k) outputted from the grayscale conversion circuit 142 is 79 grayscales, and a voltage that the data signal line driving circuit 3 applies to the sub-pixel SPIX (i, j) is 1.09[V]. While, in case where the modulation processing section 133 outputs the corrected video data D2 (i, j, k) of 0 grayscale so as to emphasize the grayscale transition to the greatest degree in the grayscale transition in "decay", the data signal line driving circuit 3 applies a voltage of 0.8[V] to the sub-pixel SPIX (i, j). In this manner, in emphasizing the grayscale transition, it is possible to apply a voltage lower than the black voltage in the case where the grayscale transition is not emphasized, so that it is possible to improve the response speed of the sub-pixel SPIX (i, j).

Likewise, in the present embodiment, in the case where the modulation processing section 133 outputs the video data D1 (i, j, k) of the current frame FR (k) without any modification, when the video data D (i, j, k) indicates a white level, the video data Db outputted from the modulation conversion circuit 142 is 1013 grayscales, and a voltage that the data signal line driving circuit 3 applies to the sub-pixel SPIX (i, j) is 6.5[V]. While, in case where the modulation processing section 133 outputs the corrected video data D2 (i, j, k) of the maximum grayscale so as to emphasize the grayscale transition to the greatest degree in the grayscale transition in "rise", the data signal line driving circuit 3 applies a voltage of 7.5[V] to the sub-pixel SPIX (i, j). In this manner, in emphasizing the grayscale transition, it is possible to apply a voltage higher than the white voltage in the case where the grayscale transition is not emphasized, so that it is possible to improve the response speed of the sub-pixel SPIX (i, j).

The following description gives an example of a case where the video data D varies from 0 grayscale to 255 grayscales in the transition from the previous frame FR (k−1) to the current frame FR (k). In this case, according to the arrangement of the comparative example, as shown in FIG. 21, the transition from 0 grayscale to 255 grayscales is the full gradation, so that it is impossible to emphasize the grayscale transition any more. Thus, the corrected video data D2 (i, j, k−1) and D2 (i, j, k) supplied to the data signal line driving circuit are respectively 0 grayscale and 255 grayscales, and a voltage applied to the sub-pixel SPIX (i, j) varies from 1.1[V] to 7.5[V].

Figure 22:
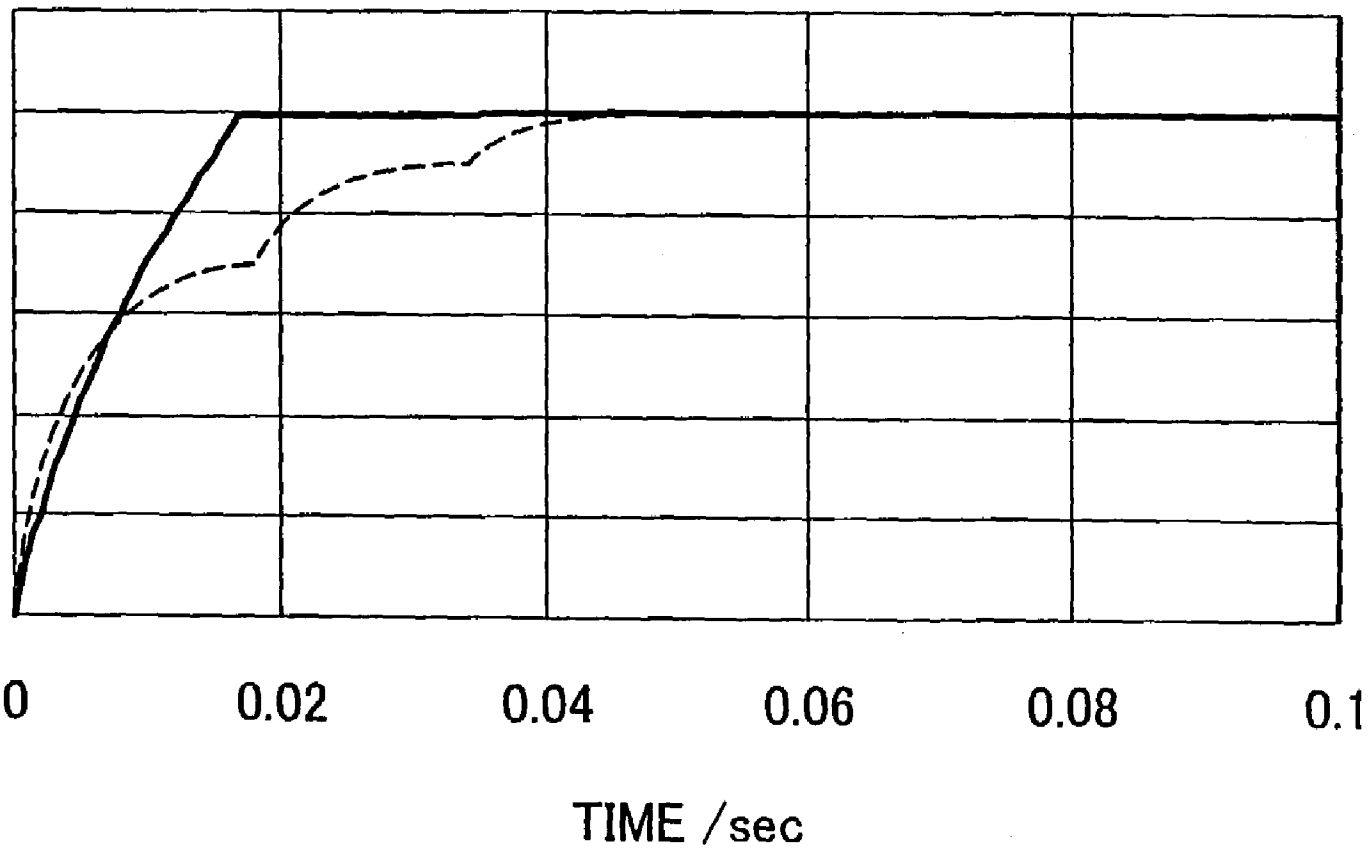
FIG. 22 is a graph indicative of a luminance response property of a pixel which is normalized in terms of a white luminance when video data inputted to the image display device varies from a black level to a white level.

Thus, as shown by a broken line of FIG. 22, due to a step response property, it takes approximately three frames (approximately 0.03 sec) to enable the luminance of the sub-pixel SPIX (i, j) to correspond to the luminance of the white level. Note that, the step response property is such phenomenon that: an electric capacitance of a liquid crystal layer so varies in accordance with response of the liquid crystal that displacement of a potential applied to the liquid crystal is reduced, so that the response seems to be slow. The phenomenon is genuinely an electric phenomenon, so that it is observed even at a high temperature.

On the other hand, in the present embodiment, as shown in FIG. 21, the video data Db (i, j, k−1) and Db (i, j, k) outputted from the grayscale conversion circuit 142 are respectively 79 grayscales and 1013 grayscales. Thus, for example, the modulation processing section 133 changes the corrected video data D2 (i, j, k) of the current frame FR (k) into a grayscale corresponding to 1023 grayscales, thereby emphasizing the grayscale transition without any trouble. Thus, as shown by a continuous line of FIG. 22, the luminance of the sub-pixel SPIX (i, j) reaches the white level within one frame (16.7 msec).

Incidentally, in case of the liquid crystal display device, when a wavelength varies, the transmittance varies even though the same voltage is applied to the pixel electrode of the liquid crystal cell. Thus, in order to unify the sub-pixels SPIX of R, G, and B in terms of the luminance, voltages that should be applied to the sub-pixels SPIX are different from each other. Here, when the data signal line driving circuit 3 of the pixel array 2*j* is arranged so that R, G, and B are set to be different from each other in terms of a relationship between the corrected video data D2 (i, j, *) and a voltage applied to each sub-pixel SPIX (i, j), a circuit arrangement of the data signal line driving circuit 3 is complicated.

However, in the present embodiment, the γ conversion circuit 141 and the grayscale conversion circuit 142 are set to perform conversion differently from each other. Thus, in the data signal line driving circuit 3 of the pixel array 2*j*, although the respective colors are set in the same manner in terms of the relationship between the corrected video data D2 (i, j, *) and the voltage applied to each sub-pixel SPIX (i, j), it is possible to appropriately set the luminance of the sub-pixels SPIX by causing the γ conversion circuit 141 and the grayscale conversion circuit 142 to appropriately convert the grayscales of each of R, G, and B.

In this manner, in the present embodiment, the γ conversion circuit 141 performs γ conversion with respect to the video data supplied to each sub-pixel inputted to the input terminal T1, so as to convert the video data into the video data Da (i, j, k) for displaying an image in a display device having a larger γ property. Further, the grayscale conversion circuit 142 compresses a possible value range of the video data Da (i, j, k), so as to generate the video data Db (i, j, k), having the same bit width as that of the video data Da (i, j, k), which can represent a value lower than the black level of the video data Da (i, j, k). As to the video data Db (i, j, k), a noise is added. Thereafter, its less significant bit is truncated, thereby obtaining the video data D1 (i, j, k).

Further, the modulation processing section 133 corrects the video data D (i, j, k) so as to emphasize the grayscale transition from the previous grayscale data to the current grayscale data. Thus, even in case where the grayscale transition to a smallest grayscale is required, it is possible to realize a driving device of an image display device which can improve the response speed of the pixel.

Embodiment 12

Figure 23:
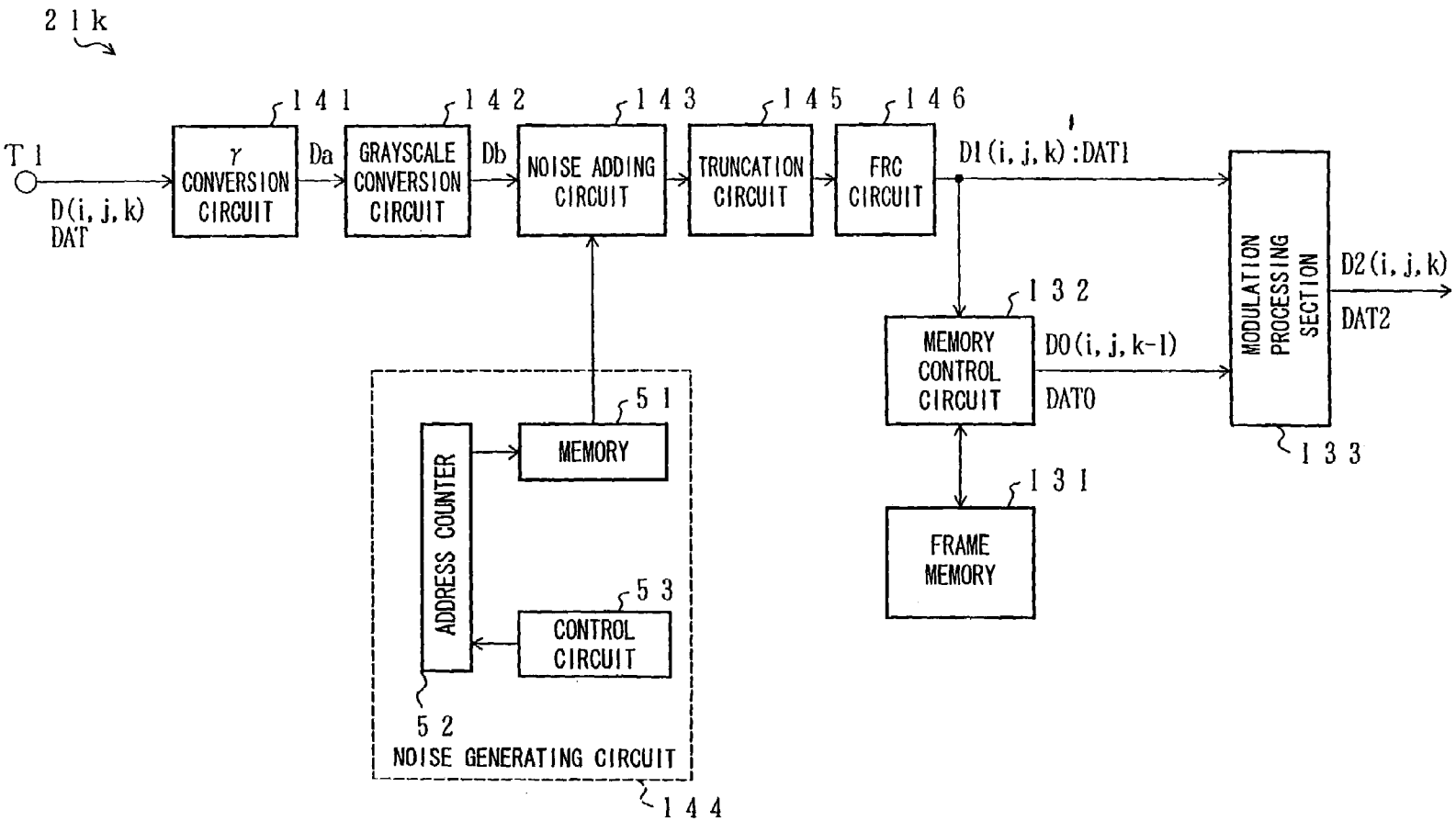
FIG. 23 shows another embodiment of the present invention, and is a block diagram showing an important portion of a modulated-drive processing section.

As shown in FIG. 23, in addition to the arrangement of Embodiment 11, a modulated-drive processing section 21*k* according to the present embodiment includes an FRC circuit 146, provided between (i) the truncation circuit 145 and (ii) the frame memory 131 and modulation processing circuit 133, which is similar to the FRC circuit 38 of Embodiment 2.

As in Embodiment 2, according to the video data D (i, j, k), the FRC circuit 146 varies a least significant bit of the video data, outputted by the truncation circuit 145, on the basis of a predetermined pattern, and then outputs thus varied least significant bit as the video data D1 (i, j, k). The pattern is set so that a value of a bit truncated by the truncation circuit 145 corresponds to an average value of values constituting the pattern.

In this arrangement, as in Embodiment 2, due to the FRC circuit 146, the least significant bit of the video data D1 (i, j, k) varies on the basis of such a pattern that a value of a bit truncated by the truncation circuit 145 corresponds to an average value of values constituting the pattern. Thus, it is possible to make an average value of the luminance of the sub-pixel SPIX (i, j) correspond to the luminance indicated by video data before being truncated by the truncation circuit 145.

Note that, in case where the response speed of the sub-pixel SPIX (i, j) is so low that the sub-pixel SPIX (i, j) cannot vary the luminance in accordance with the variation of the corrected video data D2 (i, j, k), an average value of the luminance of the sub-pixel SPIX (i, j) is not the desired value. However, in the modulated-drive processing section 21*k* according to the present embodiment, a bit varied by the FRC circuit 146 is a least significant bit of the video data D1 (i, j, k), and the modulation processing section 133 emphasizes the grayscale transition from the previous frame FR (k−1) to the current frame FR (k). Thus, the modulated-drive processing section 21*k* can set the average value of the luminance of the sub-pixel SPIX (i, j) to be the foregoing desired value without any trouble.

Here, in case of the pixel array 2*j* in which an area occupied by each sub-pixel SPIX (i, j) is extremely small and spatial resolution and luminance resolution are set to be close to or over a limit of human visual sense, that is, in case of the pixel array 2*j* on the assumption that it is viewed at such distance that it is impossible to recognize each pixel, even when the noise adding circuit 143 adds a fixed noise in a time-series manner so that its bit width is narrower than that of the video data D (i, j, k) by approximately 3 bits, there is no possibility that the noise pattern is recognized by the user of the image display device. Examples of such image display device include an XGA (eXtended Graphic Array) display of 15 inches and the like. In this case, a gap (fineness) between the sub-pixels SPIX (i, j) is set to be approximately 300 μm.

However, in such arrangement that the fixed noise is added in a time-series manner when the spatial resolution and the luminance resolution of the pixel array 2*j* do not exceed the aforementioned limit, there is a possibility that the noise pattern may be recognized by the user of the image display device 1*k* when an image displayed in the pixel array 2*j* is under a specific condition (for example, specific brightness or specific movement). Examples of such image display device include the VGA display of 15 inches and the like.

On the other hand, in the modulated-drive processing section 21*k* according to the present embodiment, the FRC circuit 146 changes the least significant bit of the video data D1 (i, j, k). Thus, even in case of applying the modulated-drive processing section 21*k* to such image display device, it is possible to prevent the noise pattern from being recognized by the user. As such, it is possible to improve the apparent display quality of the image display device 1*k* compared with the case where the fixed noise is added in a time-series manner.

Embodiment 13

Incidentally, Embodiments 11 and 12 explain the case where: the noise added to the video data D (i, j, *) by the noise adding circuit 143 is fixed in a time-series manner, and the noise of the same value is always added to the video data D (i, j, *) supplied to the sub-pixel SPIX (i, j). On the other hand, the present embodiment will explain a case where the noise added to the video data D (i, j, *) by the noise adding circuit 143 is varied in a time-series manner. Note that, this arrangement can be applied to both the Embodiments 11 and 12. Hereinafter, the case where the arrangement is applied to Embodiment 11 is described with reference to FIG. 15.

That is, in a modulated-drive processing section 21*m* according to the present embodiment, instead of the noise generating circuit 144, there is provided a noise generating circuit 144*m* arranged substantially in the same manner as the noise generating circuit 35*b* according to Embodiment 3, and the noise adding circuit 144*m* generates a noise which varies in a time-series manner.

In the modulated-drive processing section 21*m* according to the present embodiment, the noise that the noise adding circuit 143 adds to the video data D (i, j, *) is varied in a time-series manner. Thus, as in Embodiment 3, even in case where the modulated-drive processing section 21*m* is applied to an image display device (for example, a VGA display of 20 inches, an XGA display of 40 inches, and the like) in which: a spatial resolution and a luminance resolution of the pixel array 2*j* are far below the limit of human visual sense, and each sub-pixel SPIX (i, j) is recognized by the user of the image display device, it is possible to prevent the noise pattern from being recognized by the user, so that it is possible to improve the apparent display quality of the image display device 1*m* compared with the case where the fixed noise is added in a time-series manner.

Incidentally, in order to display a stable still image free from any flicker and noise, the modulated-drive processing section 133 according to the respective embodiments does not emphasize the grayscale transition and outputs the video data D1 (i, j, k) of the current frame FR (k) without any modification when a difference between the video data D0*a* (i, j, k−1) of the previous frame FR (k−1) and the video data D1 (i, j, k) of the current frame FR (k) is smaller than a predetermined threshold value.

In this case, the threshold value is set so as to correspond to a variation width at which the noise varies in a time-series manner. In more detail, the threshold value is as large as or larger than the variation width at which the noise varies in a time-series manner, and is set to be such a small value that insufficient grayscale transition due to the insufficient response speed of the sub-pixel SPIX (i, j) is not recognized even when the grayscale transition is not emphasized. For example, in case of the foregoing values, that is, in case where the video data Db (i, j, k) is 10 bits, and the volume of the noise is ±7 bits, and the truncation circuit 145 truncates 2 bits, the threshold value is set to be 32 grayscales ($=2^{(7-2)}$).

In this manner, the threshold value is set to be a value which is as large as or larger than the variation width at which the noise varies in a time-series manner. Thus, in the case where a still image is displayed, even when the noise causes the video data D1 (i, j, k) to so vary that the grayscale transition occurs, the modulation processing section 133 does not emphasize the grayscale transition and outputs the video data D1 (i, j, k) of the current frame FR (k) without any modification. In this manner, as in Embodiment 3, in the case of the grayscale transition which can be brought about merely by adding the noise data, the modulation processing section 133 according to Embodiment 13 does not emphasize the grayscale transition, and the modulation processing section 133 obtained by adding the FRC circuit 146 to the arrangement of Embodiment 13 does not emphasize the grayscale transition in case of the grayscale transition which can be brought about merely by adding the noise data and causing the FRC circuit 146 to change the least significant bit. Thus, the grayscale transition caused by the noise is not emphasized, so that it is possible to prevent the following disadvantage: due to the grayscale transition caused by the noise, the noise pattern is recognized by the user.

Further, in the case where the noise added to the video data D (i, j, *) by the noise adding circuit 143 is varied in a time-series manner like the present embodiment, that is, in the case where it is assumed that an image is viewed at a distance shorter than that of Embodiment 11 (at such a distance that each sub-pixel SPIX (i, j) is recognized by the user of the image display device), it is more desirable to set a maximum value of an absolute value of the noise data generated by the noise generating circuit 144 to be not more than 32 grayscales.

Embodiment 14

Figure 24:
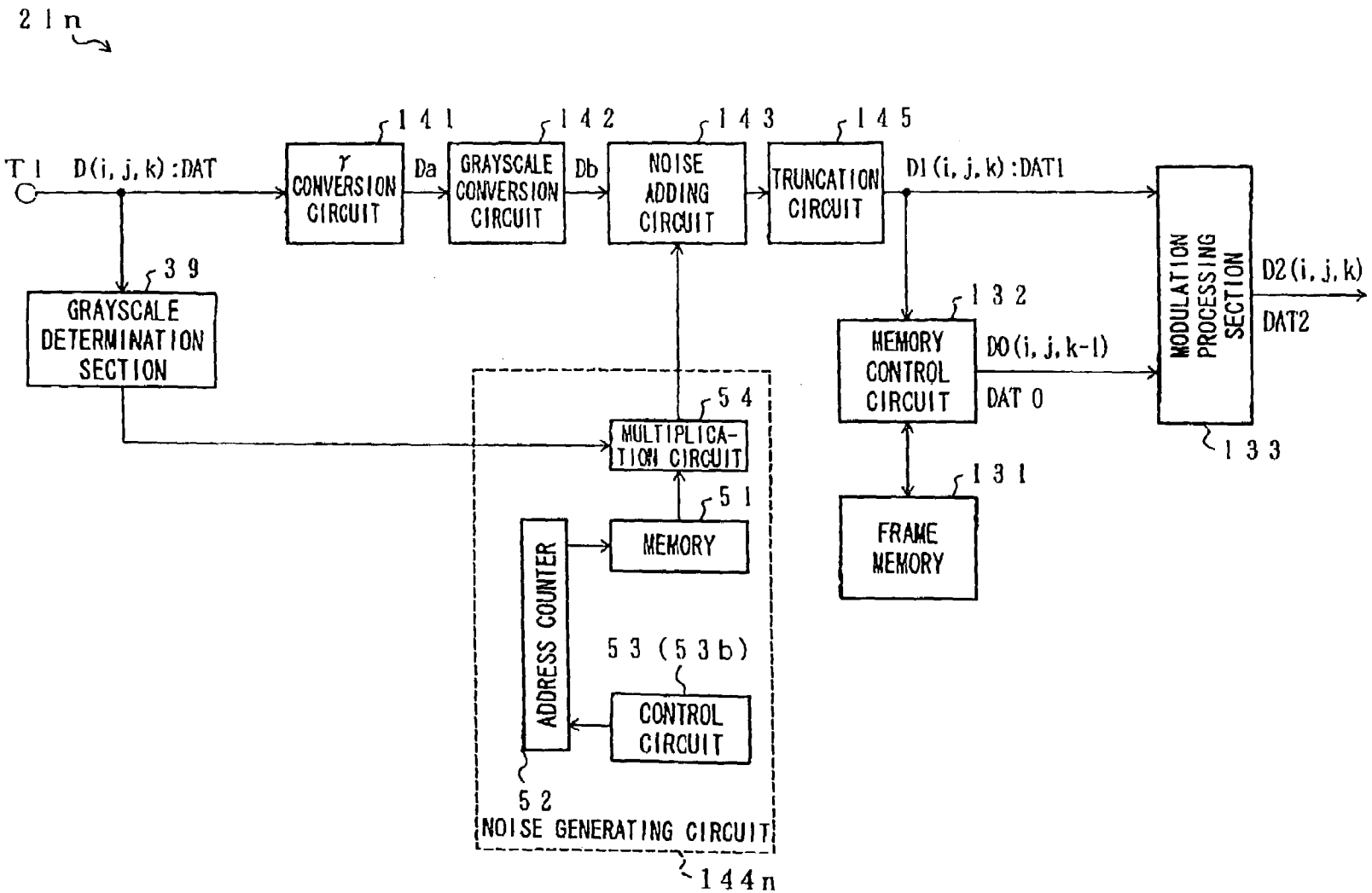
FIG. 24 shows still another embodiment of the present invention, and is a block diagram showing an important portion of a modulated-drive processing section.

The foregoing description explains the example where the maximum value of the noise data generated by the noise generating circuit is constant. However, the present embodiment will explain an arrangement in which the maximum value of the noise data is varied in accordance with a grayscale indicated by the video data D (i, j, k) inputted to the input terminal T1. Note that, this arrangement can be applied to each of Embodiments 11 to 13. Hereinafter, a case where the foregoing arrangement is applied to Embodiment 11 will be described with reference to FIG. 24.

Figure 11:
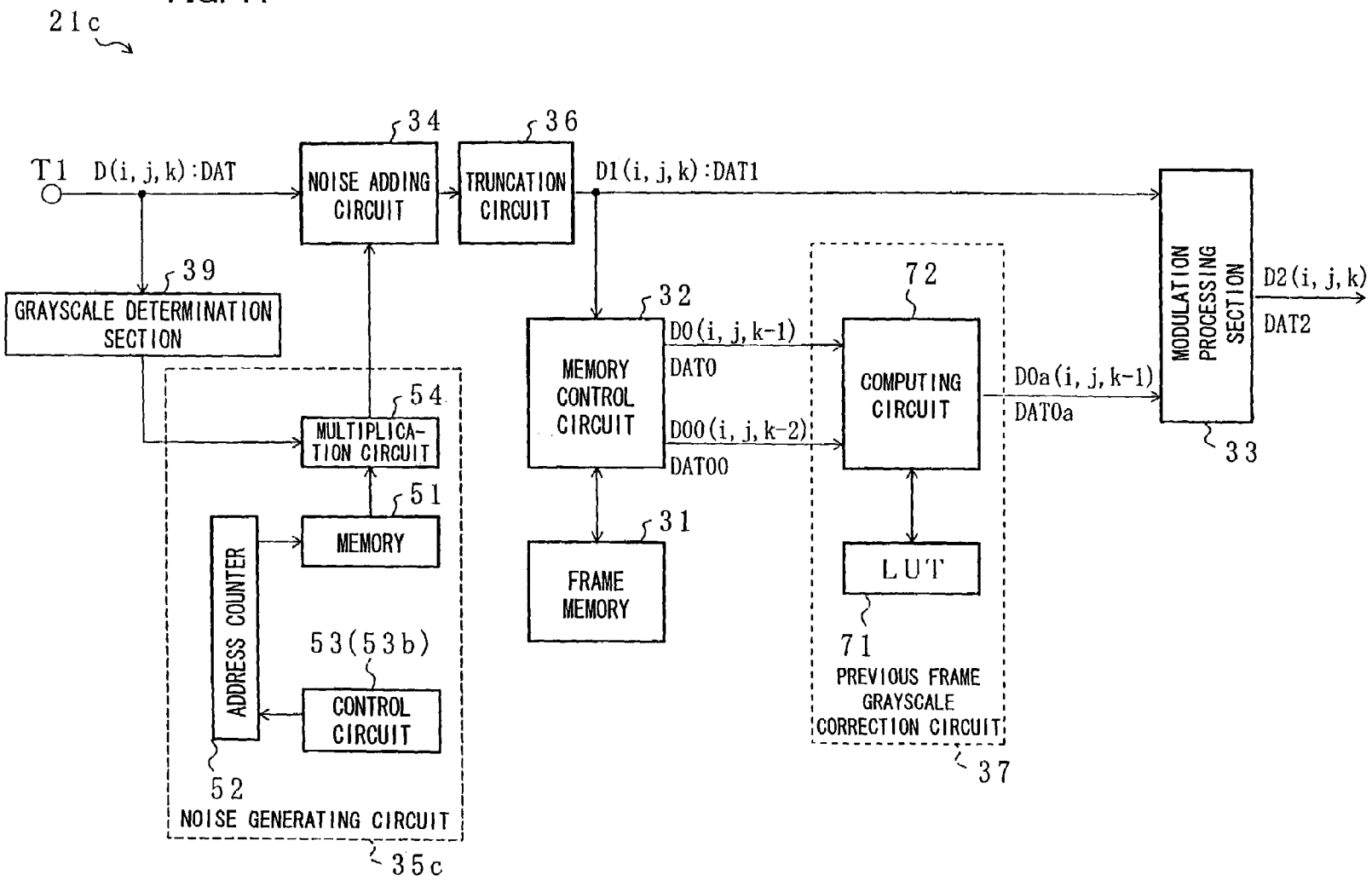
FIG. 11 shows another embodiment of the present invention, and is a block diagram showing an important portion of a modulated-drive processing section.

That is, in a modulated-drive processing section 21*n* according to the present embodiment, instead of the noise generating circuit 144 shown in FIG. 11, there is provided a noise generating circuit 144*n* similar to the noise generating circuit 35*c* according to Embodiment 3, and the noise generating circuit 144*m* can change the volume of the outputted noise data. Further, as in Embodiment 4, there is provided a grayscale determination section 39 for detecting a display grayscale level of the video data D (i, j, k) and instructing the noise generating circuit 144*n* to output a noise whose volume corresponds to a detection result.

In this arrangement, as in Embodiment 4, in case where an average value of the video data D in a block is high, that is, in case where the relative volume of the noise is so small that the noise pattern is hardly recognized by the user even when the volume of the noise is made larger than in a case where the average value is small, the maximum value of the noise is set to be large. While, in case where the average value of the video data D is small, that is, in case where the relative volume of the noise is so large that the noise pattern may be recognized by the user unless the volume of the noise is made smaller than in the case where the average value is large, the maximum value of the noise is set to be small. As a result, as in Embodiment 4, no matter what the average value of the luminance of the block may be, it is possible to set the maximum value of the noise to be a value suitable for the average value, so that it is possible to realize the image display device in whose display quality is higher than that in the case where the maximum value of the noise is fixed.

Figure 25:
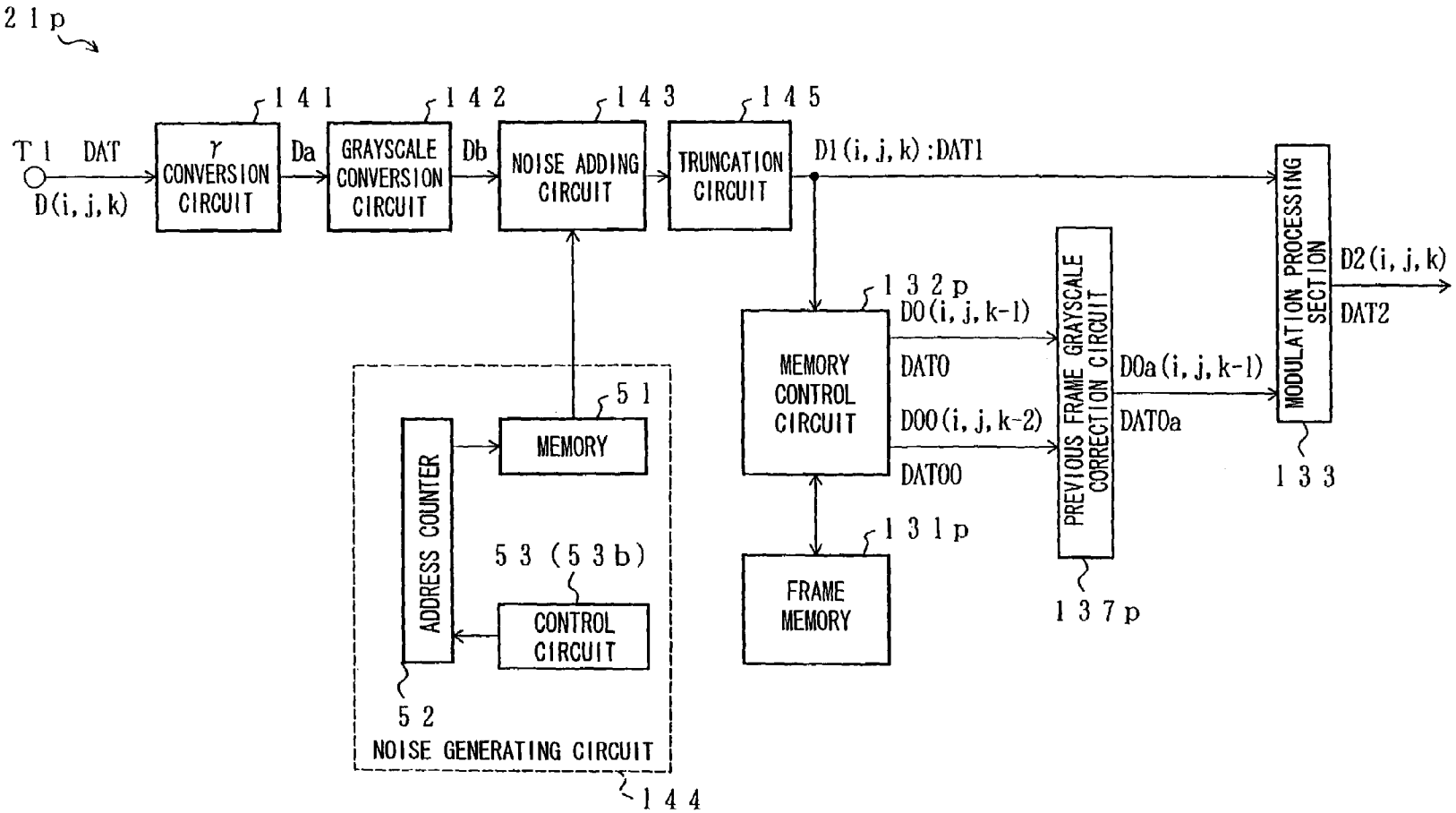
FIG. 25 shows further still another embodiment of the present invention, and is a block diagram showing an important portion of a modulated-drive processing section.
Figure 26:
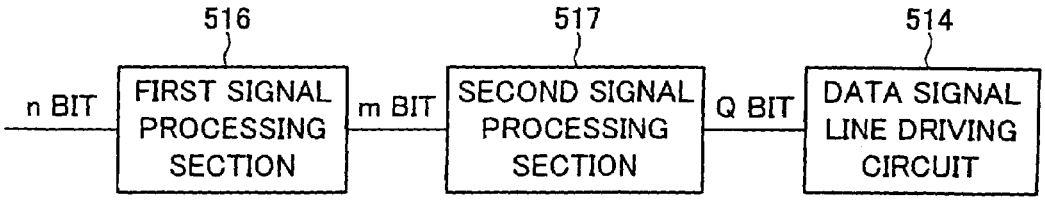
FIG. 26 shows a background art, and is a block diagram showing an important portion of an image display device.

Note that, unlike Embodiments 1 to 10, Embodiments 11 to 14 explain the arrangement in which: the video data D0 (i, j, k−1) of the previous frame FR (k−1) that the modulation processing section 133 stores in the frame memory 133 is referred to, and the video data of the current frame FR (k) is corrected so as to emphasize the grayscale transition from the current frame to the previous frame, and the corrected video data D2 (i, j, k) is outputted as the corrected video signal DAT 2. However, also in the arrangement having the γ conversion circuit 141 and the grayscale conversion circuit 142 like Embodiments 11 to 14, as shown in FIG. 25, it may be so arranged that: as in Embodiments 1 to 10, the previous frame grayscale correction circuit (37 to 37*i*) is provided, and the modulation processing section 133 generates the corrected video signal DAT2 by referring to (i) the corrected previous frame video signal DAT0*a* outputted from the previous frame grayscale correction circuit and (ii) the current frame video signal DAT. Note that, FIG. 25 shows an arrangement obtained by combining Embodiment 11 with Embodiment 1 as an example.

In addition to the arrangement shown in FIG. 15, a modulated-drive processing section 21*p* shown in FIG. 25 includes a previous frame grayscale correction circuit 137*p* similar to the previous frame grayscale correction circuit 37. Further, in the modulated-drive processing section 21*p*, instead of the frame memory 131 and the control circuit 132, there are provided a frame memory 131*p* and a control circuit 132*p* that are respectively similar to the frame memory 31 and the control circuit 32. As in the control circuit 32, the control circuit 132*p* reads out the video data D00 (i, j, k−2) of the further previous frame from the frame memory 131*p*, and outputs the video data D00 (i, j, k−2) as the further previous frame video signal DAT 00.

In this arrangement, as in Embodiment 11, the grayscale correction is performed by the γ conversion circuit 141 and the grayscale conversion circuit 142, thereby improving the response speed of the pixel. Further, as in Embodiment 1, the modulation processing section 133 emphasizes the grayscale transition in accordance with the previous frame video signal DAT0 corrected by the previous frame grayscale correction circuit 137*p*, so that it is possible to prevent occurrence of the excessive or poor brightness, thereby improving the display quality of the image display device 1.

Note that, the foregoing embodiments explain the example where the liquid crystal cell in a vertical alignment mode and a normally black mode is used as the display element, but the arrangement is not limited to this. It is possible to obtain the same effect as long as the display element has such a property that: since the response speed is low, actual grayscale transition is different from desired grayscale transition in the grayscale transition from the further previous time to the previous time even when it is driven while performing modulation so as to emphasize the grayscale transition.

However, as to the liquid crystal cell in a vertical alignment mode and a normally black mode, the response speed with respect to the grayscale transition is lower in "decay" than in "rise". Thus, even when it is driven while performing modulation so that the grayscale transition is emphasized, the actual grayscale transition tends to differ from the desired grayscale transition in the grayscale transition from the further previous time to the previous time, so that the excessive brightness tends to occur. Thus, it is particularly preferable to prevent the occurrence of the excessive brightness via the arrangement of the foregoing embodiment.

Further, the foregoing embodiments describe the example where members constituting the modulated-drive processing section is realized by a hardware, but the arrangement is not limited to this. It may be so arranged that: all of or part of the members is realized by combining a program for realizing the foregoing functions with a hardware (computer) for carrying out the program. For example, a computer connected to the image display device 1 may realize the modulated-drive processing section (21 to 21*p*) as a device driver used in driving the image display device 1. Further, it may be so arranged that: the modulated-drive processing section is realized as a conversion substrate which is internally or externally provided on the image display device 1, and a storage medium storing the software is distributed or the software is transferred via a communication line so that the software is distributed so as to cause the hardware to carry out the software in case where it is possible to change an operation of a circuit for realizing the modulated-drive processing section by rewriting the program such as a firmware, thereby operating the hardware as the modulated-drive processing section of the foregoing embodiments.

In this case, as long as a hardware which can carry out the foregoing functions is prepared, it is possible to realize the modulated-drive processing section according to the foregoing embodiments merely by causing the hardware to carry out the program.

In more detail, in case of realizing the modulated-drive processing section by using the software, a computing device, constituted of CPU or a hardware which can carry out the functions carries out the program stored in a storage device such as ROM and RAM, and controls peripheral circuits such as input and output circuits (not shown), thereby realizing the modulated-drive processing sections 21 to 21*p* according to the foregoing embodiments.

In this case, it is also possible to realize the modulated-drive processing section by combining a hardware for performing part of the process with the computing device for carrying out a program code which controls the hardware and processes a remaining process. Further, in the foregoing members, also a member described as the hardware can be realized by combining the hardware for performing part of the process with the computing device for carrying out a program code which controls the hardware and processes a remaining process. Note that, a single computing device may carry out the program code, or a plurality of computing devices connected to each other via a bus internally provided on the device or via various communication paths may carry out the program code together.

The program code itself which can be directly carried out by the computing device, or a program functioning as data which can generate a program code by uncompressing and the like is carried out as follows: the program (the program code or the data) is stored in the storage medium, and the storage medium is distributed, or the program is transferred by a transferring device for transferring the program via a wired or wireless communication path so as to be distributed, so that the program is carried out the computing device.

Note that, in case of transferring the program via the communication path, each of transferring media constituting the communication path transfers a signal sequence indicative of the program so that the program is transferred via the communication path. Further, it may be so arranged that: in transferring the signal sequence, a sending device modulates a carrier wave in accordance with the signal sequence indicative of the program so as to superpose the signal sequence on the carrier wave. In this case, a receiving device demodulates the carrier wave so as to restore the signal sequence.

While, it may be so arranged that: in transferring the signal sequence, the sending device divides the signal sequence into packets as a digital data sequence. In this case, the receiving device connects groups of the received packets, thereby restoring the signal sequence. Further, it may be so arranged that: in transferring the signal sequence, the sending device combines a signal sequence with another signal sequence by methods such as time division, frequency division, and code division, so as to transfer the signal sequence. In this case, the receiving device extracts each signal sequence from the combined signal sequences, so as to restore the signal sequences. In each case, it is possible to obtain the same effect as long as it is possible to transfer the program via the communication path.

Here, it is preferable that the storage medium used in distributing the program is detachable (removable). However, it does not matter whether the storage medium after distributing the program is detachable or not. Further, as long as the storage medium stores the program, it does not matter whether the storage medium is rewritable (writable) or not, volatile or not.

Any storage method and any shape may be adopted as long as the storage medium stores the program. Examples of the storage medium include: tapes, such as magnetic tape and cassette tape; disks including magnetic disks, such as floppy disks (registered trademark) and hard disk, and optical disks, such as CD-ROMs, MOs, MDs, and DVDs; cards, such as IC card and optical cards; and semiconductor memories, such as mask ROMs, EPROMs, EEPROMs, and flash ROMs. Alternatively, the storage medium may be a memory provided in the computing device such as CPU.

Note that, the program code may be a code for giving instruction for all procedures of the processes to the computing device. As long as there is a basic program (for example, an operating system or a library) which can be entirely or partially carried out by reading the program in a predetermined manner, all the procedures may be entirely or partially replaced with a code or a pointer which instructs the computing device to read the basic program.

Further, examples of a format according to which the program is stored in the storage medium include: a format in which the computing device accesses the program so that the program can be carried out like a condition under which the program is placed on a real memory for example; a format before placing the program on a real memory and after installing the program into a local storage medium (for example, a real memory or a hard disk) which can be always accessed by the computing means; a format before installing the program from a network or a transportable storage medium into the local storage medium. Further, the program is not limited to a compiled object code, but may be stored as a source code or an intermediate code generated during interpretation or compilation.

In each case, as long as the computing method enables the program to be converted into an executable format by performing the processes such as uncompressing of compressed information, restoration (decode) of encoded information, interpretation, compilation, linkage, or by performing the process such as placement on the real memory, or by combining these processes, it is possible to obtain the same effect regardless of a format in storing the program in the storage medium.

As described above, a driving device (21 to 21*i*) of an image display device (1) according to an embodiment of the present invention includes: an input terminal (T1) for receiving first tone data indicative of a current tone of each of pixels (sub-pixels SPIX (1, 1) . . . ); noise adding means (34, 36 for example) for adding noise data to each of the first tone data inputted to the input terminal, and rounding a less significant bit whose bit width is predetermined, so as to generate second tone data; noise generating means (35 to 35*c* for example) for generating the noise data so that the noise data added to the first tone data supplied to the pixels of the same color which are adjacent to each other have random volumes; storage means (frame memory 31 for example) for storing current second tone data of the pixel until next second tone data is inputted; and first correction means (modulation processing section 33 for example) for correcting the current second tone data, in accordance with previous second tone data read out from the storage means, so as to facilitate tone transition from the previous second tone data to the current second tone data.

Note that, the rounding process performed by the noise adding means may be a rounding-up process or a rounding-down (truncating) process. Further, the rounding process may be a process for selecting either the rounding up or the rounding down in accordance with whether or not the less significant bit exceeds a predetermined threshold value. For example, this can occur in such a manner that 4 or less is rounded down and 5 or more is rounded up in a decimal system (0 is rounded down and 1 is rounded up in a binary system).

However, when the rounding-down process is selected from the foregoing rounding processes, it is not necessary to change significant digits. Thus, when it is required to simplify the process, it is preferable that the noise adding means generates the second tone data by performing the rounding-down process.

In the foregoing arrangement, when the first tone data indicative of the current tone of each pixel is inputted, the noise adding means adds the noise data to the first tone data inputted to the input terminal, and rounds the less significant bit, so as to generate the second tone data. The current second tone data of each pixel that has been generated by the noise adding means is stored in the storage means until the next time, and the first correction means corrects the current second tone data, in accordance with the previous second tone data read out from the storage means and the current second tone data inputted from the noise adding means, so as to emphasize the tone transition from the previous time to the current time.

In the arrangement, a bit width of the second tone data stored in the storage means is set to be shorter than that of the first tone data by rounding the less significant bit. Thus, it is possible to reduce the storage capacity required in the storage means. Further, a bit width of the tone data processed by circuits (the storage means, the first correction means, and the like) positioned after the noise adding means is reduced, so that it is possible to reduce a circuit size of these circuits and the computing amount thereof, and it is possible to reduce the number of wirings for connecting these circuits and an area occupied by the wirings.

Further, the noise generating means generates the noise data so that the noise data added to the first tone data to the pixels of the same color which are adjacent to each other have random volumes. Thus, unlike an arrangement in which a pseudo outline occurs in an image displayed in the pixels when the less significant bit of the first tone data is truncated so as to generate the second tone data, the foregoing arrangement brings about no pseudo outline. As a result, although the bit width of the second tone data is shorter than that of the first tone data, it is possible to keep the display quality of an image displayed in the pixels under such condition that the display quality does not apparently different from that in the case of displaying an image based on the first tone data.

Further, the first correction means emphasizes the tone transition from the previous time to the current time, so that it is possible to improve the response speed of the pixels. Here, in case where the first correction means is provided at the following stage of the noise adding means, a noise is added to the data after emphasizing the tone transition. Thus, the tone transition may be excessively emphasized, so that the luminance of the pixels is undesirably increased. As a result, there is a possibility that this excessive emphasis may be regarded as the excessive brightness by the user of the image display device.

Alternatively, the tone transition may be insufficiently emphasized, so that the luminance of the pixel is undesirably reduced. As a result, there is a possibility that the insufficient emphasis may be regarded as the poor brightness. However, according to the foregoing arrangement, the first correction means is provided at the following stage of the noise adding means, so that it is possible to improve the response speed of the pixels without bringing about the excessive or poor brightness caused by the addition of the noise, unlike the case where the first correction means is provided at the previous stage of the noise adding means.

As a result, it is possible to realize the driving device of the image display device which can improve the response speed of the pixels and can reduce the circuit size and the computing amount thereof without apparently deteriorating the display quality of an image displayed in the pixels.

In addition to the foregoing arrangement, it may be so arranged that: the noise generating means generates the noise data so that each volume of the noise data added to the first tone data supplied to the same pixel is constant every time the noise data is added.

According to the foregoing arrangement, the volume of the first tone data to the same pixel is fixed in a time-series manner. Thus, when a still image is displayed, data outputted from the first correction means to the pixels has the same value every time though the noise data is added to the first tone data to the pixels. As a result, the image display device can display a still image free from flicker and noise caused by the addition of the noise data.

In addition to the foregoing arrangement, it may be so arranged that: the first tone data is represented by 8 bits, and a maximum value of an absolute value of the noise data is set to be in a range from 1 tone to 32 tones, and the noise adding means, the noise generating means, the storage means, and the first correction means are provided for each color of R, G, and B.

In the foregoing arrangement, when the image display device driven by the driving device is viewed at such a distance that it is impossible to recognize each pixel, it is possible to suppress a difference between a luminance of a certain pixel and a luminance of a pixel adjacent to that pixel within 5% with respect to a luminance of each pixel by adding the noise data. Further, it is possible to suppress also a difference between a luminance of a pixel indicated by the first tone data and a luminance of a pixel controlled by the correction means within 5% with respect to each luminance. Thus, it is possible to realize the image display device which can display a color image and has particularly high display quality.

Further, instead of the arrangement in which the volume of the first grayscale data to the same pixel is fixed in a time-series manner, it may be so arranged that: the noise generating means generates the noise data so that the noise data added to the first tone data supplied to the same pixel have random sizes.

In the arrangement, the noise data added to the first tone data to the same pixel varies in a time-series manner. Thus, even in case where the image display device is viewed at such a distance that each pixel is sufficiently recognized and the noise is fixed in a time-series manner which causes the noise to be recognized as the noise pattern, it is possible to prevent the noise pattern from being recognized by the user by varying the noise data in a time-series manner. As a result, it is possible to realize the driving device which is preferably used in driving the image display device.

In addition to the foregoing arrangement, it may be so arranged that: the first correction means stops correcting the current second tone data when a difference between the previous second tone data and the current second tone data corresponds to a possible difference caused merely by addition of the noise data.

In the arrangement, the first correction means stops correcting the current second tone data when a difference between the previous second tone data and the current second tone data corresponds to a possible difference caused merely by addition of the noise data. Thus, it is possible to prevent such disadvantage that: the first correction means emphasizes the tone transition caused by the noise data is emphasized, so that the noise pattern is recognized.

In addition to the foregoing arrangement, it may be so arranged that: the first tone data is represented by 8 bits, and a maximum value of an absolute value of the noise data is set to be in a range from 1 tone to 8 tones, and the noise adding means, the noise generating means, the storage means, and the first correction means are provided for each color of R, G, and B.

In the arrangement, the maximum value of the absolute value of the noise data is set to be in the foregoing range. Thus, when the image display device driven by the driving device is viewed at such a distance that each pixel can be recognized, it is possible to suppress a difference between a luminance of a certain pixel and a luminance of a pixel adjacent to that pixel within 5% with respect to each luminance by adding the noise data, and it is possible to suppress a difference between a luminance of a pixel indicated by the first tone data and a luminance of a pixel controlled by an output of the correction means within 5% with respect to each pixel by adding the noise data. Thus, it is possible to realize the image display device which can display a color image and has particularly high display quality.

In addition to the foregoing arrangement, regardless of whether the noise data varies in a time-series manner or not, it may be so arranged that: there is provided least significant bit control means (frame rate control circuit 38 for example) for varying a least significant bit of the second tone data in accordance with a predetermined pattern so that a tone obtained by averaging the second tone data to the same pixel corresponds to a tone whose least significant bit has not been rounded by the noise adding means.

In the arrangement, even in case of displaying a still image, the second tone data varies in a time-series manner. Thus, even in case where the image display device is viewed at such a distance that each pixel sometimes can be recognized and sometimes cannot be recognized depending on brightness and movement of a displayed image, and the noise pattern may be recognized depending on the displayed image when the second tone data is fixed in a time-series manner in displaying a still image, it is possible to prevent the noise pattern from being recognized by the user. Further, variation of the second tone data is limited to the least significant bit, and is limited so that a tone obtained by averaging the second tone data to the same pixel corresponds to a tone whose less significant bit has not been rounded by the noise adding means. Thus, although the second tone data varies in a time-series manner, it is possible to prevent apparent deterioration of the display quality of an image displayed in the pixels. As a result, it is possible to realize the driving device which is preferable in driving the image display device.

In addition to the foregoing arrangement, it may be so arranged that: the first correction means stops correcting the current second tone data when a difference between the previous second tone data and the current second tone data corresponds to a possible difference caused merely by addition of the noise data and variation of the least significant bit that is performed by the least significant bit control means.

In the arrangement, the first correction means stops correcting the current second tone data when a difference between the previous second tone data and the current second tone data corresponds to a possible difference caused merely by addition of the noise data and variation of the least significant bit that is performed by the least significant bit control means. Thus, it is possible to prevent such disadvantage that: the first correction means emphasizes the tone transition caused by the noise adding means and the least significant bit control means, so that the noise pattern tends to be recognized.

In addition to the foregoing arrangement, it may be so arranged that: the pixels are divided into a plurality of areas, and said driving device includes noise amount control means for averaging the first tone data supplied to the pixels in each of the areas, and controlling the noise generating means so that a maximum value of an absolute value of the noise data is smaller in case where an average value of the first tone data is small than in case where the average value of the first tone data is high.

Here, when the noise data added to the first tone data is too large, the noise pattern tends to be recognized by the user of the image display device, and when the noise data is too small, the pseudo outline occurs, so that the display quality of an image displayed in the pixels is deteriorated. Further, whether the noise pattern tends to be recognized or not depends on the brightness of the image. In case where the maximum value of the absolute value of the noise data is constant, when the transition is small, that is, when a lower luminance is indicated, a relative volume of the noise data is larger than that in the case where the tone is large, so that the noise pattern tends to be recognized. As a result, when the maximum value is fixed, it is necessary to set the maximum value so as not to bring about any trouble in case where the image is bright and in case where the image is dark, so that it is impossible to set the maximum value to be the most suitable for both the case.

On the other hand, according to the foregoing arrangement, the maximum value of the absolute value of the noise data generated by the noise generating means is changed in accordance with an average value of the first tone data. Thus, it is possible to set the maximum value to be a value more suitable for an image being displayed unlike the case where the maximum value is fixed, so that it is possible to realize the image display device having high display quality.

Further, in the foregoing arrangement, the first tone data to the pixels included in each area are averaged so that the maximum value is set in accordance with the average value. Thus, it is possible to prevent such disadvantage that: although a tone for a certain pixel is greatly different from tones of peripheral pixels, the maximum value is set in accordance with the tone for the pixel, so that the noise pattern tends to be recognized.

In addition to the foregoing arrangement, it may be so arranged that: a video signal constituted of the first tone data inputted to the input terminal is obtained by dividing an image into a plurality of small blocks and encoding each of the small blocks, and the areas correspond to the small blocks.

In the arrangement, the area corresponds to a unit in encoding the video signal (the area corresponds to a size regarded as a unit of an image, or such a size that a noise tends to be regarded because it is a unit in encoding the video signal). Thus, even in case of performing scale conversion with respect to the video signal so as to display an image based on the video signal having been subjected to the scale conversion (for example, in case of enlarging an original signal so as to display an image, based on thus enlarged original signal, in a high-definition liquid crystal display device), it is possible to prevent the foregoing disadvantage.

In addition to the foregoing arrangement, it may be so arranged that: the storage means stores not only the current second tone data but also the previous second tone data until the next time, and said driving device includes second correction means (previous frame grayscale correction circuit 37 to 37*i* for example) for correcting the previous second tone data referred to by the first correction means so that the previous second tone data approaches further previous second tone data when a combination of the further previous second tone data and the previous second tone data that are stored by the storage means is a predetermined combination.

In the arrangement, when a combination of the further previous second tone data and the previous tone data is a predetermined combination, the previous grayscale data referred to by the first correction means is corrected so as to approach the further previous tone data. Thus, when the tone transition from the further previous time to the previous time is predetermined tone transition, it is possible to suppress an amount of correction performed by the first correction means compared with the case where the second correction means does not perform any correction.

As a result, for example, when the tone transition from the further previous time to the previous time is corrected by the first correction means in the same manner as in ordinary correction like the case of "decay→rise" or "rise→decay", it is possible to suppress occurrence of the following phenomenon: a synergy effect of (i) insufficient response of the pixels in the tone transition from the further previous time to the previous time and (ii) emphasis of the tone transition that is performed by the first correction means causes the current tone of the pixel to greatly differ from the tone indicated by the current second tone data, so that the excessive or poor brightness occurs.

As a result, it is possible to improve the display quality of the image display device. Further, the storage means stores the previous second tone data that has not been corrected by the first correction means, so that an error caused by the correction performed by the first correction is not superposed or accumulated unlike the arrangement in which the second tone data that has been corrected is stored. Thus, even when the first and second correction means are realized by using circuits having relatively small circuit sizes and low accuracy in computing for the correction, this arrangement does not cause divergent or oscillating pixel tone level control. As a result, it is possible to realize the image display device having high display quality by using circuits whose circuit sizes are relatively small.

Further, the bit width of the previous second tone data stored in the storage means until the next time may be the same as the bit width of the current second tone data. However, in case where reduction of the circuit size is particularly required, in addition to the foregoing arrangement, it may be so arranged that: there is provided bit width adjusting means (control circuit 32*g*•32*i* for example) for limiting a total of a bit width of the current second tone data and a bit width of the previous tone data so that the total corresponds to a preset value, by rounding a least significant bit of at least one of the current second tone data and the previous second tone data, before the storage means stores the current second tone data and the previous tone data. In the arrangement, a total of both the second tone data stored in the storage medium is limited, so that it is possible to reduce the circuit size compared with the case where all the data are stored.

Note that, various kinds of rounding processes may be performed as the aforementioned rounding process. When it is required to simplify the rounding process, it is preferable that the bit width adjusting means limits a total of bit widths of both the second tone data by rounding down the less significant bit.

In addition to the foregoing arrangement, it may be so arranged that: the bit width adjusting means changes a ratio, at which the bit width of the previous second tone data stored until the next time is included in the preset value, in accordance with at least one of (i) a type of an image and (ii) a temperature.

Here, in case where the preset value is limited so as to be smaller than twice the bit width of the current second tone data, when a ratio at which the bit width of the further previous second tone data is included in the preset value is excessively increased, the corrected previous second tone data can be influenced by the further previous second tone data more exactly, but cannot be influenced by the previous second tone data exactly. Thus, it is desired to set the ratio, at which the bit width of the further previous second tone data is included in the preset value, to be a value appropriately influenced by both the second tone data.

While, in case where a fast-moving image is inputted, the corrected tone data is susceptible to the further previous video data. Thus, when a type of an image so varies that an expected speed of movement varies, also an appropriate value of the foregoing ratio varies. Likewise, when temperature varies, also the response speed of the pixel varies. Thus, also the appropriate value of the foregoing ratio varies.

On the other hand, according to the foregoing arrangement, the bit width adjusting means changes a ratio, at which the bit width of the previous second tone data stored until the next time is included in the preset value, in accordance with at least one of (i) a type of an image and (ii) a temperature. Thus, it is possible to keep the foregoing ratio at an appropriate value regardless of a type of an image and/or a temperature. As a result, it is possible to keep high display quality of the image display device.

Incidentally, the driving device of the image display device may be realized by using a hardware, or may be realized by causing a computer or any type of computer device to carry out a program. That is, a program according to the present invention is a program causing a computer to operate as the foregoing means, and a storage medium according to the present invention stores the program.

When the program is carried out by the computer, the computer operates as the driving device of the image display device. Thus, as in the driving device of the image display device, it is possible to realize the driving device of the image display device, which can improve the response speed of the pixels and can reduce the circuit size and the computing amount, without apparently deteriorating the display quality of an image displayed in the pixels.

Further, an image display device according to the present invention includes the foregoing driving device. Moreover, a television receiver according to the present invention includes the image display device.

The image display device and the television receiver arranged in the foregoing manner include the driving device, so that it is possible to improve the response speed of the pixels and it is possible to reduce the circuit size and the computing amount without apparently deteriorating the display quality of an image displayed in the pixels.

Meanwhile, as described above, a driving device (21*j* to 21*p*) of an image display device (1) according to the present invention includes: tone conversion means (142 for example) for converting first tone data indicative of a current tone of each of pixels (sub-pixels SPIX (1, 1)) into second tone data having a γ property larger than a γ property of the first tone data; storage means (frame memory 131 for example) for storing current second tone data until the next time; and correction means (modulation processing section 133 for example) for correcting the current second tone data, in accordance with previous second tone data read out from the storage means, so as to facilitate tone transition from the previous second tone data to the current tone data, wherein a lowest possible limit of the second tone data which varies according to conversion of the first tone data is set to be higher than a lower limit of a representable (expressible) value range of the second tone data.

In the foregoing arrangement, the correction means corrects the current second tone data so as to emphasize the tone transition from the previous time to the current time, so that it is possible to improve the response speed of the pixels. Besides, in the foregoing arrangement, the tone conversion means converts the first tone data into the second tone data having a larger γ property. Further, a lowest possible limit of the second tone data which varies according to conversion of the first tone data is set to be higher than a lower limit of a representable value range of the second tone data.

Thus, in case where the pixel for displaying an image based on the second tone data displays a tone indicated by the second tone data, there are a larger number of dark tones than the case where the γ conversion is not performed. Further, a value of second tone data which corresponds to a lower limit (black level) of the first tone data is not the lower limit of the second tone data. Thus, the correction means can use second tone data indicative of a tone lower than a tone of the foregoing second tone data in emphasizing the tone transition, so that it is possible to improve the response speed of the pixels.

In addition to the foregoing arrangement, it may be so arranged that: a bit width of the second tone data is set to be wider than a bit width of the first tone data. Further, in addition to the foregoing arrangement, it may be so arranged that: the bit width of the first tone data is 8 bits, and the bit width of the second tone data is 10 bits. In these arrangements, the bit width of the second tone data is set to be wider than the bit width of the first tone data, so that the tone conversion means can perform the γ conversion with higher accuracy.

In addition to the foregoing arrangement, it may be so arranged that: the driving device includes: noise adding means for adding noise data and rounding a least significant bit having a predetermined bit width before inputting the second tone data to the storage means and the correction means; and noise generating means for generating the noise data so that the noise data added to the pixels of the same color which are adjacent to each other have random volumes, and supplying the noise data to the noise adding means. Further, in addition to the foregoing arrangement, it may be so arranged that: a bit width of the first tone data is 8 bits, an a bit width of the second tone data is 10 bits, and a bit width of the least significant bit is 2 bits.

Note that, various kinds of rounding processes may be performed as the aforementioned rounding process. When it is required to simplify the rounding process, it is preferable that the noise adding means generates the second tone data by rounding down the less significant bit.

In these arrangements, the bit width of the second tone data stored in the storage means is set to be shorter than the bit width of the second tone data that the tone conversion means generated by rounding the less significant bit. Thus, it is possible to reduce the storage capacity required in the storage means. Further, the bit width of the tone data processed by circuits (the storage means, the correction means, and the like) positioned after the noise adding means is reduced.

Thus, it is possible to reduce the circuit size and the computing amount of these circuits, and it is possible to reduce the number of wirings connecting the circuits and an area occupied by the wirings. Further, the noise generating means generates the noise data so that the noise data added to the second tone data of the same color which are adjacent to each other have random volumes. Thus, this arrangement does not bring about the pseudo outline unlike an arrangement in which: the less significant bit of the second tone data is merely truncated, so that the pseudo outline occurs in an image displayed in the pixels.

As a result, according to the foregoing arrangement, although the bit width of the second tone data stored in the storage means is shorter than the bit width of the second tone data generated by the tone conversion means, it is possible to keep the display quality of an image displayed in the pixels so that there is no apparent difference from the case where the less significant bit is not rounded.

Note that, in case where the noise adding means is provided at the following stage of the correction means, a noise is added to the data obtained after emphasizing the tone transition. Thus, the tone transition is excessively emphasized, so that the luminance of the pixel undesirably increases. As a result, the excessive emphasis of the tone transition may be recognized by the user of the image display device as the excessive brightness.

Alternatively, the tone transition is insufficiently emphasized, so that the luminance of the pixel undesirably decreases. As a result, the insufficient emphasis of the tone transition may be recognized by the user as the poor brightness. However, according to the foregoing arrangement, the correction means is provided at the following stage of the noise adding means. Thus, unlike the arrangement in which the correction means is provided at the previous stage of the noise adding means, it is possible to improve the response speed of the pixels without bringing about the excessive or poor brightness caused by the addition of the noise.

As a result, it is possible to prevent the display quality of an image displayed in the pixels from apparently deteriorating, and it is possible to reduce the circuit size and the computing amount.

Incidentally, the driving device of the image display device expressed in each of the various embodiments above, may further be realized in the form of a method of driving. They may further be implemented by using hardware, or they may be realized by causing a computer to carry out a method, wherein any such method may be implemented in the form of a program. That is, a program according to any of the embodiments of the present invention may be a program causing a computer to operate as any of the foregoing means, and any type of computer readable medium according to an embodiment of the present invention may store the program.

When the program is carried out by the computer (any type of computer device capable of running a computer program and/or reading from a computer readable medium), the computer operates as the driving device of the image display device. Thus, as in the driving device of the image display device, it is possible to realize the driving device of the image display device, which can improve the response speed of the pixels and can reduce the circuit size and the computing amount, without apparently deteriorating the display quality of an image displayed in the pixels.

A program in accordance with an embodiment of the present invention includes a program causing a computer to execute the steps constituting any of the aforementioned methods of driving a display. Such a computer running the program may operate as a driver for the display.

Any and all of these programs may be represented as a computer data signal. For example, if a computer receives the computer data signal embodied in a signal (for example, a carrier wave, sync signal, or any other signal) and runs a program, the computer may drive the display with any of the drive methods.

Any of these programs, when recorded on a computer readable storage medium, may be readily stored and distributed.

A computer reading the storage medium, may drive the display with any of the drive methods.

Further, an image display device according to an embodiment of the present invention includes the any of mentioned driving devices. Moreover, a television receiver according to an embodiment of the present invention includes any of the image display devices.

The image display device and the television receiver arranged in the foregoing manner include the driving device, so that it is possible to improve the response speed of the pixels.

Note that, the foregoing description explains the arrangement in which the rounding process is performed before storing data in the storage means. However, it may be so arranged that: instead of performing the rounding process before storing the data, the storage means compresses and stores data, which should be stored, by using a known compressing technique, and the first correction means or the correction means performs the rounding process before outputting the corrected video data.

An example is described as follows on the basis of the arrangement of FIG. 1 or FIG. 15. The truncation circuit (36•145) is omitted, and the memory control circuit (32•132) compresses the inputted data and stores thus compressed data into the frame memory (31•131), and the data from the frame memory is decompressed and outputted. Further, the modulation processing section (33•133) rounds the corrected video data, and outputs the data as the corrected video data D2 (i, j, k).

Also in the arrangement, the noise is added before the first correction means or the correction means corrects the data. As such, it is possible to improve the response speed of the pixels while preventing the occurrence of the excessive or poor brightness caused by adding the noise.

Further, the data stored in the storage means is compressed by performing the compressing process. As such, it is possible to reduce the storage capacity required in the storage means. Further, the rounding process is performed by the first correction means or the correction means. Thus, it is possible to reduce a bit width of vide data which needs to be processed by a circuit (for example, the data signal line driving circuit 3 and the like of the panel 11 of the image display device 1) positioned at the following stage of the first correction means or the correction means. Further, the rounding process is performed after the noise is added, so that it is possible to suppress the occurrence of the pseudo outline unlike the arrangement in which merely the rounding process is performed.

As a result, it is possible to realize a driving device of an image display device in which: it is possible to improve the response speed of the pixels without apparently deteriorating the display quality of an image displayed in the pixels, and it is possible to reduce a circuit size and a computing amount.

However, as explained in the respective embodiments, it is possible to further reduce the circuit size by causing the means (for example the noise adding means or the like) positioned at a further previous stage to round the less significant bit.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving device of an image display device, comprising:

an input terminal for receiving first tone data indicative of a current tone of each of pixels;

noise adding means for adding noise data to the first tone data, and for rounding a less significant bit whose bit width is predetermined, so as to generate second tone data;

noise generating means for generating the noise data such that the noise data added to the first tone data supplied to the pixels of the same color which are adjacent to each other have random volumes, and for supplying the noise data to the noise adding means;

storage means for storing current second tone data of the pixel until next second tone data is inputted; and first correction means for correcting the current second tone data, in accordance with previous second tone data read out from the storage means, so as to facilitate tone transition from the previous second tone data to the current second tone data.

2. The driving device as set forth in claim 1, wherein the noise generating means generates the noise data so that each volume of the noise data added to the first tone data supplied to the same pixel is constant every time the noise data is added.

3. The driving device as set forth in claim 2, wherein:

the first tone data is represented by 8 bits, and a maximum value of an absolute value of the noise data is set to be in a range from 1 tone to 32 tones, and wherein the noise adding means, the noise generating means, the storage means, and the first correction means are provided for each color of R, G, and B.

4. The driving device as set forth in claim 2, comprising least significant bit control means for varying a least significant bit of the second tone data in accordance with a predetermined pattern so that a tone obtained by averaging the second tone data supplied to the same pixel corresponds to a tone whose least significant bit has not been rounded by the noise adding means.

5. The driving device as set forth in claim 4, wherein the first correction means stops correcting the current second tone data when a difference between the previous second tone data and the current second tone data corresponds to a possible difference caused merely by addition of the noise data and variation of the least significant bit that is performed by the least significant bit control means.

6. The driving device as set forth in claim 5, wherein the pixels are divided into a plurality of areas, said driving device further comprising:

noise amount control means for averaging first tone data supplied to the pixels in each of the areas, and for controlling the noise generating means so that a maximum value of an absolute value of the noise data is relatively smaller in a case where an average value of the first tone data is relatively small than in a case where the average value of the first tone data is relatively high.

7. The driving device as set forth in claim 6, wherein:

a video signal including the first tone data inputted to the input terminal is obtained by dividing an image into a plurality of blocks and encoding each of the blocks, and wherein the areas correspond to the blocks.

8. The driving device as set forth in claim 1, wherein the noise generating means generates the noise data so that the noise data added to the first tone data supplied to the same pixel have random sizes.

9. The driving device as set forth in claim 8, wherein the first correction means stops correcting the current second tone data when a difference between the previous second tone data and the current second tone data corresponds to a possible difference caused merely by addition of the noise data.

10. The driving device as set forth in claim 9, wherein:

the first tone data is represented by 8 bits, and a maximum value of an absolute value of the noise data is set to be in a range from 1 tone to 8 tones, and the noise adding means, the noise generating means, the storage means, and the first correction means are provided for each color of R, G, and B.

11. The driving device as set forth in claim 8, wherein:

the first tone data is represented by 8 bits, and a maximum value of an absolute value of the noise data is set to be in a range from 1 tone to 8 tones, and the noise adding means, the noise generating means, the storage means, and the first correction means are provided for each color of R, G, and B.

12. The driving device as set forth in claim 8, comprising least significant bit control means for varying a least significant bit of the second tone data in accordance with a predetermined pattern so that a tone obtained by averaging the second tone data supplied to the same pixel corresponds to a tone whose least significant bit has not been rounded by the noise adding means.

13. The driving device as set forth in claim 12, wherein the first correction means stops correcting the current second tone data when a difference between the previous second tone data and the current second tone data corresponds to a possible difference caused merely by addition of the noise data and variation of the least significant bit that is performed by the least significant bit control means.

14. The driving device as set forth in claim 13, wherein the pixels are divided into a plurality of areas, the driving device further comprising:

noise amount control means for averaging the first tone data supplied to the pixels in each of the areas, and for controlling the noise generating means so that a maximum value of an absolute value of the noise data is relatively smaller in a case where an average value of the first tone data is relatively small than in a case where the average value of the first tone data is relatively high.

15. The driving device as set forth in claim 14, wherein:

a video signal including the first tone data inputted to the input terminal is obtained by dividing an image into a plurality of blocks and encoding each of the blocks, and wherein the areas correspond to the blocks.

16. The driving device as set forth in claim 1, comprising least significant bit control means for varying a least significant bit of the second tone data in accordance with a predetermined pattern so that a tone obtained by averaging the second tone data supplied to the same pixel corresponds to a tone whose least significant bit has not been rounded by the noise adding means.

17. The driving device as set forth in claim 16, wherein the first correction means stops correcting the current second tone data when a difference between the previous second tone data and the current second tone data corresponds to a possible difference caused merely by addition of the noise data and variation of the least significant bit that is performed by the least significant bit control means.

18. The driving device as set forth in claim 17, wherein the pixels are divided into a plurality of areas, the driving device further comprising:

noise amount control means for averaging the first tone data supplied to the pixels in each of the areas, and for controlling the noise generating means so that a maximum value of an absolute value of the noise data is relatively smaller in a case where an average value of the first tone data is relatively small than in a case where the average value of the first tone data is relatively high.

19. The driving device as set forth in claim 18, wherein:

a video signal including the first tone data inputted to the input terminal is obtained by dividing an image into a plurality of blocks and encoding each of the blocks, and wherein the areas correspond to the blocks.

20. The driving device as set forth in claim 1, wherein the storage means is for storing both the current second tone data and the previous second tone data, the driving device further comprising:

second correction means for correcting the previous second tone data of the first correction means so that the previous second tone data approaches further previous second tone data when a combination of the further previous second tone data and the previous second tone data stored by the storage means is a predetermined combination.

21. The driving device as set forth in claim 20, further comprising:

bit width adjusting means for limiting a total of a bit width, of the current second tone data and a bit width of the previous second tone data so that the total corresponds to a preset value, by rounding a less significant bit of at least one of the current second tone data and the previous second tone data, before the storage means stores the current second tone data and the previous second tone data.

22. The driving device as set forth in claim 21, wherein the bit width adjusting means changes a ratio, at which the bit width of the previous second tone data is contained in the preset value, in accordance with at least one of a type of an image and a temperature.

23. The driving device as set forth in claim 21, wherein the bit width adjusting means rounds the less significant bit by truncating the less significant bit.

24. The driving device as set forth in claim 1, comprising:

tone conversion means, provided between the input terminal and the noise adding means, for converting the first tone data into tone data having a $\gamma$ property larger than a $\gamma$ property of the first tone data, wherein a possible lowest limit of the tone data having been subjected to $\gamma$ conversion is set to be higher than a lower limit of a representable value range of the tone data, said tone data varying according to conversion of the first tone data.

25. The driving device as set forth in claim 24, wherein:
a bit width of the first tone data is 8 bits, and
a bit width of the tone data having been subjected to the γ conversion is 10 bits, and
a bit width of the less significant bit is 2 bits.

26. The driving device as set forth in claim 1, wherein
the noise adding means rounds the less significant bit by truncating the less significant bit.

27. An image display device including the driving device as set forth in claim 1.

28. The image display device as set forth in claim 27, wherein the image display device is a television receiver.

29. An image display device, which includes pixels and a driving device, comprising:
an input terminal for receiving first tone data indicative of a current tone of each of pixels;
noise adding means for adding noise data to the first tone data, and for rounding a less significant bit whose bit width is predetermined, so as to generate second tone data;
noise generating means for generating the noise data such that the noise data added to the first tone data supplied to the pixels of the same color which are adjacent to each other have random volumes, and for supplying the noise data to the noise adding means;
storage means for storing current second tone data of the pixel until next second tone data is inputted; and
first correction means for correcting the current second tone data, in accordance with previous second tone data read out from the storage means, so as to facilitate tone transition from the previous second tone data to the current tone data.

30. The image display device as set forth in claim 29, wherein
the image display device is a television receiver.

31. A computer readable medium, storing a program which causes a computer to function as:
noise adding means for adding noise data to first tone data inputted to an input terminal receiving the first tone data indicative of a current tone of each of pixels, and rounding a less significant bit whose bit width is predetermined, so as to generate second tone data;
noise generating means for generating the noise data so that the noise data added to the first tone data supplied to the pixels of the same color which are adjacent to each other have random volumes, and supplying the noise data to the noise adding means;
storage means for storing current second tone data of the pixel until next second tone data is inputted; and
first correction means for correcting the current second tone data, in accordance with previous second tone data read out from the storage means, so as to facilitate tone transition from the previous second tone data to the current tone data.

32. A driving device of an image display device, comprising:
tone conversion means for converting first tone data indicative of a current tone of each of pixels into second tone data having a γ property larger than a γ property of the first tone data;
storage means for storing current second tone data of the pixel until next time; and
correction means for correcting the current second tone data, in accordance with previous second tone data read out from the storage means, so as to facilitate tone transition from the previous second tone data to the current tone data, wherein a lowest possible limit of the second tone data which varies according to conversion of the first tone data is set to be higher than a lower limit of a representable value range of the second tone data.

33. The driving device as set forth in claim 32, wherein
a bit width of the second tone data is set to be wider than a bit width of the first tone data.

34. The driving device as set forth in claim 33, wherein
the bit width of the first tone data is 8 bits, and the bit width of the second tone data is 10 bits.

35. The driving device as set forth in claim 32, comprising:
noise adding means for adding noise data and rounding a less significant bit having a predetermined bit width before inputting the second tone data to the storage means and the correction means; and
noise generating means for generating the noise data so that the noise data added to the pixels of the same color which are adjacent to each other have random volumes, and supplying the noise data to the noise adding means.

36. The driving device as set forth in claim 35, wherein:
a bit width of the first tone data is 8 bits, and
a bit width of the second tone data is 10 bits, and
a bit width of the less significant bit is 2 bits.

37. The driving device as set forth in claim 35, wherein
the noise adding means rounds the less significant bit by truncating the less significant bit.

38. The driving device as set forth in claim 32, further comprising:
noise adding means for adding noise data before inputting the second tone data to the storage means and the correction means; and
noise generating means for generating the noise data such that the noise data added to the pixels of the same color which are adjacent to each other have random volumes, and supplying the noise data to the noise adding means, wherein the storage means is for compressing and storing current second tone data of the pixel until next second tone data is inputted, and wherein the correction means rounds a less significant bit whose bit width is predetermined before outputting the current second tone data that has been corrected.

39. An image display device including the driving device as set forth in claim 38.

40. The image display device as set forth in claim 39, wherein the image display device is a television receiver.

41. A computer readable medium, storing a program which causes a computer to function as:
tone conversion means for converting first tone data indicative of a current tone of each of pixels into second tone data having a γ property larger than a γ property of the first tone data;
storage means for storing current second tone data of the pixel until next time; and
correction means for correcting the current second tone data, in accordance with previous second tone data read out from the storage means, so as to facilitate tone transition from the previous second tone data to the current tone data, wherein
a lowest possible limit of the second tone data which varies according to conversion of the first tone data is set to be higher than a lower limit of a representable value range of the second tone data.

42. An image display device, which includes pixels and a driving device for generating corrected second tone data so as to drive the pixels, said driving device comprising:

tone conversion means for converting first tone data indicative of a current tone of each of pixels into second tone data having a γ property larger than a γ property of the first tone data;

storage means for storing current second tone data of the pixel until next time; and correction means for correcting the current second tone data, in accordance with previous second tone data read out from the storage means, so as to facilitate tone transition from the previous second tone data to the current tone data, wherein a lowest possible limit of the second tone data which varies according to conversion of the first tone data is set to be higher than a lower limit of a representable value range of the second tone data.

43. The image display device as set forth in claim 42, wherein the image display device is a television receiver.

44. A driving device of an image display device, comprising:

an input terminal for receiving first tone data indicative of a current tone of each of pixels;

noise adding means for adding noise data to the first tone data so as to generate second tone data;

noise generating means for generating the noise data such that the noise data added to the first tone data supplied to the pixels of the same color which are adjacent to each other have random volumes, and for supplying the noise data to the noise adding means;

storage means for compressing and storing current second tone data of the pixel until next second tone data is inputted; and first correction means for correcting the current second tone data, in accordance with previous second tone data read out from the storage means, so as to facilitate tone transition from the previous second tone data to-the current second tone data, and for rounding a less significant bit whose bit width is predetermined, so as to output the current second tone data that has been corrected.

45. An image display device including the driving device as set forth in claim 44.

46. The image display device as set forth in claim 45, wherein the image display device is a television receiver.

47. A driving device of an image display device, comprising:

noise generating means for generating noise data;

noise adding means for adding the generated noise data to received first tone data, and for rounding at least one less significant bit so as to generate second tone data;

storage means for storing the second tone data of the pixel; and correction means for correcting current second tone data of the pixel, in accordance with previous second tone data read out from the storage means, so as to facilitate tone transition from the previous second tone data to the current second tone data.

48. The driving device as set forth in claim 47, wherein the noise generating means generates noise data such that the noise data to be added to the first tone data supplied to the pixels of the same color which are adjacent to each other have random volumes.

49. The driving device as set forth in claim 48, wherein the noise generating means generates noise data so that each volume of the noise data added to the first tone data supplied to the same pixel is constant every time the noise data is added.

50. The driving device as set forth in claim 47, wherein:

a video signal including the received first tone data is obtained by dividing an image into a plurality of blocks and encoding each of the blocks.

51. The driving device as set forth in claim 47, wherein:

the first tone data is represented by 8 bits, a maximum value of an absolute value of the noise data is set to be in a range from 1 tone to 32 tones, and the second tone data is represented by 6 bits.

52. The driving device as set forth in claim 51, wherein the noise adding means, the noise generating means, the storage means, and the correction means are provided for each color of R, G, and B.

53. The driving device as set forth in claim 47, wherein:

the first tone data is represented by 10 bits and the second tone data is represented by 8 bits.

54. The driving device as set forth in claim 47, wherein the noise generating means generates the noise data so that the noise data added to the first tone data supplied to the same pixel have random sizes.

55. The driving device as set forth in claim 54, wherein the correction means stops correcting the current second tone data when a difference between the previous second tone data and the current second tone data corresponds to a possible difference caused merely by addition of the noise data.

56. The driving device as set forth in claim 55, wherein:

the first tone data is represented by 8 bits, and a maximum value of an absolute value of the noise data is set to be in a range from 1 tone to 8 tones, and wherein the second tone data is represented by 6 bits.

57. The driving device as set forth in claim 56, wherein:

the noise adding means, the noise generating means, the storage means, and the correction means are provided for each color of R, G, and B.

58. The driving device as set forth in claim 54, wherein:

the first tone data is represented by 8 bits, and a maximum value of an absolute value of the noise data is set to be in a range from 1 tone to 8 tones, and the noise adding means, the noise generating means, the storage means, and the correction means are provided for each color of R, G, and B.

59. The driving device as set forth in claim 58, comprising least significant bit control means for varying a least significant bit of the second tone data in accordance with a predetermined pattern so that a tone obtained by averaging the second tone data supplied to the same pixel corresponds to a tone whose least significant bit has not been rounded by the noise adding means.

60. The driving device as set forth in claim 59, wherein the correction means stops correcting the current second tone data when a difference between the previous second tone data and the current second tone data corresponds to a possible difference caused merely by addition of the noise data and variation of the least significant bit that is performed by the least significant bit control means.

61. The driving device as set forth in claim 60, wherein the pixels are divided into a plurality of areas, the driving device further comprising:

noise amount control means for averaging the first tone data supplied to the pixels in each of the areas, and for controlling the noise generating means so that a maximum value of an absolute value of the noise data is relatively smaller in a case where an average value of the first tone data is relatively small than in a case where the average value of the first tone data is relatively high.

62. The driving device as set forth in claim 61, wherein:

a video signal including the first tone data is obtained by dividing an image into a plurality of blocks and encoding each of the blocks, and wherein the areas correspond to the blocks.

63. The driving device as set forth in claim 47, further comprising:

least significant bit control means for varying a least significant bit of the second tone data in accordance with a predetermined pattern so that a tone obtained by averaging the second tone data supplied to the same pixel corresponds to a tone whose least significant bit has not been rounded by the noise adding means.

64. The driving device as set forth in claim 63, wherein the correction means stops correcting the current second tone data when a difference between the previous second tone data and the current second tone data corresponds to a possible difference caused merely by addition of the noise data and variation of the least significant bit that is performed by the least significant bit control means.

65. The driving device as set forth in claim 64, wherein the pixels are divided into a plurality of areas, the driving device further comprising:

noise amount control means for averaging the first tone data supplied to the pixels in each of the areas, and for controlling the noise generating means so that a maximum value of an absolute value of the noise data is relatively smaller in a case where an average value of the first tone data is relatively small than in a case where the average value of the first tone data is relatively high.

66. The driving device as set forth in claim 65, wherein:

a video signal including the first tone data is obtained by dividing an image into a plurality of blocks and encoding each of the blocks, and wherein the areas correspond to the blocks.

67. The driving device as set forth in claim 47, wherein the storage means is for storing both the current second tone data and the previous second tone data, the driving device further comprising:

second correction means for correcting the previous second tone data of the correction means so that the previous second tone data approaches further previous second tone data when a combination of the further previous second tone data and the previous second tone data stored by the storage means is a predetermined combination.

68. The driving device as set forth in claim 67, further comprising:

bit width adjusting means for limiting a total of a bit width of the current second tone data and a bit width of the previous second tone data so that the total corresponds to a preset value.

69. The driving device as set forth in claim 68, wherein the bit width adjusting means limits a total of a bit width by rounding a less significant bit of at least one of the current second tone data and the previous second tone data, before the storage means stores the current second tone data and the previous second tone data.

70. The driving device as set forth in claim 69, wherein the bit width adjusting means changes a ratio, at which the bit width of the previous second tone data is contained in the preset value, in accordance with at least one of a type of an image and a temperature.

71. The driving device as set forth in claim 68, wherein the bit width adjusting means changes a ratio, at which the bit width of the previous second tone data is contained in the preset value, in accordance with at least one of a type of an image and a temperature.

72. The driving device as set forth in claim 47, comprising:

conversion means for converting, prior to the noise adding means, the first tone data into tone data having a γ property relatively larger than a v property of the first tone data.

73. The driving device as set forth in claim 72, wherein the correction means uses rounded off bits for correcting current second tone data of the pixel.

74. The driving device as set forth in claim 72, wherein a possible lowest limit of the tone data having been subjected to γ conversion is set to be higher than a lower limit of a representable value range of the tone data, said tone data varying according to conversion of the first tone data.

75. The driving device as set forth in claim 70, wherein:

a bit width of the first tone data is 8 bits, and a bit width of the tone data having been subjected to the γ conversion is 10 bits, and a bit width of the at least one less significant bit is 2 bits.

76. The driving device as set forth in claim 72, wherein:

a bit width of the first tone data is 8 bits, and a bit width of the tone data having been subjected to the γ conversion is 10 bits, and a bit width of the at least one less significant bit is 2 bits.

77. The driving device as set forth in claim 76, wherein the correction means uses the less significant 2 bits for correcting current second tone data of the pixel.

78. An image display device including the driving device as set forth in claim 47.

79. The image display device as set forth in claim 78, wherein the image display device is a television receiver.

80. The driving device as set forth in claim 47, wherein the noise adding means rounds the at least one less significant bit by truncating the less significant bit.

81. A driving device of an image display device, comprising:

noise generating means for generating noise data;

noise adding means for adding the generated noise data to received first tone data so as to generate second tone data;

storage means for storing the second tone data of the pixel; and correction means for correcting the current second tone data of the pixel, in accordance with previous second tone data read out from the storage means, so as to facilitate tone transition from the previous second tone data to the current second tone data, and for rounding at least one less significant bit so as to output corrected current second tone data.

82. An image display device including the driving device as set forth in claim 81.

83. The image display device as set forth in claim 82, wherein the image display device is a television receiver.

84. A driving method for an image display device, comprising:

generating noise data;

adding the generated noise data to received first tone data;

rounding at least one less significant bit from the added generated noise data and first tone data so as to generate second tone data;

storing the second tone data of the pixel; and correcting current second tone data of the pixel, in accordance with the stored previous second tone data, so as to facilitate tone transition from the previous second tone data to the current second tone data.

85. The method as set forth in claim 84, wherein the noise generating includes generating noise data such that the noise data to be added to the first tone data supplied to the pixels of the same color which are adjacent to each other have random volumes.

86. The method as set forth in claim 85, wherein the noise generating includes generating noise data so that each volume of the noise data added to the first tone data supplied to the same pixel is constant every time the noise data is added.

87. The method as set forth in claim 84, wherein:

a video signal including the received first tone data is obtained by dividing an image into a plurality of blocks and encoding each of the blocks.

88. The method as set forth in claim 84, wherein:

the first tone data is represented by 8 bits, a maximum value of an absolute value of the noise data is set to be in a range from 1 tone to 32 tones, and the second tone data is represented by 6 bits.

89. The method as set forth in claim 88, wherein the noise adding, the noise generating, the storing, and the correcting are provided for each color of R, G, and B.

90. The method as set forth in claim 84, wherein:

the first tone data is represented by 10 bits and the second tone data is represented by 8 bits.

91. The method as set forth in claim 84, wherein the noise generating includes generating the noise data so that the noise data added to the first tone data supplied to the same pixel have random sizes.

92. The method as set forth in claim 91, wherein the correcting of the current second tone data is stopped when a difference between the previous second tone data and the current second tone data corresponds to a possible difference caused merely by addition of the noise data.

93. The method as set forth in claim 92, wherein:

the first tone data is represented by 8 bits, and a maximum value of an absolute value of the noise data is set to be in a range from 1 tone to 8 tones, and wherein the second tone data is represented by 6 bits.

94. The method as set forth in claim 93, wherein:

the noise adding, the noise generating, the storing, and the correcting are provided for each color of R, G, and B.

95. The method as set forth in claim 91, wherein:

the first tone data is represented by 8 bits, and a maximum value of an absolute value of the noise data is set to be in a range from 1 tone to 8 tones, and the noise adding, the noise generating, the storing, and the correcting are provided for each color of R, 0, and B.

96. The method as set forth in claim 95, further comprising:

varying a least significant bit of the second tone data in accordance with a predetermined pattern so that a tone obtained by averaging the second tone data supplied to the same pixel corresponds to a tone whose least significant bit has not been rounded by the noise adding.

97. The method as set forth in claim 96, wherein the correcting of the current second tone data is stopped when a difference between the previous second tone data and the current second tone data corresponds to a possible difference caused merely by addition of the noise data and variation of the least significant bit that is performed by the varying.

98. The method as set forth in claim 97, wherein the pixels are divided into a plurality of areas, the method further comprising:

averaging the first tone data supplied to the pixels in each of the areas, and controlling the noise generating so that a maximum value of an absolute value of the noise data is relatively smaller in a case where an average value of the first tone data is relatively small than in a case where the average value of the first tone data is relatively high.

99. The method as set forth in claim 98, wherein:

a video signal including the first tone data is obtained by dividing an image into a plurality of blocks and encoding each of the blocks, and wherein the areas correspond to the blocks.

100. The method as set forth in claim 84, further comprising:

varying a least significant bit of the second tone data in accordance with a predetermined pattern so that a tone obtained by averaging the second tone data supplied to the same pixel corresponds to a tone whose least significant bit has not been rounded by the noise adding.

101. The method as set forth in claim 100, wherein the correcting of the current second tone data is stopped when a difference between the previous second tone data and the current second tone data corresponds to a possible difference caused merely by addition of the noise data and variation of the least significant bit that is performed by the varying.

102. The method as set forth in claim 101, wherein the pixels are divided into a plurality of areas, the method further comprising:

averaging the first tone data supplied to the pixels in each of the areas, and controlling the noise generating so that a maximum value of an absolute value of the noise data is relatively smaller in a case where an average value of the first tone data is relatively small than in a case where the average value of the first tone data is relatively high.

103. The method as set forth in claim 102, wherein:

a video signal including the first tone data is obtained by dividing an image into a plurality of blocks and encoding each of the blocks, and wherein the areas correspond to the blocks.

104. The method as set forth in claim 84, wherein both the current second tone data and the previous second tone data are stored, the method further comprising:

second correcting the previous second tone data previously corrected in the correcting step, so that the previous second tone data approaches further previous second tone data when a combination of the further previous second tone data and the stored previous second tone data is a predetermined combination.

105. The method as set forth in claim 104, further comprising:

limiting a total of a bit width of the current second tone data and a bit width of the previous second tone data so that the total corresponds to a preset value.

106. The method as set forth in claim 105, wherein the limiting limits a total of a bit width by rounding a less significant bit of at least one of the current second tone data and the previous second tone data, before the storing of the current second tone data and the previous second tone data.

107. The method as set forth in claim 106, wherein a ratio is changed, at which the bit width of the previous second tone data is contained in the preset value, in accordance with at least one of a type of an image and a temperature.

108. The method as set forth in claim 105, wherein a ratio is changed, at which the bit width of the previous second tone data is contained in the preset value, in accordance with at least one of a type of an image and a temperature.

109. The method as set forth in claim 84, further comprising:

converting, prior to the noise adding, the first tone data into tone data having a γ property relatively larger than a γ property of the first tone data.

110. The method as set forth in claim 109, wherein the correcting use rounded off bits for correcting current second tone data of the pixel.

111. The method as set forth in claim 109, wherein a possible lowest limit of the tone data having been subjected to γ conversion is set to be higher than a lower limit of a representable value range of the tone data, said tone data varying according to conversion of the first tone data.

112. The method as set forth in claim 111, wherein:

a bit width of the first tone data is 8 bits, and a bit width of the tone data having been subjected to the γ conversion is 10 bits, and a bit width of the at least one less significant bit is 2 bits.

113. The method as set forth in claim 109, wherein:

a bit width of the first tone data is 8 bits, and a bit width of the tone data having been subjected to the γ conversion is 10 bits, and a bit width of the at least one less significant bit is 2 bits.

114. The method as set forth in claim 112, wherein the correcting uses the less significant 2 bits for correcting current second tone data of the pixel.

115. An image display method including the driving method as set forth in claim 84.

116. The image display method as set forth in claim 115, wherein the image display method is for a television receiver.

117. A driving method for an image display device, comprising:

generating noise data;

adding the generated noise data to received first tone data so as to generate second tone data;

storing the second tone data of the pixel;

correcting the current second tone data of the pixel, in accordance with stored previous second tone data, so as to facilitate tone transition from the previous second tone data to the current second tone data; and rounding at least one less significant bit so as to output corrected current second tone data.

118. A computer readable medium, including program segments for, when executed on a computer device, causing the computer device to implement a method comprising:

generating noise data;

adding the generated noise data to received first tone data;

rounding at least one less significant bit from the added generated noise data and first tone data so as to generate second tone data;

storing the second tone data of the pixel; and correcting current second tone data of the pixel, in accordance with the stored previous second tone data, so as to facilitate tone transition from the previous second tone data to the current second tone data.

119. A computer readable medium, including program segments for, when executed on a computer device, causing the computer device to implement a method comprising:

generating noise data;

adding the generated noise data to received first tone data so as to generate second tone data;

storing the second tone data of the pixel;

correcting the current second tone data of the pixel, in accordance with stored previous second tone data, so as to facilitate tone transition from the previous second tone data to the current second tone data; and rounding at least one less significant bit so as to output corrected current second tone data.

* * * * *